US010296033B2

(12) United States Patent
Adachi

(10) Patent No.: US 10,296,033 B2
(45) Date of Patent: May 21, 2019

(54) SUBSTRATE VOLTAGE CONTROL CIRCUIT

(71) Applicant: Panasonic Corporation, Osaka (JP)

(72) Inventor: Kazuhiro Adachi, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 33 days.

(21) Appl. No.: 15/610,674

(22) Filed: Jun. 1, 2017

(65) Prior Publication Data

US 2017/0357283 A1 Dec. 14, 2017

(30) Foreign Application Priority Data

| | | |
|---|---|---|
| Jun. 8, 2016 | (JP) | 2016-114282 |
| Jun. 8, 2016 | (JP) | 2016-114283 |
| Jun. 8, 2016 | (JP) | 2016-114400 |
| Jan. 16, 2017 | (JP) | 2017-005222 |

(51) Int. Cl.

| | |
|---|---|
| ***G05F 1/10*** | (2006.01) |
| ***G05F 3/02*** | (2006.01) |
| ***G05F 3/20*** | (2006.01) |

(52) U.S. Cl.
CPC ..... *G05F 3/205* (2013.01)

(58) Field of Classification Search
CPC ..... G05F 3/205
USPC ..... 327/537
See application file for complete search history.

(56) References Cited

U.S. PATENT DOCUMENTS

| | | | | |
|---|---|---|---|---|
| 6,188,267 | B1 | 2/2001 | Sanchez et al. | |
| 2007/0115706 | A1* | 5/2007 | Sells | H02J 7/0034 363/132 |
| 2009/0206363 | A1 | 8/2009 | Machida et al. | |
| 2012/0217542 | A1 | 8/2012 | Morita | |
| 2012/0280728 | A1 | 11/2012 | Hussein et al. | |

FOREIGN PATENT DOCUMENTS

| | | |
|---|---|---|
| JP | 5-268028 | 10/1993 |
| JP | 2000-502513 | 2/2000 |
| JP | 2009-200149 | 9/2009 |
| JP | 2010-045742 | 2/2010 |
| JP | 2012-249509 | 12/2012 |
| WO | 2011/064955 | 6/2011 |

* cited by examiner

*Primary Examiner* — Metasebia T Retebo
(74) *Attorney, Agent, or Firm* — McDermott Will & Emery LLP

(57) ABSTRACT

A substrate voltage control circuit comprising: a first connection terminal; a second connection terminal; a substrate voltage control terminal; a first switch having a first source, a first drain, and a first gate, the first source being connected to the substrate voltage control terminal, the first drain being connected to the first connection terminal; a first resistor connected between the first gate and the second connection terminal; a second switch having a second source, a second drain, and a second gate, the second source being connected to the substrate voltage control terminal, the second drain being connected to the second connection terminal; and a second resistor connected between the second gate and the first connection terminal.

10 Claims, 21 Drawing Sheets

SUBSTRATE VOLTAGE CONTROL CIRCUIT

BACKGROUND

1. Technical Field

The present disclosure relates to a circuit that controls voltage at a substrate terminal of a bidirectional switching device.

2. Description of the Related Art

Bidirectional switching devices relating to embodiments of the present disclosure are semiconductor devices each of which is formed on a single chip and is capable of performing control such that two source terminals are electrically short-circuited (ON state) or are open-circuited (OFF state) (see International Publication No. 2011/064955). When voltage at a first source terminal among the two source terminals is higher than voltage at a second source terminal among the two source terminals and the bidirectional switching device is in the ON state, the bidirectional switching device is capable of conducting current from the first source terminal to the second source terminal. When voltage at the second source terminal is higher than voltage at the first source terminal and the bidirectional switching device is in the ON state, the bidirectional switching device is capable of conducting current from the second source terminal to the first source terminal.

Bidirectional switching devices can be employed, for example, as power devices such as main switches of power converters of matrix converters.

International Publication No. 2011/064955 discloses a control circuit (103) that sets the substrate voltage of a bidirectional switching device to the lower one of the voltages at the two source terminals so as to stabilize operation of the bidirectional switching device (see FIG. 5). In this control circuit (103), a parallel circuit of a diode (135) and a resistor (136) is connected between a substrate terminal (SUB) and the second source terminal (S2), and a parallel circuit of a diode (133) and a resistor (134) is similarly connected between the substrate terminal (SUB) and the first source terminal (S1). The cathode terminal of the diode (135) is connected to the second source terminal (S2), and the anode terminal of the diode (135) is connected to the substrate terminal (SUB). The cathode terminal of the diode (133) is connected to the first source terminal (S1), and the anode terminal of the diode (133) is connected to the substrate terminal (SUB).

SUMMARY

One non-limiting and exemplary embodiment provides a substrate voltage control circuit that controls a bidirectional switching device to operate with stable switching characteristics and with a reduced switching-characteristics variance between two current-flow directions.

In one general aspect, the techniques disclosed here feature a substrate voltage control circuit including; a first connection terminal; a second connection terminal; a substrate voltage control terminal; a first switch having a first source, a first drain, and a first gate, the first source being connected to the substrate voltage control terminal, the first drain being connected to the first connection terminal; a first resistor connected between the first gate and the second connection terminal; a second switch having a second source, a second drain, and a second gate, the second source being connected to the substrate voltage control terminal, the second drain being connected to the second connection terminal; and a second resistor connected between the second gate and the first connection terminal.

It should be noted that general or specific embodiments may be implemented as an element, a device, a module, a system, an integrated circuit, a method, a computer program, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
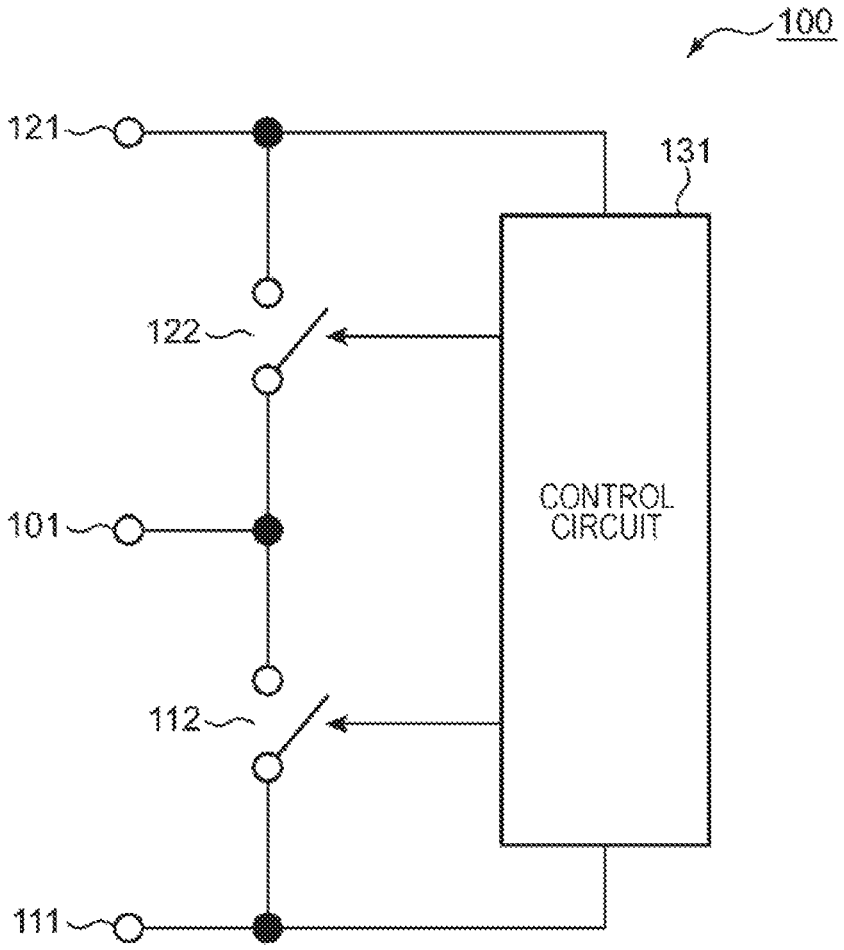
FIG. 1 is a diagram illustrating a substrate voltage control circuit according to a basic configuration of embodiments of the present disclosure.

The control circuit (103) disclosed in International Publication No. 2011/064955 described above sometimes fails to set the voltage at the substrate terminal to the lower one of the voltages at the two source terminals.

The following description will be given of the case where voltage at the source terminal (S1) is lower than voltage at the source terminal (S2) among the two source terminals. In this case, if voltage at the substrate terminal (SUB) is higher than the voltage at the source terminal (S1), the diode (133) is in the ON state and conducts current from the anode terminal to the cathode terminal. Consequently, the voltage at the substrate terminal (SUB) is successfully decreased to be close to the voltage at the source terminal (S1).

However, if the voltage at the substrate terminal (SUB) is lower than the voltage at the source terminal (S1), voltage at the cathode terminal is higher than voltage at the anode terminal. Thus, the diode (133) does not turn ON and does not conduct current. In this case, the control circuit (103) fails to increase the voltage at the substrate terminal (SUB) to the voltage at the source terminal (S1). The same situation occurs when the voltage at the source terminal (S2) is lower than the voltage at the source terminal (S1) and the voltage at the substrate terminal (SUB) is lower than the voltage at the source terminal (S2).

That is, the technique disclosed in International Publication No. 2011/064955 fails to increase the voltage at the substrate terminal (SUB) to be close to the lower one of the voltages at the two source terminals when the voltage at the substrate terminal (SUB) is lower than the lower one of the voltages at the two source terminals. Accordingly, the technique disclosed in International Publication No. 2011/064955 fails to control a bidirectional switching device to operate with stable switching characteristics and with a reduced switching-characteristics variance between two current-flow directions.

Embodiments of the present disclosure cope with the above issue and provide a substrate voltage control circuit that controls a bidirectional switching device to operate with stable switching characteristics and with a reduced switching-characteristics variance between two current-flow directions.

Underlying Knowledge Forming Basis of the Present Disclosure

Transistors called bidirectional gate injection transistors (GITs) are known as power devices used in matrix converters or the like. Bidirectional GITs implement the state of being normally off and low on-state resistance by using gallium nitride (GaN) having a wide bandgap.

Bidirectional GITs have an issue of unbalanced switching characteristics between two directions since voltage at the substrate terminal varies. To cope with such an issue, a technique of setting the voltage at the substrate terminal (SUB) of a bidirectional switching device to the lower one of the voltages at two source terminals is known as described in International Publication No. 2011/064955 cited above.

However, as described above, the technique of International Publication No. 2011/064955 fails to increase the voltage at the substrate terminal (SUB) to be close to the lower one of the voltages at the two source terminals when the voltage at the substrate terminal (SUB) is lower than the lower one of the voltages at the two source terminals.

Accordingly, a substrate voltage control circuit according to a first aspect of the present disclosure aims to set the voltage at a substrate voltage control terminal, which is connected to a substrate terminal of a bidirectional switching device, to the lower one of voltage at a first source connection terminal and voltage at a second source connection terminal even if the voltage at the substrate voltage control terminal is lower than the lower one of the voltage at the first source connection terminal and the voltage at the second source connection terminal.

The technique of International Publication No. 2011/064955 also fails to control a bidirectional switching device to operate with stable switching characteristics and with a reduced switching-characteristics variance between two current-flow directions because the voltage at the substrate terminal (SUB) reaches a floating state when the voltage at the substrate terminal (SUB) is lower than the lower one of the voltages at the source terminals.

Substrate voltage control circuits according to second and third aspects of the present disclosure cope with the issue described above.

A substrate voltage control circuit according to a first aspect of the present disclosure is a substrate voltage control circuit that controls voltage at a substrate terminal of a bidirectional switching device, including a first source connection terminal, a second source connection terminal, a substrate voltage control terminal, a low-side circuit, and a high-side circuit, the bidirectional switching device including a first source terminal, a second source terminal, and a substrate terminal, wherein the first source connection terminal is connected to the first source terminal, the second source connection terminal is connected to the second source terminal, the substrate voltage control terminal is connected to the substrate terminal, the low-side circuit includes a low-side switch and a low-side resistor, the low-side switch includes a low-side-switch source terminal, a low-side-switch drain terminal, and a low-side-switch gate terminal, the high-side circuit includes a high-side switch and a high-side resistor, the high-side switch includes a high-side-switch source terminal, a high-side-switch drain terminal, and a high-side-switch gate terminal, the low-side-switch source terminal is connected to the substrate voltage control terminal, the low-side switch drain terminal is connected to the first source connection terminal, the low-side resister is connected between the low-side-switch gate terminal and the second source connection terminal, the high-side-switch source terminal is connected to the substrate voltage control terminal, the high-side-switch drain terminal is connected to the second source connection terminal, and the high-side resistor is connected between the high-side-switch gate terminal and the first source connection terminal.

In accordance with the first aspect, in the case where voltage at the second source connection terminal is higher than voltage at the first source connection terminal and voltage at the substrate voltage control terminal is lower than the voltage at the first source connection terminal, the low-side switch is in an ON state if the voltage at the low-side-switch gate terminal relative to the voltage at the substrate voltage control terminal is higher than threshold voltage of the low-side switch. Consequently, the substrate voltage control terminal and the first source connection terminal are short-circuited, and the voltage at the substrate voltage control terminal increases to be close to the voltage at the first source connection terminal. As a result, the voltage at the substrate voltage control terminal is successfully set to the voltage at the first source connection terminal even when the voltage at the substrate voltage control terminal is lower than the voltage at the first source connection terminal.

In addition, in the case where the voltage at the first source connection terminal is higher than the voltage at the second source connection terminal and the voltage at the substrate voltage control terminal is lower than the voltage at the second source connection terminal, the high-side switch is in an ON state if voltage at the high-side-switch gate terminal relative to the voltage at the substrate voltage control terminal is higher than threshold voltage of the high-side switch. Consequently, the substrate voltage control terminal and the second source connection terminal are short-circuited, and the voltage at the substrate voltage control terminal increases to be close to the voltage at the second source connection terminal. As a result, the voltage at the substrate voltage control terminal is successfully set to the voltage at the second source connection terminal even when the voltage at the substrate voltage control terminal is lower than the voltage at the second source connection terminal.

As described above, in accordance with the first aspect, the voltage at the substrate voltage control terminal is successfully set to the lower one of the voltage at the first source connection terminal and the voltage at the second source connection terminal. As a result, control is successfully performed such that a bidirectional switching device operates with stable switching characteristics and with a reduced switching-characteristics variance between two current-flow directions.

In the first aspect, the low-side circuit may include a low-side diode, an anode terminal of the low-side diode may be connected to the low-side-switch gate terminal, and a cathode terminal of the low-side diode may be connected to the second source connection terminal, the high-side circuit may include a high-side diode, an anode terminal of the high-side diode may be connected to the high-side-switch gate terminal, and a cathode terminal of the low-side diode may be connected to the first source connection terminal, the low-side diode may make voltage at the low-side-switch gate terminal lower than threshold voltage of the low-side switch to set the low-side switch to an OFF state before the voltage at the second source connection terminal becomes equal to the voltage at the first source connection terminal, and the high-side diode may make voltage at the high-side switch gate terminal lower than threshold voltage of the high-side switch to set the high-side switch to the OFF state before the voltage at the first source connection terminal becomes equal to the voltage at the second source connection terminal.

In accordance with the first aspect, the low-side diode removes electric charge from a parasitic capacitance of the low-side-switch gate terminal to make the voltage at the low-side-switch gate terminal lower than the threshold voltage of the low-side switch and consequently set the low-side switch to the OFF state before the voltage at the second source connection terminal becomes equal to the voltage at the first source connection terminal. Consequently, a situation where the low-side switch is kept in the ON state even after the voltage at the second source connection terminal becomes lower than the voltage at the first source connection terminal is successfully avoided.

In addition, the high-side diode removes electric charge from a parasitic capacitance of the high-side-switch gate terminal to make the voltage at the high-side-switch gate terminal lower than the threshold voltage of the high-side switch and consequently set the high-side switch to the OFF state before the voltage at the first source connection terminal becomes equal to the voltage at the second source connection terminal. Consequently, a situation where the high-side switch is kept in the ON state even after the voltage at the first source connection terminal becomes lower than the voltage at the second source connection terminal is successfully avoided. Thus, a situation where both the high-side switch and the low-side switch are in the ON state is successfully avoided, and consequently a situation where the first source connection terminal and the second source connection terminal are short-circuited via the high-side switch and the low-side switch and the circuit is damaged is successfully avoided.

In the first aspect, the low-side circuit may include a low-side capacitor, the low-side capacitor may be connected between the first source connection terminal and the low-side-switch gate terminal, the high-side circuit may include a high-side capacitor, the high-side capacitor may be connected between the second source connection terminal and the high-side-switch gate terminal, when $Vs2s1$ denotes the voltage at the second source connection terminal relative to the voltage at the first source connection terminal, the low-side capacitor may suppress a decrease in the voltage at the low-side-switch gate terminal so as to keep the low-side switch in the ON state until the Vs2*s*1 decreases to be close to 0 V in a positive voltage range, and the high-side capacitor may suppress a decrease in the voltage at the high-side-switch gate terminal so as to keep the high-side switch in the ON state until the Vs2*s*1 increases to be close to 0 V in a negative voltage range.

In accordance with the first aspect, the low-side capacitor suppresses the decrease in the voltage at the low-side-switch gate terminal so that the low-side switch is kept in the ON state until the voltage Vs2*s*1 decreases to be close to 0 V in the positive voltage range. Consequently, the voltage at the low-side-switch gate terminal becomes stable, and the response of the voltage at the substrate voltage control terminal to the lower one of the voltage at the first source connection terminal and the voltage at the second source connection terminal is successfully increased.

In addition, the high-side capacitor suppresses the decrease in the voltage at the high-side switch gate terminal so that the high-side switch is kept in the ON state until the voltage Vs2*s*1 increases to be close to 0 V in the negative voltage range. Consequently, the voltage at the high-side-switch gate terminal becomes stable, and the response of the voltage at the substrate voltage control terminal to the lower one of the voltage at the first source connection terminal and the voltage at the second source connection terminal is successfully increased.

In the first aspect, the low-side capacitor and the high-side capacitor may each have a capacitance value in a range from 100 pF to 10 nF.

In accordance with the first aspect, the response of the voltage at the substrate voltage control terminal to the lower one of the voltage at the first source connection terminal and the voltage at the second source connection terminal is successfully increased.

In the first aspect, the low-side resistor and the high-side resistor may each have a resistance value in a range from 500Ω to 500 kΩ.

In accordance with the first aspect, the response of the voltage at the substrate voltage control terminal to the lower one of the voltage at the first source connection terminal and the voltage at the second source connection terminal is successfully increased.

In the first aspect, in the case where low-side-switch gate voltage denotes the voltage at the low-side-switch gate terminal relative to the voltage at the low-side-switch source terminal, when the low-side-switch gate voltage is higher than the threshold voltage of the low-side switch, the low-side switch may be in the ON state and may short-circuit the low-side-switch source terminal and the low-side-switch drain terminal, and when the low-side-switch gate voltage is lower than the threshold voltage of the low-side switch, the low-side switch may be in the OFF state and may cause the low-side-switch source terminal and the low-side-switch drain terminal to be open-circuited;

in the case where high-side-switch gate voltage denotes the voltage at the high-side-switch gate terminal relative to the voltage at the high-side-switch source terminal, when the high-side-switch gate voltage is higher than the threshold voltage of the high-side switch, the high-side switch may be in the ON state and may short-circuit the high-side-switch source terminal and the high-side-switch drain terminal, and when the high-side-switch gate voltage is lower than the threshold voltage of the high-side switch, the high-side switch may be in the OFF state and may cause the high-side-switch source terminal and the high-side-switch drain terminal to be open-circuited.

In accordance with the first aspect, when the low-side-switch gate voltage, which is the voltage at the low-side-switch gate terminal relative to the voltage at the low-side-switch source terminal, is higher than the threshold voltage of the low-side switch, the low-side switch is in the ON state and short-circuits the low-side-switch source terminal and the low-side-switch drain terminal. Consequently, the voltage at the substrate voltage control terminal is successfully set to the voltage at the first source connection terminal even when the voltage at the substrate voltage control terminal to which the low-side-switch source terminal is connected is lower than the voltage at the first source connection terminal.

In addition, when the high-side-switch gate voltage, which is the voltage at the high-side-switch gate terminal relative to the voltage at the high-side-switch source terminal, is higher than the threshold voltage of the high-side switch, the high-side switch is in the ON state and short-circuits the high-side-switch source terminal and the high-side-switch drain terminal. Consequently, the voltage at the substrate voltage control terminal is successfully set to the voltage at the second source connection terminal even when the voltage at the substrate voltage control terminal to which the high-side-switch source terminal is connected is lower than the voltage at the second source connection terminal, In the first aspect, the low-side switch and the high-side switch may each be a metal oxide semiconductor field effect transistor (MOSFET), an insulated gate bipolar transistor (IGBT), a junction field effect transistor (JFET), a static induced transistor (SIT), or a high electron mobility transistor (HEMT), In the first aspect, the low-side switch may include a low-side-switch body diode, and when the voltage at the low-side-switch source terminal is higher than the voltage at the low-side-switch drain terminal, current may flow from the low-side-switch source terminal to the low-side-switch drain terminal via the low-side-switch body diode; and the high-side switch may include a high-side-switch body diode, and when the voltage at the high-side-switch source terminal is higher than the voltage at the high-side-switch drain terminal, current may flow from the high-side-switch source terminal to the high-side-switch drain terminal via the high-side-switch body diode.

In accordance with the first aspect, the low-side-switch diode and the high-side-switch diode can be formed without using any external circuit components.

A substrate voltage control circuit according to a second aspect of the present disclosure is a substrate voltage control circuit that controls voltage at a substrate terminal of a bidirectional switching device, including a first source connection terminal, a second source connection terminal, a substrate voltage control terminal, a low-side circuit, and a high-side circuit, the bidirectional switching device including a first source terminal, a second source terminal, and a substrate terminal, wherein the first source connection terminal is connected to the first source terminal, the second source connection terminal is connected to the second source terminal, the substrate voltage control terminal is connected to the substrate terminal, the low-side circuit includes a low-side first switch, a low-side second switch, a low-side capacitor, and a low-side power supply, the low-side first switch includes a low-side-first-switch source terminal, a low-side-first-switch drain terminal, and a low-side-first-switch gate terminal, the low-side second switch includes a low-side-second-switch source terminal, a low-side-second-switch drain terminal, and a low-side-second-switch gate terminal, the high-side circuit includes a high-side first switch, a high-side second switch, a high-side capacitor, and a high-side power supply, the high-side first switch includes a high-side-first-switch source terminal, a high-side-first-switch drain terminal, and a high-side-first-switch gate terminal, the high-side second switch includes a high-side-second-switch source terminal, a high-side-second-switch drain terminal, and a high-side-second-switch gate terminal, the low-side-first-switch source terminal is connected to the substrate voltage control terminal, the low-side-first-switch drain terminal is connected to the first source connection terminal, the low-side-first-switch gate terminal is connected to the low-side-second-switch drain terminal, the low-side capacitor is connected between the second source connection terminal and the low-side-second-switch gate terminal, the low-side power supply is connected between the substrate voltage control terminal and the low-side-second-switch source terminal, the high-side-first-switch source terminal is connected to the substrate voltage control terminal, the high-side-first-switch drain terminal is connected to the second source connection terminal, the high-side-first-switch gate terminal is connected to the high-side-second-switch drain terminal, the high-side capacitor is connected between the first source connection terminal and the high-side-second-switch gate terminal, and the high-side power supply is connected between the substrate voltage control terminal and the low-side-second-switch source terminal.

In accordance with the second aspect, in the case where voltage Vs2*s*1 denotes voltage at the second source connection terminal relative to voltage at the first source connection terminal, voltage at the low-side-second-switch gate terminal (gate voltage) decreases due to coupling of the low-side capacitor when the voltage Vs2*s*1 decreases in a positive voltage range. At that time, the gate voltage of the low-side second switch is a gate voltage relative to voltage of the low-side power supply. If this gate voltage becomes lower than threshold voltage of the low-side second switch, the low-side second switch is set to the ON state and the voltage of the low-side power supply is applied to the low-side-first-switch gate terminal. Consequently, the low-side first switch is set to the ON state, and the voltage at the first source connection terminal is applied to the substrate voltage control terminal.

Accordingly, in the second aspect, the voltage at the substrate voltage control terminal is set to the voltage at the first source connection terminal when the voltage Vs2*s*1 changes, and the floating state of the voltage at the substrate voltage control terminal is successfully avoided. As a result, in the second aspect, the bidirectional switching device is successfully controlled to operate with stable switching characteristics and a reduced switching-characteristics variance between two current-flow directions.

In addition, in the second aspect, since the low-side-first-switch gate terminal of the low-side first switch is driven by the low-side second switch when the voltage Vs2*s*1 decreases in the positive voltage range, the drive performance of the low-side first switch is successfully increased.

The same applies to the high-side circuit when the voltage Vs2*s*1 increases in a negative voltage range.

In addition, in the second aspect, the low-side circuit may include a low-side switch diode, an anode terminal of the low-side switch diode may be connected to the substrate voltage control terminal, and a cathode terminal of the low-side switch diode may be connected to the low-side-first-switch gate terminal, the high-side circuit may include a high-side switch diode, an anode terminal of the high-side switch diode may be connected to the substrate voltage control terminal, and a cathode terminal of the high-side switch diode is connected to the high-side-first-switch gate terminal, the low-side switch diode may conduct current from the anode terminal of the low-side switch diode to the cathode terminal of the low-side switch diode when the voltage at the substrate voltage control terminal is higher than the voltage at the first source connection terminal to make the voltage at the substrate voltage control terminal closer to the voltage at the first source connection terminal, and the high-side switch diode may conduct current from the anode terminal of the high-side switch diode to the cathode terminal of the high-side switch diode when the voltage at the substrate voltage control terminal is higher than the voltage at the second source connection terminal to make the voltage at the substrate voltage control terminal closer to the voltage at the second source connection terminal.

In accordance with the second aspect, since the low-side switch diode is provided, the low-side switch diode is successfully set to the ON state, when the voltage at the substrate voltage control terminal is higher than the voltage at the first source connection terminal, to make the voltage at the substrate voltage control terminal closer to the voltage at the first source connection terminal.

In addition, since the high-side switch diode is provided, the high-side switch diode is successfully set to the ON state, when the voltage at the substrate voltage control terminal is higher than the voltage at the second source connection terminal to make the voltage at the substrate voltage control terminal closer to the voltage at the second source connection terminal.

In addition, in the second aspect, the low-side circuit may include a low-side diode, an anode terminal of the low-side diode may be connected to the low-side-first-switch gate terminal, and a cathode terminal of the low-side diode may be connected to the second source connection terminal, the high-side circuit may include a high-side diode, an anode terminal of the high-side diode may be connected to the high-side-first-switch gate terminal, and a cathode terminal of the high-side diode may be connected to the first source connection terminal, the low-side diode may make voltage at the low-side-first-switch gate terminal lower than threshold voltage of the low-side first switch to set the low-side first switch to an OFF state before the voltage at the second source connection terminal becomes equal to the voltage at the first source connection terminal, and the high-side diode may make voltage at the high-side-first-switch gate terminal lower than threshold voltage of the high-side first switch to set the high-side first switch to the OFF state before the voltage at the first source connection terminal becomes equal to the voltage at the second source connection terminal.

In accordance with the second aspect, the low-side diode removes electric charge from a parasitic capacitance of the low-side-first-switch gate terminal to make the voltage at the low-side-first-switch gate terminal lower than the threshold voltage of the low-side first switch and consequently set the low-side first switch to the OFF state before the voltage at the second source connection terminal becomes equal to the voltage at the first source connection terminal. Consequently, a situation where the low-side first switch is kept in the ON state even after the voltage at the second source connection terminal becomes lower than the voltage at the first source connection terminal is successfully avoided.

In addition, the high-side diode removes electric charge from a parasitic capacitance of the high-side-first-switch gate terminal to make the voltage at the high-side-first-switch gate terminal lower than the threshold voltage of the high-side first switch and consequently set the high-side first switch to the OFF state before the voltage at the first source connection terminal becomes equal to the voltage at the second source connection terminal. Consequently, a situation where the high-side first switch is kept in the ON state even after the voltage at the first source connection terminal becomes lower than the voltage at the second source connection terminal is successfully avoided.

In addition, in the second aspect, in the case where low-side-first-switch gate voltage denotes the voltage at the low-side-first-switch gate terminal relative to voltage at the low-side-first-switch source terminal, when the low-side-first-switch gate voltage is higher than the threshold voltage of the low-side first switch, the low-side first switch may be in the ON state and may short-circuit the low-side-first-switch source terminal and the low-side-first-switch drain terminal, when the low-side-first-switch gate voltage is lower than the threshold voltage of the low-side first switch, the low-side first switch may be in the OFF state and may cause the low-side-first-switch source terminal and the low-side-first-switch drain terminal to be open, in the case where high-side-first-switch gate voltage denotes the voltage at the high-side-first-switch gate terminal relative to voltage at the high-side-first-switch source terminal, when the high-side-first-switch gate voltage is higher than the threshold voltage of the high-side first switch, the high-side first switch may be in the ON state and may short-circuit the high-side-first-switch source terminal and the high-side-first-switch drain terminal, and when the high-side-first-switch gate voltage is lower than the threshold voltage of the high-side first switch, the high-side first switch may be in the OFF state and may cause the high-side-first-switch source terminal and the high-side-first-switch drain terminal to be open.

In accordance with the second aspect, when the low-side-first-switch gate voltage, which is the voltage at the low-side-first-switch gate terminal relative to the voltage at the low-side-first-switch source terminal, is higher than the threshold voltage of the low-side first switch, the low-side first switch is in the ON state and short-circuits the low-side-first-switch source terminal and the low-side-first-switch drain terminal. Consequently, the voltage at the substrate voltage control terminal is successfully set to the voltage at the first source connection terminal even when the voltage at the substrate voltage control terminal to which the low-side-first-switch source terminal is connected is lower than the voltage at the first source connection terminal.

In addition, when the high-side-first-switch gate voltage, which is the voltage at the high-side-first-switch gate terminal relative to the voltage at the high-side-first-switch source terminal, is higher than the threshold voltage of the high-side first switch, the high-side first switch is in the ON state and short-circuits the high-side-first-switch source terminal and the high-side-first-switch drain terminal. Consequently, the voltage at the substrate voltage control terminal is successfully set to the voltage at the second source connection terminal even when the voltage at the substrate voltage control terminal to which the high-side-first-switch source terminal is connected is lower than the voltage at the second source connection terminal.

In addition, in the second aspect, the low-side first switch and the high-side first switch may each be a metal oxide semiconductor field effect transistor (MOSFET), an insulated gate bipolar transistor (IGBT), a junction field effect transistor (JFET), a static induced transistor (SIT), or a high electron mobility transistor (HEMT).

In addition, in the second aspect, the low-side first switch may include a low-side-switch body diode, the low-side-switch body diode may conduct current from the low-side-first-switch source terminal to the low-side-first-switch drain terminal when the voltage at the low-side-first-switch source terminal is higher than the voltage at the low-side-first-switch drain terminal, the high-side first switch may include a high-side-switch body diode, the high-side-switch body diode may conduct current from the high-side-first-switch source terminal to the high-side-first-switch drain terminal when the voltage at the high-side-first-switch source terminal is higher than the voltage at the high-side-first-switch drain terminal.

Since the low-side second switch is in the OFF state in a period of a steady state in which the voltage Vs2*s*1 is a constant voltage in the positive voltage range, the low-side first switch is also in the OFF state. Consequently, the voltage at the substrate voltage control terminal is in an electrically floating state.

In accordance with the second aspect, since the low-side second switch includes the low-side-switch body diode, the voltage at the substrate voltage control terminal is kept at a voltage that is higher than the voltage at the first source connection terminal by the threshold voltage of the low-side-switch body diode in a period of the steady state in which the voltage Vs2*s*1 is a constant voltage in the positive voltage range. As a result, the voltage at the substrate voltage control terminal is successfully set to the voltage at the first source connection terminal, which is the lower one of the voltage at the first source connection terminal and the voltage at the second source connection terminal, in the period of the steady state in which the voltage Vs2*s*1 is a constant voltage in the positive voltage range. The same applies to the high-side circuit.

Further, in accordance with the second aspect, the low-side-switch diode and the high-side-switch diode can be formed without using any external circuit components.

A substrate voltage control circuit according to a third aspect of the present disclosure is a substrate voltage control circuit that controls voltage at a substrate terminal of a bidirectional switching device, including a first source connection terminal, a second source connection terminal, a substrate voltage control terminal, a low-side circuit, and a high-side circuit, the bidirectional switching device including a first source terminal, a second source terminal, and a substrate terminal, wherein the first source connection terminal is connected to the first source terminal, the second source connection terminal is connected to the second source terminal, the substrate voltage control terminal is connected to the substrate terminal, the low-side circuit includes a low-side first switch, a low-side second switch, and a low-side first capacitor, the low-side first switch includes a low-side-first-switch source terminal, a low-side-first-switch drain terminal, and a low-side-first-switch gate terminal, the low-side second switch includes a low-side-second-switch source terminal, a low-side-second-switch drain terminal, and a low-side-second-switch gate terminal, the high-side circuit includes a high-side first switch, a high-side second switch, and a high-side first capacitor, the high-side first switch includes a high-side-first-switch source terminal, a high-side-first-switch drain terminal, and a high-side-first-switch gate terminal, the high-side second switch includes a high-side-second-switch source terminal, a high-side-second-switch drain terminal, and a high-side-second-switch gate terminal, the low-side-first-switch source terminal is connected to the first source connection terminal, the low-side-first-switch drain terminal is connected to the substrate voltage control terminal, the low-side-first-switch gate terminal is connected to the low-side-second-switch drain terminal, the low-side-second-switch source terminal is connected to the first source connection terminal, the low-side first capacitor is connected between the second source connection terminal and the low-side-second-switch drain terminal, the high-side-first-switch source terminal is connected to the second source connection terminal, the high-side-first-switch drain terminal is connected to the substrate voltage control terminal, the high-side-first-switch gate terminal is connected to the high-side-second-switch drain terminal, the high-side-second-switch source terminal is connected to the second source connection terminal, and the high-side first capacitor is connected between the first source connection terminal and the high-side-second-switch drain terminal.

According to the third aspect, when voltage Vs2*s*1 denotes voltage at the second source connection terminal relative to voltage at the first source connection terminal, voltage (hereinafter, referred to as gate voltage) at the low-side-first-switch gate terminal relative to voltage at the low-side-first-switch source terminal decreases due to coupling caused by the low-side first capacitor when the voltage Vs2*s*1 decreases in a positive voltage range. When the gate voltage of the low-side first switch becomes lower than threshold voltage of the low-side first switch, the low-side first switch is set to the ON state and consequently voltage at the first source connection terminal is applied to the substrate voltage control terminal.

Accordingly, in the third aspect, the voltage at the substrate voltage control terminal is set to the voltage at the first source connection terminal when the voltage Vs2*s*1 decreases in the positive voltage range, and the floating state of the voltage at the substrate voltage control terminal is successfully avoided. As a result, in the third aspect, the bidirectional switching device is successfully controlled to operate with stable switching characteristics and a reduced switching characteristics variance between two current-flow directions.

The same applies to the high-side circuit when voltage Vs1*s*2 decreases in the positive voltage range (when the voltage Vs2*s*1 increases in a negative voltage range) in the case where the voltage at the first source connection terminal relative to the voltage at the second source terminal is the voltage Vs1*s*2.

In the third aspect, the low-side circuit may further include a low-side diode, the high-side circuit may further include a high-side diode, the low-side diode includes a low-side anode terminal and a low-side cathode terminal, the high-side diode includes a high-side anode terminal and a high-side cathode terminal, the low-side anode terminal may be connected to the low-side-second-switch gate terminal, the low-side cathode terminal may be connected to the substrate voltage control terminal, the high-side anode terminal may be connected to the high-side-second-switch gate terminal, and the low-side cathode terminal may be connected to the substrate voltage control terminal.

In accordance with the third aspect, when the voltage at the substrate voltage control terminal decreases, the low-side diode is set to the ON state, and consequently, the voltage at the low-side-second-switch gate terminal decreases in response to a decrease in the voltage at the substrate voltage control terminal. When the gate voltage of the low-side second switch becomes lower than threshold voltage of the low-side second switch, the low-side second switch is set to the ON state. As a result, the potential at the low-side-first-switch gate terminal and the potential at the low-side-first-switch source terminal become equal, and the low-side first switch is set to the OFF state.

Accordingly, in accordance with the third aspect, the low-side first switch is successfully set to the OFF state for sure when the voltage at the substrate voltage control terminal decreases in the case where the voltage Vs2*s*1 decreases in the negative voltage range. The same applies to the high-side circuit when the voltage at the substrate voltage control terminal decreases in the case where the voltage Vs1*s*2 decreases in the negative voltage range.

In the third aspect, the low-side circuit may further include a low-side second capacitor, the high-side circuit may further include a high-side second capacitor, the low-side second capacitor may be connected between the substrate voltage control terminal and the low-side-second-switch gate terminal, and the high-side second capacitor may be connected between the substrate voltage control terminal and the high-side-second-switch gate terminal.

In accordance with the third aspect, when the voltage at the substrate voltage control terminal decreases, the voltage at the low-side-second-switch gate terminal decreases in response to a decrease in the voltage at the substrate voltage control terminal because of coupling caused by the low-side second capacitor. If the gate voltage of the low-side second switch consequently becomes lower than threshold voltage of the low-side second switch, the low-side second switch is set to the ON state. As a result, the potential at the low-side-first-switch gate terminal and the potential at the low-side-first-switch source terminal become equal, and the low-side first switch is set to the OFF state.

Accordingly, in accordance with the third aspect, the low-side first switch is successfully set to the OFF state for sure when the voltage at the substrate voltage control terminal decreases in the case where the voltage Vs2s1 decreases in the negative voltage range. The same applies to the high-side circuit when the voltage at the substrate voltage control terminal decreases in the case where the voltage Vs1s2 decreases in the negative voltage range.

In the third aspect, the low-side circuit may further include a low-side resistor, the high-side circuit may further include a high-side resistor, the low-side resistor may be connected between the substrate voltage control terminal and the low-side-second-switch gate terminal, and the high-side resistor may be connected between the substrate voltage control terminal and the high-side-second-switch gate terminal.

In accordance with the third aspect, current flows from the low-side-second-switch gate terminal to the substrate voltage control terminal via the low-side resistor in response to a decrease in the voltage at the substrate voltage control terminal, and consequently the voltage at the low-side-second-switch gate terminal decreases in response to the decrease in the voltage at the substrate voltage control terminal. If the gate voltage of the low-side second switch consequently becomes lower than the threshold voltage of the low-side second switch, the low-side second switch is set to the ON state. As a result, the potential at the low-side-first-switch gate terminal and the potential at the low-side-first-switch source terminal become equal, and the low-side first switch is set to the OFF state.

Accordingly, in accordance with the third aspect, the low-side first switch is successfully set to the OFF state for sure when the voltage at the substrate voltage control terminal decreases in the case where the voltage Vs2s1 decreases in the negative voltage range. The same applies to the high-side circuit when the voltage at the substrate voltage control terminal decreases in the case where the voltage Vs1s2 decreases in the negative voltage range.

In the third aspect, in the case where low-side-first-switch gate voltage denotes voltage at the low-side-first-switch gate terminal relative to voltage at the low-side-first-switch source terminal, when the low-side-first-switch gate voltage is lower than threshold voltage of the low-side first switch, the low-side first switch may be in the ON state and may short-circuit the low-side-first-switch source terminal and the low-side-first-switch drain terminal, and when the low-side-first-switch gate voltage is higher than the threshold voltage of the low-side first switch, the low-side first switch may be in the OFF state and may cause the low-side-first-switch source terminal and the low-side-first-switch drain terminal to be open; and in the case where high-side-first-switch gate voltage denotes voltage at the high-side-first-switch gate terminal relative to voltage at the high-side-first-switch source terminal, when the high-side-first-switch gate voltage is lower than threshold voltage of the high-side first switch, the high-side first switch may be in the ON state and may short-circuit the high-side-first-switch source terminal and the high-side-first-switch drain terminal, and when the high-side-first-switch gate voltage is higher than the threshold voltage of the high-side first switch, the high-side first switch may be in the OFF state and may cause the high-side-first-switch source terminal and the high-side-first-switch drain terminal to be open.

In accordance with the third aspect, the low-side first switch and the high-side first switch may each be a P-type switching device, such as a P-type MOSFET.

In accordance with the third aspect, the low-side first switch and the high-side first switch may each be a P-type metal oxide semiconductor field effect transistor (MOSFET), an insulated gate bipolar transistor (IGBT), a junction field effect transistor (JFET), a static induced transistor (SIT), or a high electron mobility transistor (HEMT).

In the third aspect, the low-side first switch may include a low-side-first-switch body diode, when the voltage at the low-side-first-switch source terminal is lower than the voltage at the low-side-first-switch drain terminal, the low-side first switch may conduct current from the low-side-first-switch drain terminal to the low-side-first-switch source terminal via the low-side-first-switch body diode, the high-side first switch may include a high-side-first-switch body diode, when the voltage at the high-side-first-switch source terminal is lower than the voltage at the high-side-first-switch drain terminal, the high-side first switch may conduct current from the high-side-first-switch drain terminal to the high-side-first-switch source terminal via the high-side-first-switch body diode.

Suppose that the voltage at the second source connection terminal becomes lower than the voltage at the first source connection terminal, and the voltage Vs2s1 changes from a positive voltage to a negative voltage. In this case, since the voltage at the substrate voltage control terminal becomes equal to the voltage at the first source connection terminal while the voltage Vs2s1 is positive, the voltage at the second source connection terminal is lower than the voltage at the substrate voltage control terminal. Accordingly, the voltage at the high-side-first-switch source terminal connected to the second source connection terminal is lower than the voltage at the high-side-first-switch drain terminal connected to the substrate voltage control terminal.

Accordingly, current flows from the high-side-first-switch drain terminal to the high-side-first-switch source terminal via the high-side-first-switch body diode, and the voltage at the substrate voltage control terminal is limited to be lower than or equal to a voltage obtained by adding threshold voltage of the high-side-first-switch body diode to the voltage at the second source connection terminal. As a result, the voltage at the substrate voltage control terminal decreases in response to a decrease in the voltage Vs2s1 in the negative voltage range.

Thus, in accordance with the third aspect, the voltage at the substrate voltage control terminal is successfully decreased in response to a decrease in the voltage Vs2s1 in the case where the voltage Vs2s1 decreases in the negative voltage range. The same applies to the low-side circuit in the case where the voltage Vs1s2 decreases in the negative voltage range (in the case where the voltage Vs2s1 increases in the positive voltage range).

In the third aspect, the low-side circuit may further include a low-side third capacitor connected between the low-side anode terminal and the low-side-second-switch gate terminal, the high-side circuit may further include a high-side third capacitor connected between the high-side anode terminal and the high-side-second-switch gate terminal, the low-side first capacitor and the high-side first capacitor may each have a capacitance in a range from 0.1 nF to 100 nF, and the low-side third capacitor and the high-side third capacitor may each have a capacitance in a range from 0.05 nF to 50 nF.

In accordance with the third aspect, the response of the voltage at the substrate voltage control terminal to the lower one of the voltage at the first source connection terminal and the voltage at the second source connection terminal is successfully increased.

In the third aspect, the low-side circuit may further include a low-side first resistor connected between the low-side-first-switch gate terminal and the first source connection terminal, a low-side second resistor connected between the low-side-second-switch gate terminal and the first source connection terminal, and a low-side third resistor connected between the low-side anode terminal and the low-side-second-switch gate terminal, the high-side circuit may further include a high-side first resistor connected between the high-side-first-switch gate terminal and the second source connection terminal, a high-side second resistor connected between the high-side-second-switch gate terminal and the second source connection terminal, a high-side third resistor connected between the high-side anode terminal and the high-side-second-switch gate terminal, and the low-side first resistor, the low-side second resistor, the low-side third resistor, the high-side first resistor, the high-side second resistor, and the high-side third resistor may each have a resistance in a range from 10 kΩ to 1 MΩ.

In accordance with the third aspect, the response of the voltage at the substrate voltage control terminal to the lower one of the voltage at the first source connection terminal and the voltage at the second source connection terminal is successfully increased.

Bidirectional Switching Device

Prior to a description of substrate voltage control circuits according to embodiments of the present disclosure, a bidirectional switching device that is controlled by the substrate voltage control circuits will be described with reference to FIG. 6.

Figure 6:
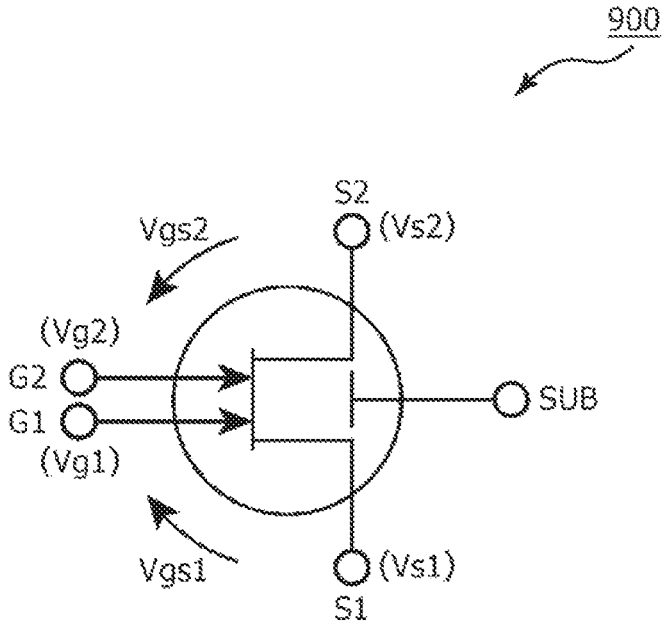
FIG. 6 is a diagram illustrating a bidirectional switching device by using circuit symbols.

FIG. 6 is a diagram illustrating a bidirectional switching device 900 by using circuit symbols. The bidirectional switching device 900 includes a source terminal S1, a source terminal S2, two gate terminals G1 and G2, and a substrate terminal SUB. Let Vs1 denote voltage at the source terminal S1, Vs2 denote voltage at the source terminal S2, Vg1 denote voltage at the gate terminal G1, Vg2 denote voltage at the gate terminal G2, Vgs1 denote the voltage Vg1 at the gate terminal G1 relative to the voltage Vs1 at the source terminal S1, and Vgs2 denote the voltage Vg2 at the gate terminal G2 relative to the voltage Vs2 at the source terminal S2.

In the case where the voltage Vs2 is higher than the voltage Vs1, the bidirectional switching device 900 is in an ON state when the voltage Vgs1 is higher than threshold voltage and is in an OFF state when the voltage Vgs1 is lower than the threshold voltage.

On the other hand, in the case where the voltage Vs1 is higher than the voltage Vs2, the bidirectional switching device 900 is in the ON state when the voltage Vgs2 is higher than threshold voltage and is in the OFF state when the voltage Vgs2 is lower than the threshold voltage.

Although the bidirectional switching device 900 illustrated in FIG. 6 includes two gate terminals G1 and G2, substrate voltage control circuits according to embodiments of the present disclosure are applicable to bidirectional switching devices including a single gate terminal and expected advantageous effects can be obtained.

Waveform of Voltage at Substrate Terminal

Figure 2:
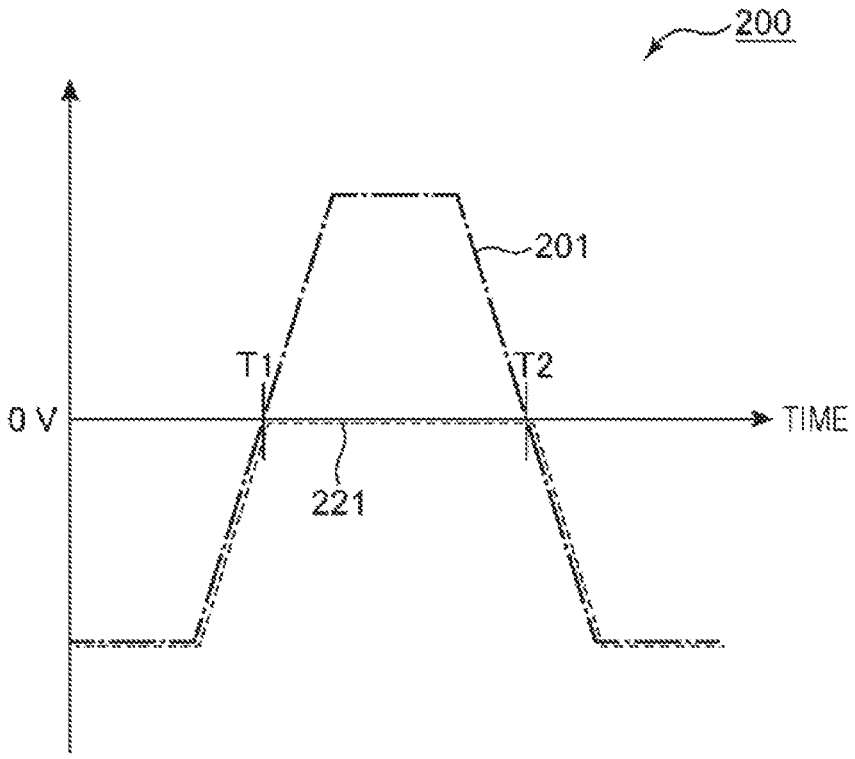
FIG. 2 is a waveform diagram illustrating an ideal relationship between voltage at a substrate terminal and voltage at a source terminal.

Now, an ideal waveform of voltage at the substrate terminal SUB will be described with reference to FIG. 2. FIG. 2 is a waveform diagram 200 illustrating an ideal relationship between voltage at the substrate terminal SUB and a voltage differentiation between voltages at the source terminal S1 and the source terminal S2. A source terminal voltage waveform 201, which is denoted by a dot-and-dash line, is a waveform of voltage at a source terminal (e.g., the source terminal S2) obtained when voltage at another source terminal (e.g., the source terminal S1) is regarded as a reference voltage of 0 V. A substrate terminal voltage waveform 221, which is denoted by a dash line, is a waveform of voltage at the substrate terminal SUB.

An ideal voltage waveform of the substrate terminal voltage waveform 221 is that the voltage at the substrate terminal SUB becomes equal to the lower one of the voltages at the source terminals when the source terminal voltage waveform 201 changes from a negative voltage to a positive voltage (at time T1) and then changes from a positive voltage to a negative voltage (at time T2).

Specifically, in the case where the source terminal voltage waveform 201 is a waveform of voltage at the source terminal S2, since the voltage at the source terminal S2 is lower than the voltage at the source terminal S1 up until time T1, the substrate terminal voltage waveform 221 increases in accordance with the source terminal voltage waveform 201. From time T1 to time T2, since the voltage at the source terminal S2 is higher than the voltage at the source terminal S1, the substrate terminal voltage waveform 221 follows the voltage at the source terminal S1, which is 0 V, and is maintained at 0 V. After time T2, since the voltage at the source terminal S2 is lower than the voltage at the source terminal S1 again, the substrate terminal voltage waveform 221 decreases in accordance with the source terminal voltage waveform 201.

Substrate voltage control circuits according to embodiments of the present disclosure attempt to make the waveform of voltage at the substrate terminal SUB to be as close to the ideal substrate terminal voltage waveform 221 illustrated in FIG. 2 as possible.

Basic Configuration

A substrate voltage control circuit having a basic configuration according to embodiments of the present disclosure will be described next with reference to FIG. 1. FIG. 1 is a diagram illustrating a substrate voltage control circuit 100 having a basic configuration according to embodiments of the present disclosure.

The substrate voltage control circuit 100 includes two source connection terminals, which are a first source connection terminal 111 and a second source connection terminal 121, and a substrate voltage control terminal 101. Connections between these terminals and terminals of the bidirectional switching device 900 illustrated in FIG. 6 will be described. The first source connection terminal 111 is connected to the source terminal S1. The second source connection terminal 121 is connected to the source terminal S2. The substrate voltage control terminal 101 is connected to the substrate terminal SUB.

The substrate voltage control circuit 100 further includes a switch 112 connected between the first source connection terminal 111 and the substrate voltage control terminal 101, a switch 122 connected between the second source connection terminal 121 and the substrate voltage control terminal 101, and a control circuit 131 that controls the switches 112 and 122. The control circuit 131 simultaneously sets the switch 112 to the ON state and the switch 122 to the OFF state when the voltage at the first source connection terminal 111 is lower than the voltage at the second source connection terminal 121. In addition, the control circuit 131 simultaneously sets the switch 112 to the OFF state and the switch 122 to the ON state when the voltage at the first source connection terminal 111 is higher than the voltage at the second source connection terminal 121.

The control circuit 131 includes a comparator that compares the voltage at the first source connection terminal 111 and the voltage at the second source connection terminal 121 with each other, a control signal generation circuit that generates a control signal in accordance with an output signal of the comparator, and a gate driver circuit that controls the switch 112 and the switch 122 in accordance with the generated control signal. As described above, the control circuit 131 is implemented by using circuits such as a comparator, a control signal generation circuit, and a gate driver circuit.

Since the control circuit 131 requires a comparator, a control signal generation circuit, and a gate driver circuit, the circuit scale increases and consequently the volume and cost increase. As described below, since substrate voltage control circuits according to embodiments of the present disclosure do not require the control circuit 131, the reduced circuit scale and consequently the reduced size and cost are successfully achieved. Embodiments of the present disclosure will be described below.

First Embodiment

Figure 3:
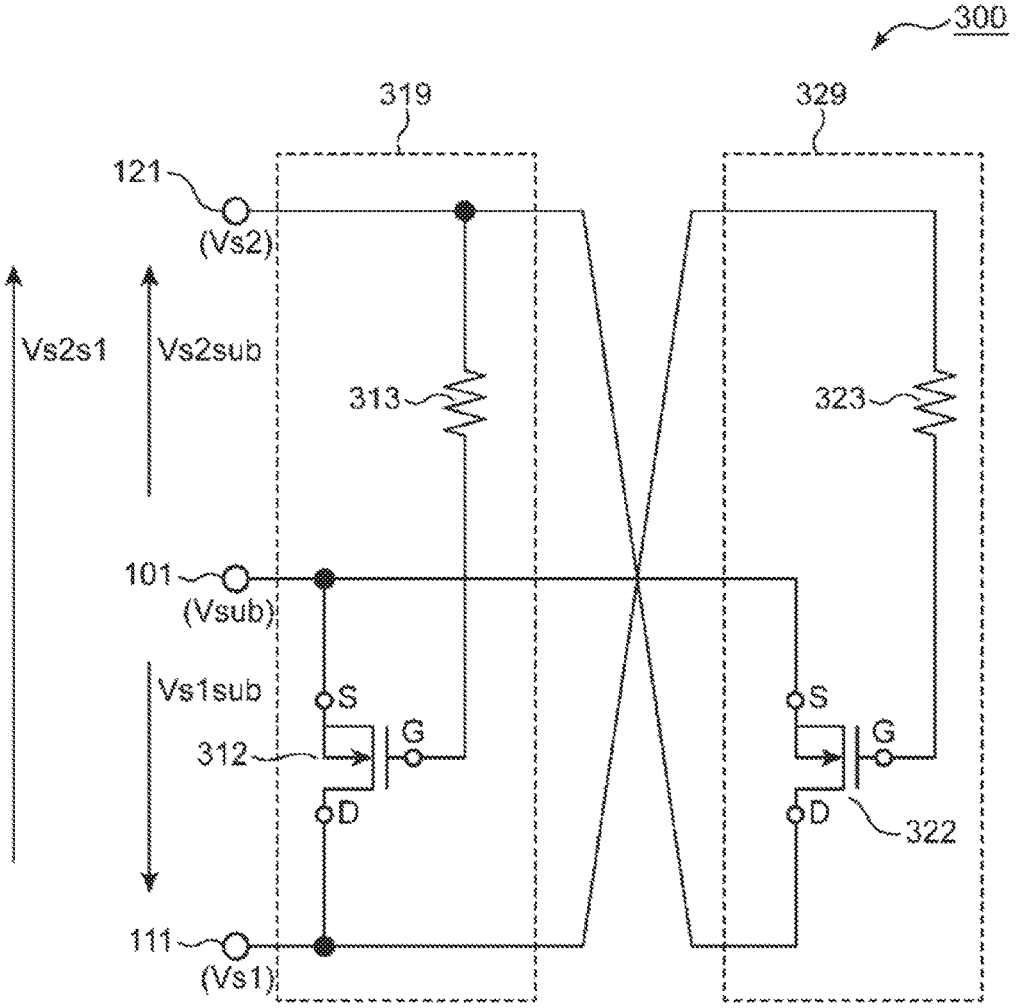
FIG. 3 is a diagram illustrating an example of a substrate voltage control circuit according to a first embodiment of the present disclosure.

FIG. 3 is a diagram illustrating an example of a substrate voltage control circuit 300 according to a first embodiment of the present disclosure. The substrate voltage control circuit 300 includes a first source connection terminal 111, a second source connection terminal 121, a substrate voltage control terminal 101, a low-side circuit 319, and a high-side circuit 329.

The source terminal S1 of the bidirectional switching device 900 is connected to the first source connection terminal 111. The source terminal S2 of the bidirectional switching device 900 is connected to the second source connection terminal 121. The substrate terminal SUB of the bidirectional switching device 900 is connected to the substrate voltage control terminal 101.

The low-side circuit 319 is a circuit for applying voltage at the first source connection terminal 111 to the substrate voltage control terminal 101. The high-side circuit 329 is a circuit for applying voltage at the second source connection terminal 121 to the substrate voltage control terminal 101. The low-side circuit 319 and the high-side circuit 329 have substantially the same circuit configuration except that connections to the first source connection terminal 111 and the second source connection terminal 121 are opposite.

An N-channel (N-ch) metal oxide semiconductor field effect transistor (MOSFET) 312 is an N-ch MOSFET employed as the switch 112 illustrated in FIG. 1. Similarly, an N-ch MOSFET 322 is an N-ch MOSFET employed as the switch 122.

The low-side circuit 319 includes the N-ch MOSFET 312 (an example of a low-side switch and an example of a first switch) and a resistor 313. The high-side circuit 329 includes the N-ch MOSFET 322 (an example of a high-side switch and an example of a second switch) and a resistor 323.

A source terminal S of the N-ch MOSFET 312 is connected to the substrate voltage control terminal 101. A drain terminal D of the N-ch MOSFET 312 is connected to the first source connection terminal 111. A gate terminal G of the N-ch MOSFET 312 is connected to the second source connection terminal 121 with the resistor 313 interposed therebetween.

A source terminal S of the N-ch MOSFET 322 is connected to the substrate voltage control terminal 101. A drain terminal D of the N-ch MOSFET 322 is connected to the second source connection terminal 121. A gate terminal G of the N-ch MOSFET 322 is connected to the first source connection terminal 111 with the resistor 323 interposed therebetween.

When voltage Vs2 at the second source connection terminal 121 is higher than voltage Vs1 at the first source connection terminal 111, the N-ch MOSFET 312 is in the ON state and the N-ch MOSFET 322 is in the OFF state. Consequently, the substrate voltage control terminal 101 and the first source connection terminal 111 are electrically short-circuited, and the voltage Vs1 at the first source connection terminal 111 is applied to the substrate voltage control terminal 101.

When the voltage Vs1 at the first source connection terminal 111 is higher than the voltage Vs2 at the second source connection terminal 121, the N-ch MOSFET 322 is in the ON state and the N-ch MOSFET 312 is in the OFF state. Consequently, the substrate voltage control terminal 101 and the second source connection terminal 121 are electrically short-circuited, and the voltage Vs2 at the second source connection terminal 121 is applied to the substrate voltage control terminal 101.

In principal, an N-ch MOSFET is in the ON state when voltage (gate voltage Vgs) at the gate terminal G relative to the lower one of voltages at two terminals of the source terminal S and the drain terminal D is higher than its threshold voltage Vth and is in the OFF state when the gate voltage Vgs is lower than the threshold voltage Vth.

Strictly speaking, an N-ch MOSFET has two threshold voltages depending on voltage Vds at the drain terminal D relative to voltage at the source terminal S. The first one is threshold voltage Vth in the case of Vds>0 V and is typical threshold voltage. The second one is threshold voltage Vth in the case of Vds<0 V and is typically called threshold voltage in the case where the voltage Vds is negative. The values of these threshold voltages Vth are different. In the case where these threshold voltages Vth are distinguished from each other below, the former is referred to as threshold voltage Vth1 and the latter is referred to as threshold voltage Vth2.

(i) Low-Side Circuit: Vsub>Vs1

In the low-side circuit 319, when the voltage Vsub at the substrate voltage control terminal 101 is higher than the voltage Vs1 at the first source connection terminal 111 (Vsub>Vs1), gate voltage Vgs is the voltage at the gate terminal G of the N-ch MOSFET 312 relative to the voltage at the first source connection terminal 111. In addition, in the case of Vsub>Vs1, the voltage Vds is lower than 0 V (Vds<0). Thus, the threshold voltage Vth of the N-ch MOSFET 312 is the threshold voltage Vth2.

At that time, when voltage Vs2*s*1 at the second source connection terminal 121 relative to the voltage at the first source connection terminal 111 is higher than the threshold voltage Vth2 of the N-ch MOSFET 312, the gate voltage Vgs is higher than the threshold voltage Vth2 and the N-ch MOSFET 312 is in the ON state. On the other hand, when the voltage Vs2*s*1 is lower than the threshold voltage Vth2, the voltage Vgs is lower than the threshold voltage Vth2 and the N-ch MOSFET 312 is in the OFF state.

(ii) Low-Side Circuit: Vs1>Vsub

Conversely, when the voltage Vsub at the substrate voltage control terminal 101 is lower than the voltage Vs1 at the first source connection terminal 111 (Vs1>Vsub), the gate voltage Vgs is voltage at the gate terminal G of the N-ch MOSFET 312 relative to the voltage at the substrate voltage control terminal 101. In addition, in the case of Vs1>Vsub, the voltage Vds is higher than 0 V (Vds>0). Thus, the threshold voltage Vth is the threshold voltage Vth1.

At that time, when voltage Vs2*sub* at the second source connection terminal 121 relative to the voltage at the substrate voltage control terminal 101 is higher than the threshold voltage Vth1 of the N-ch MOSFET 312, the gate voltage Vgs is higher than the threshold voltage Vth1 and the N-ch MOSFET 312 is in the ON state. On the other hand, when the voltage Vs2*sub* is lower than the threshold voltage Vth1, the gate voltage Vgs is lower than the threshold voltage Vth1 and the N-ch MOSFET 312 is in the OFF state.

(iii) High-Side Circuit: Vsub>Vs2

The description above also applies to the high-side circuit 329. When the voltage Vsub at the substrate voltage control terminal 101 is higher than the voltage Vs2 at the second source connection terminal 121 connected to the drain terminal D of the N-ch MOSFET 322 (Vsub>Vs2), the gate voltage Vgs is the voltage at the gate terminal G of the N-ch MOSFET 322 relative to the voltage at the second source connection terminal 121. In addition, in the case of Vsub>Vs2, the voltage Vds is lower than 0 V (Vds<0) in the N-ch MOSFET 322. Thus, the threshold voltage Vth of the N-ch MOSFET 322 is the threshold voltage Vth2.

At that time, when voltage Vs1*s*2 at the first source connection terminal 111 relative to the voltage at the second source connection terminal 121 is higher than the threshold voltage Vth2 of the N-ch MOSFET 322, the gate voltage Vgs is higher than the threshold voltage Vth2 and the N-ch MOSFET 322 is in the ON state. On the other hand, when the voltage Vs1*s*2 is lower than the threshold voltage Vth2, the gate voltage Vgs is lower than the threshold voltage Vth2 and the N-ch MOSFET 322 is in the OFF state.

(iv) High Side Circuit: Vs2>Vsub

Conversely, when the voltage Vsub at the substrate voltage control terminal 101 is lower than the voltage Vs2 at the second source connection terminal 121 connected to the drain terminal D of the N-ch MOSFET 322 (Vsub<Vs2), the gate voltage Vgs is the voltage at the gate terminal G of the N-ch MOSFET 322 relative to the voltage Vsub. In addition, in the case of Vsub<Vs2, the voltage Vds is higher than 0 V (Vds>0) in the N-ch MOSFET 322. Thus, the threshold voltage Vth of the N-ch MOSFET 322 is the threshold voltage Vth1.

At that time, when voltage Vs1*sub* at the first source connection terminal 111 relative to the voltage at the substrate voltage control terminal 101 is higher than the threshold voltage Vth1 of the N-ch MOSFET 322, the gate voltage Vgs is higher than the threshold voltage Vth1 and the N-ch MOSFET 322 is in the ON state. On the other hand, when the voltage Vs1*sub* is lower than the threshold voltage Vth1, the gate voltage Vgs is lower than the threshold voltage Vth1 and the N-ch MOSFET 322 is in the OFF state.

The N-ch MOSFET 312 and the N-ch MOSFET 322 each may be a device including a body diode or may be a device not including a body diode. In addition, the N-ch MOSFET 312 and the N-ch MOSFET 322 may be replaced with N-ch switching devices, such as insulated gate bipolar transistors (IGBTs) or junction field effect transistors (JFETs), and the switches 112 and 122 are not limited to the N-ch MOSFET 312 and the N-ch MOSFET 322.

In addition, the semiconductor material of the semiconductor devices used as the N-ch MOSFET 312 and the N-ch MOSFET 322 are not limited to a specific semiconductor material and may be silicon (Si), silicon carbide (SiC), gallium nitride (GaN), diamond, or the like.

As in the case of (ii) described above, in the substrate voltage control circuit 300, even in the case where the voltage Vsub is lower than the voltage Vs1, the N-ch MOSFET 312 is set to be in the ON state if the voltage Vs2*sub* is higher than the threshold voltage Vth1 of the N-ch MOSFET 312. Consequently, the substrate voltage control terminal 101 and the first source connection terminal 111 are successfully short-circuited.

In addition, as in the case of (iv) described above, in the substrate voltage control circuit 300, even in the case where the voltage Vsub is lower than the voltage Vs2, the N-ch MOSFET 322 is set to be in the ON state if the voltage Vs1*sub* is higher than the threshold voltage Vth1 of the N-ch MOSFET 322. Consequently, the substrate voltage control terminal 101 and the second source connection terminal 121 are successfully short-circuited.

As in the case of (i) to (iv) described above, the substrate voltage control circuit 300 successfully sets the voltage at the substrate voltage control terminal 101 to the lower one of the voltage at the first source connection terminal 111 and the voltage at the second source connection terminal 121. As a result, the substrate voltage control circuit 300 successfully controls the bidirectional switching device 900 to operate with stable switching characteristics and with a reduced switching-characteristics variance between two current-flow directions.

Second Embodiment

FIG. 3 used in the above description illustrates a fundamental circuit configuration, and practical circuits need modifications for implementing a protection function and performance improvement. A practical substrate voltage control circuit according to a second embodiment, which is a refinement of the first embodiment, will be described with reference to FIG. 4.

Figure 4:
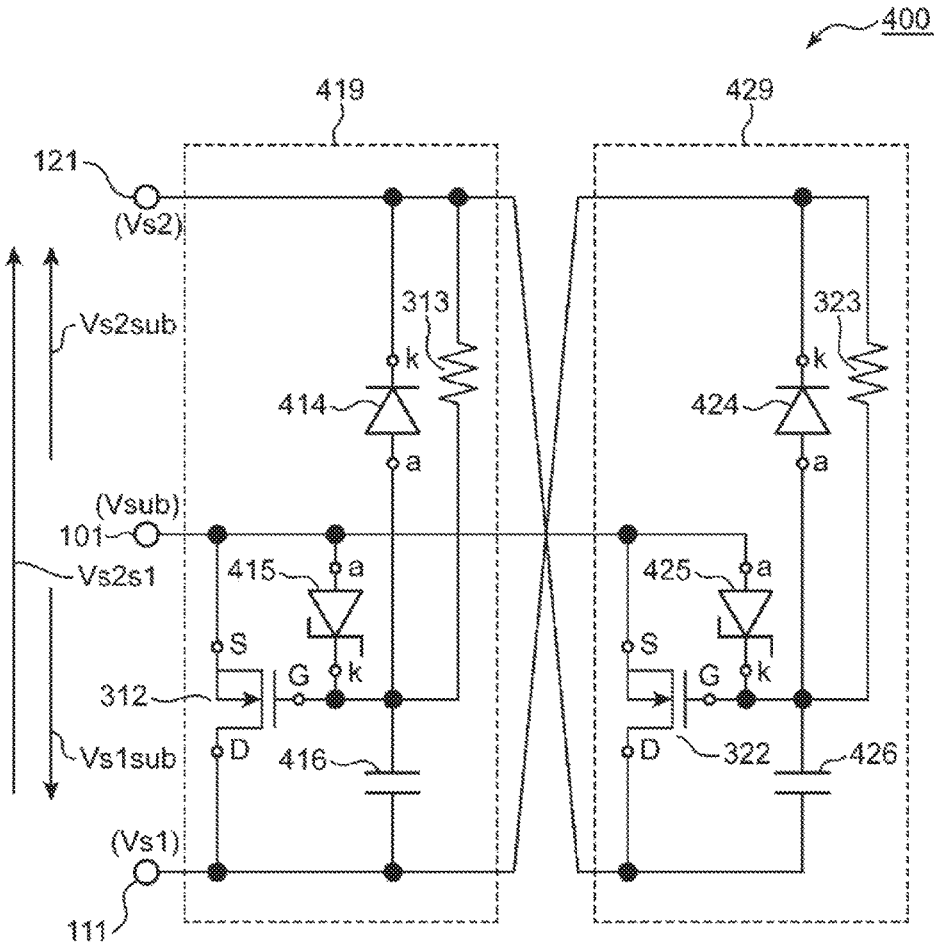
FIG. 4 is a diagram illustrating an example of a substrate voltage control circuit according to a second embodiment of the present disclosure.

FIG. 4 is a diagram illustrating an example of a substrate voltage control circuit 400 according to the second embodiment of the present disclosure. The substrate voltage control circuit 400 further includes a diode 414 (an example of a low-side diode and an example of a first diode), a diode 424 (an example of a high-side diode and an example of a second diode), a Zener diode 415 (an example of a low-side switch diode), a Zener diode 425 (an example of a high-side switch diode), a capacitor 416, and a capacitor 426 in addition to the components of the substrate voltage control circuit 300 illustrated in FIG. 3. A low-side circuit 419 includes the N-ch MOSFET 312, the resistor 313, the diode 414, the Zener diode 415, and the capacitor 416. A high-side circuit 429 includes the N-ch MOSFET 322, the resistor 323, the diode 424, the Zener diode 425, and the capacitor 426.

The low-side circuit 419 is a circuit for applying voltage Vs1 at the first source connection terminal 111 to the substrate voltage control terminal 101 when voltage Vs2 at the second source connection terminal 121 is higher than the voltage Vs1 at the first source connection terminal 111. The high-side circuit 429 is a circuit for applying voltage Vs2 at the second source connection terminal 121 to the substrate voltage control terminal 101 when the voltage Vs1 at the first source connection terminal 111 is higher than the voltage Vs2 at the second source connection terminal 121.

In the low-side circuit 419, an anode terminal a of the diode 414 is connected to the gate terminal G of the N-ch MOSFET 312, and a cathode terminal k of the diode 414 is connected to the second source connection terminal 121. An anode terminal a of the Zener diode 415 is connected to the substrate voltage control terminal 101, and a cathode terminal k of the Zener diode 415 is connected to the gate terminal G of the N-ch MOSFET 312. The capacitor 416 is connected between the gate terminal G of the N-ch MOSFET 312 and the first source connection terminal 111.

Likewise, in the high-side circuit 429, an anode terminal a of the diode 424 is connected to the gate terminal G of the N-ch MOSFET 322, and a cathode terminal k of the diode 424 is connected to the first source connection terminal 111. An anode terminal a of the Zener diode 425 is connected to the substrate voltage control terminal 101, and a cathode terminal k of the Zener diode 425 is connected to the gate terminal G of the N-ch MOSFET 322. The capacitor 426 is connected between the gate terminal G of the N-ch MOSFET 322 and the second source connection terminal 121.

Operation and component values of the low-side circuit 419 will be described below. The following description will be given on the assumption that the voltage Vsub is higher than the voltage Vs1 (Vsub>Vs1).

Diode

Voltage at the second source connection terminal 121 relative to the voltage at the first source connection terminal 111 is defined as voltage Vs2*s*1 as in the first embodiment. When the voltage Vs2*s*1 is a positive voltage higher than the threshold voltage Vth of the N-ch MOSFET 312, the N-ch MOSFET 312 is in the ON state. When the voltage Vs2*s*1 is a positive voltage lower than the threshold voltage Vth of the N-ch MOSFET 312, the N-ch MOSFET 312 is in the OFF state. In addition, when the voltage Vs2*s*1 is a negative voltage, the N-ch MOSFET 312 is in the OFF state.

When the voltage Vs2*s*1 becomes lower than the threshold voltage Vth in a period in which the voltage Vs2*s*1 changes from a positive voltage toward 0 V and in a transition period in which the voltage Vs2*s*1 changes from a positive voltage to a negative voltage, the N-ch MOSFET 312 needs to be turned OFF immediately.

However, since there is parasitic capacitance at the gate terminal G of the N-ch MOSFET 312, the change in the gate voltage Vgs may delay with respect to the change in the voltage Vs2 at the second source connection terminal 121. This delay is equal to a value relating to a time constant, which is determined by a product of the parasitic capacitance and resistance of the resistor 313. If such delay occurs, the N-ch MOSFET 312 may be kept in the ON state for a while even after the voltage Vs2*s*1 becomes a negative voltage, for example. At that time, since the N-ch MOSFET 322 of the high-side circuit 429 is also in the ON state, the second source connection terminal 121 and the first source connection terminal 111 are short-circuited via the N-ch MOSFET 312 and the N-ch MOSFET 322, which possibly damages the circuits such as the substrate voltage control circuit 400 and the bidirectional switching device 900. Accordingly, the substrate voltage control circuit 400 needs to sufficiently reduce the delay and to turn OFF the N-ch MOSFET 312 immediately. The diode 414 is provided to reduce the delay.

When the gate voltage Vgs of the N-ch MOSFET 312 is higher than the voltage Vs2 at the second source connection terminal 121 by threshold voltage Vf of the diode 414 (Vgs>Vs2+Vf), the diode 414 is in the ON state and conducts current from the anode terminal a to the cathode terminal k. Accordingly, when the voltage Vs2*s*1 decreases and the gate voltage Vgs consequently becomes higher than the voltage Vs2 by the threshold voltage Vf, the diode 414 is set to the ON state and removes electric charge accumulated as parasitic capacitance of the N-ch MOSFET 312. As a result, the gate voltage Vgs of the N-ch MOSFET 312 successfully follows the change in the voltage Vs2*s*1 immediately. In order to set the N-ch MOSFET 312 to the OFF state for sure when the voltage Vs2*s*1 is at around 0 V, the diode 414 needs to be set to the ON state before the N-ch MOSFET 312 is set to the OFF state. Thus, the threshold voltage Vth of the N-ch MOSFET 312 is set to be higher than the threshold voltage Vf of the diode 414.

Zener Diodes

The Zener diodes 415 and 425 are protection circuits for protecting the gate terminals G of the N-ch MOSFETs 312 and 322 from being damaged by overvoltage, respectively. The Zener diode 415 has Zener voltage that is lower than allowable voltage of the gate terminal G of the N-ch MOSFET 312. With this configuration, the Zener diode 415 prevents voltage higher than the allowable voltage from being applied to the gate terminal G and consequently can avoid the damage of the gate terminal G by overvoltage.

The Zener diode 425 has Zener voltage that is lower than allowable voltage of the gate terminal G of the N-ch MOSFET 322. With this configuration, the Zener diode 425 prevents voltage higher than the allowable voltage from being applied to the gate terminal G and consequently can avoid the damage of the gate terminal G by overvoltage.

When the voltage Vsub at the substrate voltage control terminal 101 is higher than the voltage Vs1 at the first source connection terminal 111, the Zener diode 415 conducts current from the anode terminal a to the cathode terminal k and makes the voltage Vsub closer to the voltage Vs1 at the first source connection terminal 111.

In addition, when the voltage Vsub at the substrate voltage control terminal 101 is higher than the voltage Vs2 at the second source connection terminal 121, the Zener diode 425 conducts current from the anode terminal a to the cathode terminal k and makes the voltage Vsub closer to the voltage Vs2 at the second source connection terminal 121.

Resistors

As resistance of the resistor 313 decreases, the response of the voltage Vsub at the substrate voltage control terminal 101 to the voltage Vs2 at the second source connection terminal 121 improves. Thus, a lower resistance of the resistance 313 is more desirable. However, when the voltage Vs2*s*1 is a positive voltage, current flows from the second source connection terminal 121 to the first source connection terminal 111 via the resistor 313, the Zener diode 415, and the N-ch MOSFET 312. Accordingly, if the resistance of the resistance 313 is too low, the amount of current increases and consequently the loss in the substrate voltage control circuit 400 increases. Thus, the resistance of the resistor 313 may be set to an optimum value in consideration of a trade-off between the response of the voltage Vsub at the substrate voltage control terminal 101 and the loss. The same applies to the resistor 323. For example, the resistor 313 and the resistor 323 may each have a resistance that is greater than or equal to 500Ω and less than or equal to 500 kΩ.

Capacitor

There is parasitic capacitance between the anode terminal a and the cathode terminal k of the diode 414. There is also parasitic capacitance at the gate terminal G of the N-ch MOSFET 312. In the case where the voltage Vs2*s*1 is in a positive voltage range, current flows from the cathode terminal k to the anode terminal a of the Zener diode 415 when the voltage Vs2*sub* is higher than the Zener voltage of the Zener diode 415. Accordingly, the gate voltage Vgs of the N-ch MOSFET 312 is clamped at the Zener voltage of the Zener diode 415, that is, at a constant voltage. When the voltage Vs2*sub* decreases from a voltage higher than the Zener voltage of the Zener diode 415 toward 0 V, displacement current flows from the cathode terminal k to the anode terminal a of the Zener diode 415 because of coupling caused by the parasitic capacitance that is present between the cathode terminal k and the anode terminal a of the diode 414. This displacement current decreases the gate voltage Vgs of the N-ch MOSFET 312.

The gate voltage Vgs may consequently become lower than the threshold voltage Vth before the voltage Vs2*s*1 decreases to be close to 0 V in the positive voltage range, and the N-ch MOSFET 312 may be set to the OFF state. As a result, the waveform of the controlled voltage Vsub at the substrate voltage control terminal 101 may deviate from the ideal waveform and the performance may decrease. The capacitor 416 is provided to improve this situation.

The capacitor 416 decreases a variance in the gate voltage Vgs of the N-ch MOSFET 312. Specifically, when the voltage Vs2*s*1 decreases to be close to 0 V in the positive voltage range, the capacitor 416 absorbs part of displacement current that flows from the cathode terminal k to the anode terminal a of the Zener diode 415 due to the parasitic capacitance of the diode 414. Accordingly, the capacitor 416 successfully suppresses a decrease in the gate voltage Vgs of the N-ch MOSFET 312. As a result, the N-ch MOSFET 312 is kept in the ON state until the voltage Vs2*s*1 decreases to be close to 0 V. Thus, the waveform of the voltage Vsub can be made closer to the ideal waveform.

As the capacitance of the capacitor 416 increases, the voltage waveform at the substrate voltage control terminal 101 can be made closer to the ideal waveform; however, the loss increases. There is a trade-off between the loss and the degree at which the voltage waveform at the substrate voltage control terminal 101 is made closer to the ideal waveform. Accordingly, the capacitance of the capacitor 416 may be set to an appropriate value in consideration of a relationship between the loss and the characteristics of the voltage waveform at the substrate voltage control terminal 101. For example, the capacitor 416 may have a capacitance that is greater than or equal to 100 pF and less than or equal to 10 nF.

The above description is regarding the operation and component values of the low-side circuit 419. Since the high-side circuit 429 and the low-side circuit 419 have substantially the same circuit configuration except that connections to the first source connection terminal 111 and the second source connection terminal 121 are opposite. Thus, operation and components values of the high-side circuit 429 are substantially the same as those of the low-side circuit 419, and a description thereof is omitted, Simulation A result of a circuit simulation performed by using the substrate voltage control circuit 400 illustrated in FIG. 4 will be described next.

Figure 5A:
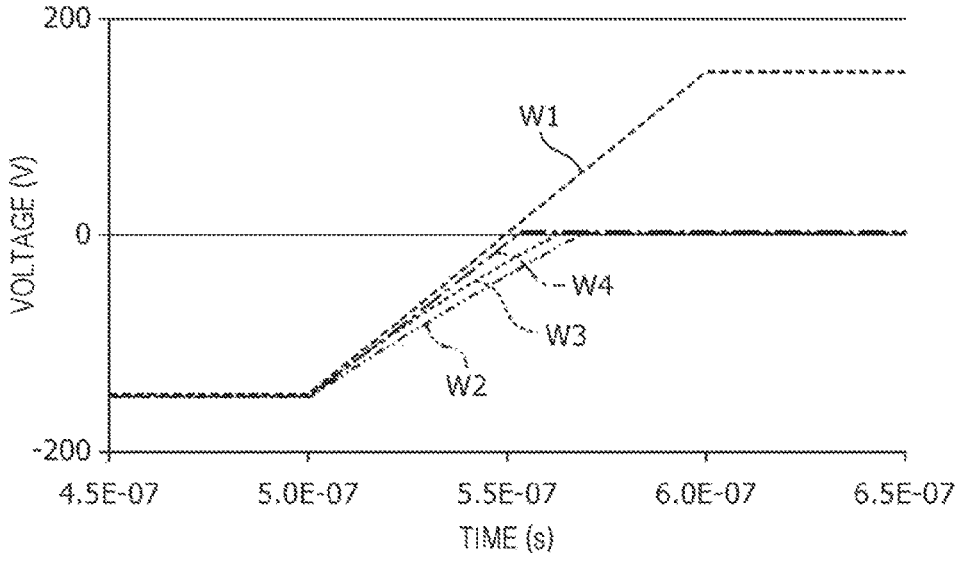
FIG. 5A is a waveform diagram illustrating a result of a circuit simulation.
Figure 5B:
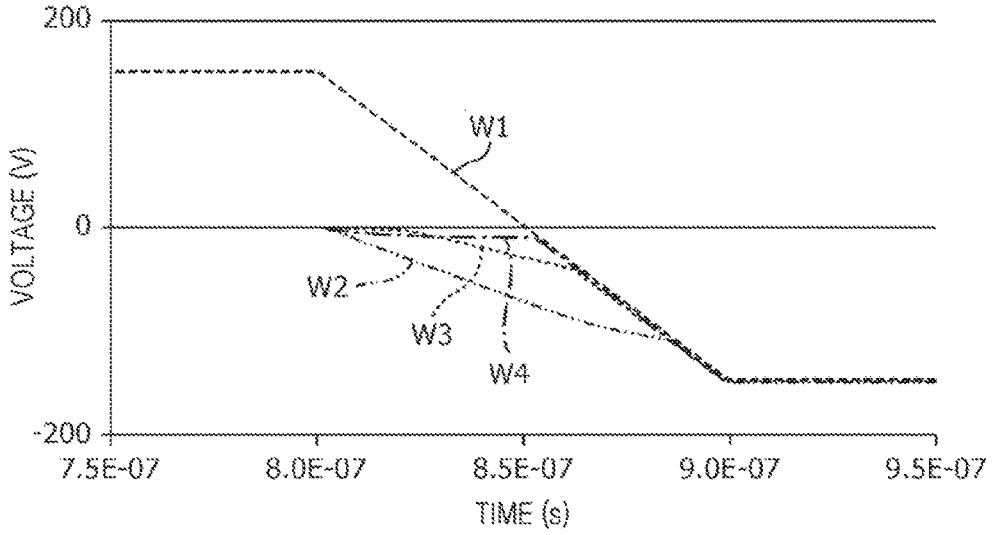
FIG. 5B is a waveform diagram illustrating the result of the circuit simulation.

FIGS. 5A and 5B are waveform diagrams each illustrating the result of the circuit simulation. In this circuit simulation, the waveform of the voltage Vsub at the substrate voltage control terminal 101 is observed when voltage at the second source connection terminal 121 is changed from −150 V to +150 V and is changed from +150 V to −150 V with voltage at the first source connection terminal 111 being fixed at 0 V. The response of the voltage Vsub to the voltage Vs2*s*1 is then evaluated. In this circuit simulation, a period for which the voltage Vs2*s*1 is changed is 100 ns.

FIG. 5A illustrates a waveform of the voltage Vsub when the voltage Vs2*s*1 changes from a negative voltage to a positive voltage, whereas FIG. 5B illustrates a waveform of the voltage Vsub when the voltage Vs2*s*1 changes from a positive voltage to a negative voltage. FIGS. 5A and 5B show four voltage waveforms W1 to W4. The voltage waveform W1 represents the waveform of the voltage Vs2*s*1, and the voltage waveforms W2 to W4 each represent the waveform of the voltage Vsub.

Circuit conditions are set different for the waveforms W2 to W4. The circuit conditions for the waveform W2 are that the resistors 313 and 323 and the capacitor 416 and 426 are removed. The circuit conditions for the waveform W3 are that the resistors 313 and 323 each have a resistance of 1 kΩ and the capacitors 416 and 426 are removed. The circuit conditions for the waveform W4 are that the resistors 313 and 323 each have a resistance of 1 kΩ and the capacitors 416 and 426 each have a capacitance of 1 nF.

In both of FIGS. 5A and 5B, a difference in the response of the voltage Vsub to the voltage Vs2*s*1 is observed when the voltage Vs2*s*1 changes in a negative voltage range. In a steady state in which the voltage Vs2*s*1 is constant, the voltage Vsub has the same waveform in either case.

Comparison of the waveform W2 obtained when the resistors 313 and 323 are removed with the waveform W3 obtained when the resistors 313 and 323 each having a resistance of 1 kΩ are added indicates that a period from when the waveform W1 reaches 0 V to when the waveform W3 reaches 0 V is shorter than a period from when the waveform W1 reaches 0 V to when the waveform W2 reaches 0 V in FIG. 5A. Additionally, Comparison of the waveform W2 with the waveform W3 indicates that a period from when the waveform W1 reaches 0 V to when the waveform W3 overlaps the waveform W1 is shorter than a period from when the waveform W1 reaches 0 V to when the waveform W2 overlaps the waveform W1 in FIG. 5B. That is, the waveform W3 is closer to the ideal waveform. Comparison of the waveform W3 with the waveform W4 obtained when the capacitors 416 and 426 each having a capacitance of 1 nF are added to the circuit conditions for the waveform W3 indicates that a period from when the waveform W1 reaches 0 V to when the waveform W4 reaches 0 V is shorter than the period from when the waveform W1 reaches 0 V to when the waveform W3 reaches 0 V in FIG. 5A. Additionally, Comparison of the waveform W3 with the waveform W4 indicates that a period from when the waveform W1 reaches 0 V to when the waveform W4 overlaps the waveform W1 is shorter than a period from when the waveform W1 reaches 0 V to when the waveform W3 overlaps the waveform W1 in FIG. 5B. That is, the waveform W4 is closer to the ideal waveform than the waveform W3. The result of the circuit simulation that matches the above description of the operation given with reference to FIG. 4 is obtained for the waveform W4.

As described above, the operation of the substrate voltage control circuit 400 expected in the second embodiment of the present disclosure is confirmed through the circuit simulation.

As described above, since the substrate voltage control circuit 400 includes the diodes 414 and 424 and the capacitors 416 and 426, the substrate voltage control circuit 400 successfully increases the response of the voltage Vsub to the voltage Vs2*s*1 and makes the waveform of the voltage Vsub closer to the ideal voltage waveform.

Structure of Bidirectional Switching Device

Substrate voltage control circuits according to embodiments of the present disclosure can be formed as an integrated circuit on a chip on which a semiconductor element serving as the bidirectional switching device is formed. Prior to a description regarding integration of the substrate voltage control circuits, the structure of the bidirectional switching device will be described first with reference to FIG. 7.

Figure 7:
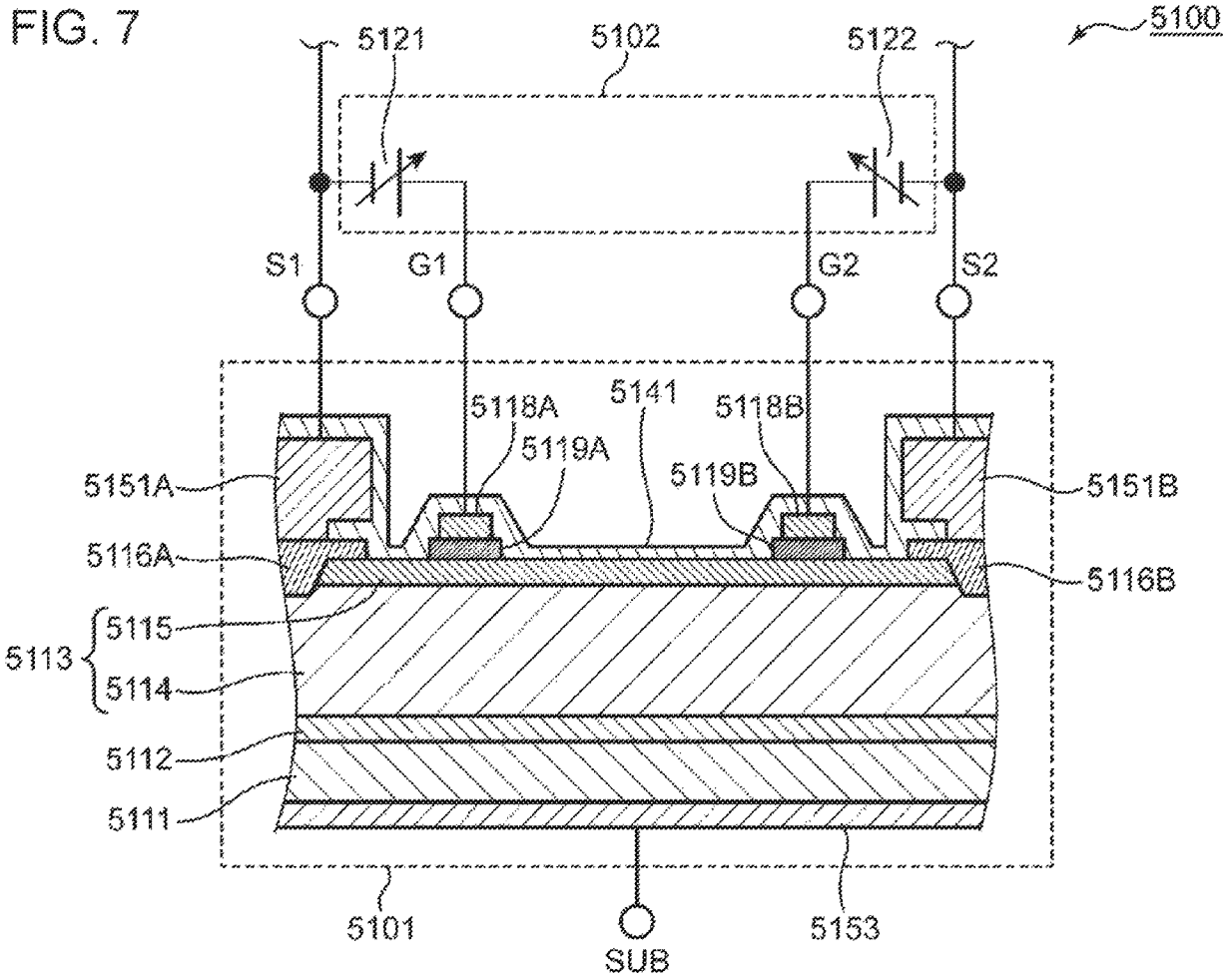
FIG. 7 is a diagram illustrating a cross-sectional structure of a GaN bidirectional switching device to which a gate driver circuit unit is connected.

FIG. 7 is a diagram illustrating a cross-sectional structure of a GaN bidirectional switching device 5101 to which a gate driver circuit unit 5102 is connected.

As illustrated in FIG. 7, the GaN bidirectional switching device 5101 includes a buffer layer 5112 formed on a conductive silicon (Si) substrate 5111 and having a thickness of approximately 1 μm, and a semiconductor multilayer 5113 formed on the buffer layer 5112. The buffer layer 5112 includes aluminum nitride (AlN) layers each having a thickness of approximately 10 nm and gallium nitride (GaN) layers each having a thickness of approximately 10 nm, which are alternately stacked one on another.

The semiconductor multilayer 5113 includes a first semiconductor layer 5114 and a second semiconductor layer 5115 that are sequentially stacked in this order from the side closer to the Si substrate 5111. The second semiconductor layer 5115 has a wider bandgap than the first semiconductor layer 5114. The first semiconductor layer 5114 is an undoped gallium nitride (GaN) layer having a thickness of approximately 2 μm. The second semiconductor layer 5115 is an n-type aluminum gallium nitride (AlGaN) layer having a thickness of approximately 20 nm.

Electric charge is produced near the hetero-interface between the first semiconductor layer 5114 composed of GaN and the second semiconductor layer 5115 composed of AlGaN by spontaneous polarization and piezoelectric polarization. As a result, a channel region is produced, which is a two-dimensional electron gas layer having a sheet carrier concentration of $1\times10^{13}$ $cm^{-2}$ or greater and a mobility of 1000 $cm^2V/sec$ or greater.

A first ohmic electrode 5116A and a second ohmic electrode 5116B are formed on the semiconductor multilayer 5113 to be spaced apart from each other. Each of the first ohmic electrode 5116A and the second ohmic electrode 5116B is a multilayer of titanium (Ti) and aluminum (Al) and is in ohmic contact with the channel region.

In the configuration illustrated in FIG. 7, part of the second semiconductor layer 5115 is removed in order to reduce the contact resistance. Further, the upper surface of the first semiconductor layer 5114 is partially made lower by approximately 40 nm, and the first ohmic electrode 5116A and the second ohmic electrode 5115B are in contact with the interface between the first semiconductor layer 5114 and the second semiconductor layer 5115. Note that the first ohmic electrode 5116A and the second ohmic electrode 5116B may be formed on the upper surface of the second semiconductor layer 5115.

An S1 electrode interconnect 5151A composed of Au and Ti is formed on the upper surface of the first ohmic electrode 5116A and is electrically connected to the first ohmic electrode 5116A. An S2 electrode interconnect 5151B composed of Au and Ti is formed on the upper surface of the second ohmic electrode 5116E and is electrically connected to the second ohmic electrode 5116B.

A first p-type semiconductor layer 5119A and a second p-type semiconductor layer 5119B are selectively formed to be spaced apart from each other in a region between the first ohmic electrode 5116A and the second ohmic electrode 5116B on the upper surface of the second semiconductor layer 5115. A first gate electrode 5118A is formed on the upper surface of the first p-type semiconductor layer 5119A. A second gate electrode 5118B is formed on the upper surface of the second p-type semiconductor layer 5119B. The first gate electrode 5118A and the second gate electrode 5118B are each composed of a multilayer of palladium (Pd) and gold (Au) and are respectively in ohmic contact with the first p-type semiconductor layer 5119A and the second p-type semiconductor layer 5119B.

A protective film 5141 composed of silicon nitride (SiN) is formed to cover the S1 electrode interconnect 5151A, the first ohmic electrode 5116A, the second semiconductor layer 5115, the first p-type semiconductor layer 5119A, the first gate electrode 5118A, the second p-type semiconductor layer 5119B, the second gate electrode 5118B, the second ohmic electrode 5116B, and the S2 electrode interconnect 5151B.

A back-surface electrode 5153, which is a multilayer of nickel (Ni), chromium (Cr), and silver (Ag) having a thickness of approximately 800 nm, is formed on the back surface of the Si substrate 5111. The back-surface electrode 5153 is in ohmic contact with the Si substrate 5111.

A terminal connected to the first ohmic electrode 5116A, a terminal connected to the first gate electrode 5118A, a terminal connected to the second gate electrode 5118B, and a terminal connected to the second ohmic electrode 5116B respectively correspond to the source terminal S1, the gate terminal G1, the gate terminal G2, and the source terminal S2 illustrated in FIG. 6. In addition, a terminal connected to the back-surface electrode 5153 corresponds to the substrate terminal SUB illustrated in FIG. 6.

The first p-type semiconductor layer 5119A and the second p-type semiconductor layer 5119B each have a thickness of approximately 300 nm and are each composed of p-type GaN doped with magnesium (Mg). Each of the first p-type semiconductor layer 5119A and the second p-type semiconductor layer 5119B forms a p-n junction with the second semiconductor layer 5115. With this configuration, since a depletion layer extends from the first p-type semiconductor layer 5119A to the channel region when voltage across the first ohmic electrode 5116A and the first gate electrode 5118A is lower than or equal to, for example, 0 V, current that flows through the channel is successfully blocked. Likewise, since a depletion layer extends from the second p-type semiconductor layer 5119B to the channel region when voltage across the second ohmic electrode 5116B and the second gate electrode 5118B is lower than or equal to, for example, 0 V, current that flows through the channel is successfully blocked. Thus, a semiconductor element that performs a so-called normally-off operation can be implemented. In addition, the distance between the first p-type semiconductor layer 5119A and the second p-type semiconductor layer 5119B is designed to withstand the maximum voltage applied across the first ohmic electrode 5116A and the second ohmic electrode 5116B.

The gate driver circuit unit 5102 includes a first power supply 5121 connected between the source terminal S1 and the gate terminal G1 and a second power supply 5122 connected between the source terminal S2 and the gate terminal G2. The first power supply 5121 and the second power supply 5122 are variable power supplies that are capable of changing output voltage. Note that gate circuits each including a power supply therein may be used instead of the first power supply 5121 and the second power supply 5122 which are variable power supplies.

Voltage of the first power supply 5121 is set to be lower than threshold voltage of the first gate electrode 5118A so as to make a depletion layer extend below the first gate electrode 5118A. Voltage of the second power supply 5122 is set to be lower than threshold voltage of the second gate electrode 5118E so as to make a depletion layer extend below the second gate electrode 5118B.

With such a configuration, no current flows in either directions between the source terminal S2 which is the first ohmic electrode 5116A and the source terminal S2 which is the second ohmic electrode 5116B. If the voltage of the first power supply 5121 is set to be higher than or equal to the threshold voltage of the first gate electrode 5118A and the voltage of the second power supply 5122 is set to be higher than or equal to the threshold voltage of the second gate electrode 5118B, current can flow in both directions between the source terminal S1 and the second terminal S2. If the voltage of the first power supply 5121 is set to be higher than or equal to the threshold voltage of the first gate electrode 5118A and the voltage of the second power supply 5122 is set to be lower than the threshold voltage of the second gate electrode 5118B, current does not flow from the source terminal S1 to the source terminal S2 but current flows from the source terminal S2 to the source terminal S1. If the voltage of the first power supply 5121 is set to be lower than the threshold voltage of the first gate electrode 5118A and the voltage of the second power supply 5122 is set to be higher than or equal to the threshold voltage of the first gate electrode 5118A, current flows from the source terminal S1 to the source terminal S2 but current does not flow from the source terminal S2 to the source terminal S1.

A structure in the case where the components of the substrate voltage control circuit are formed by using the same semiconductor process as that used to form the GaN bidirectional switching device 5101 will be described next. Since the substrate voltage control circuit and the GaN bidirectional switching device 5101 are formed by using the same semiconductor process, they can be integrated on the same chip, which will be described below.

Figure 8:
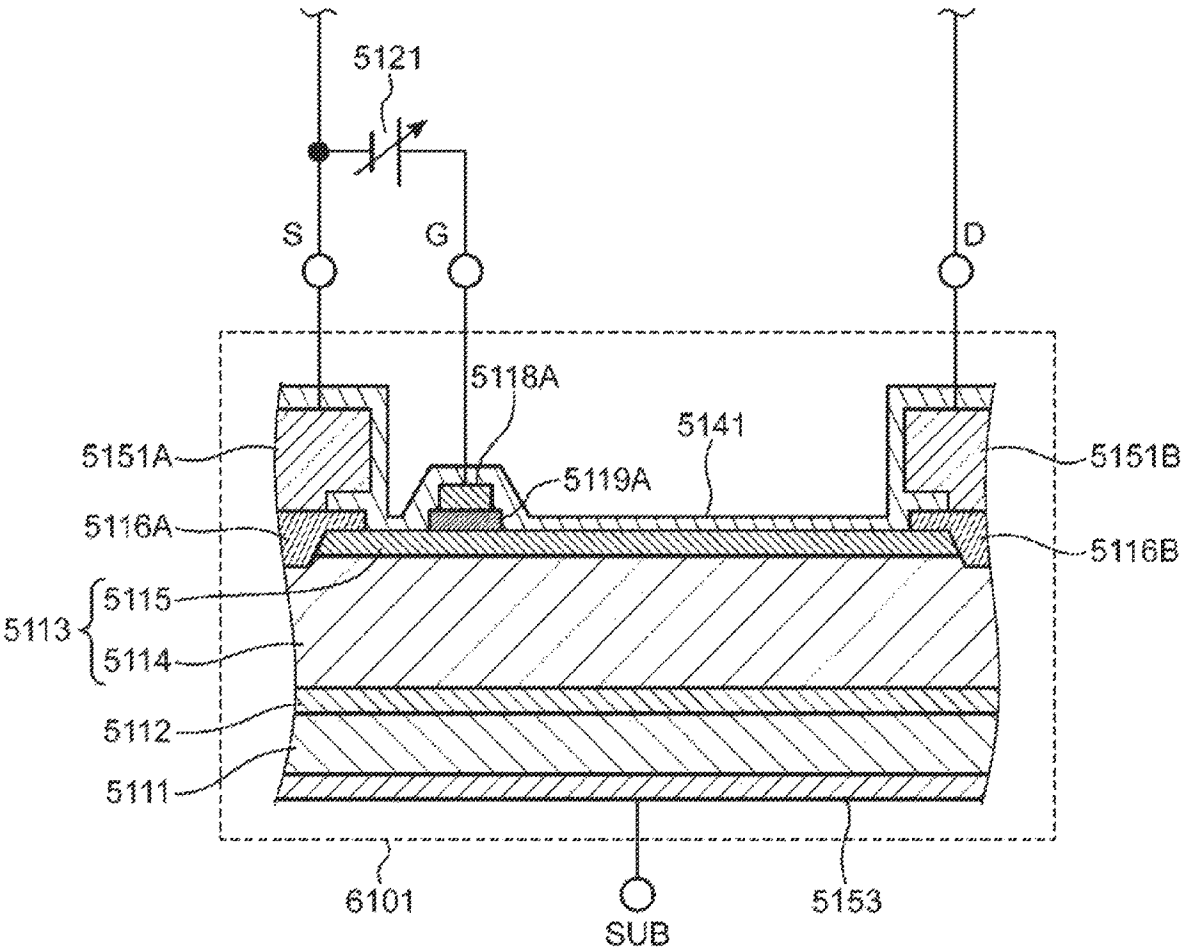
FIG. 8 is a diagram illustrating a cross-sectional structure of a GaN switching device.

Suppose that N-ch MOSFET 312 and the N-ch MOSFET 322 illustrated in FIG. 4 are each replaced with a GaN switching device. FIG. 8 is a diagram illustrating a cross-sectional structure of a GaN switching device 6101. The GaN switching device 6101 is not a bidirectional switching device but is a single-directional switching device including three terminals, i.e., a source terminal S, a drain terminal D, and a gate terminal G. The GaN switching device 6101 can be formed to have a structure obtained by removing the second gate electrode 5118E and the second p-type semiconductor layer 5119B from the structure of the GaN bidirectional switching device 5101 illustrated in FIG. 7. Accordingly, the GaN switching device 6101 can be formed by using the same semiconductor process as that used for the GaN bidirectional switching device 5101. In addition, the source terminal S1, the source terminal S2, and the gate terminal G1 of the GaN bidirectional switching device 5101 respectively serve as the source terminal S, the drain terminal D, and the gate terminal G of the GaN switching device 6101.

When voltage (gate voltage Vgs) at the gate terminal G relative to voltage at the source terminal S is higher than threshold voltage of the GaN switching device 6101, the GaN switching device 6101 is in the ON state and electrically short-circuits the source terminal S and the drain terminal D. In addition, when the gate voltage Vgs is lower than the threshold voltage, the GaN switching device 6101 is in the OFF state and causes the source terminal S and the drain terminal D to be electrically open.

Figure 9:
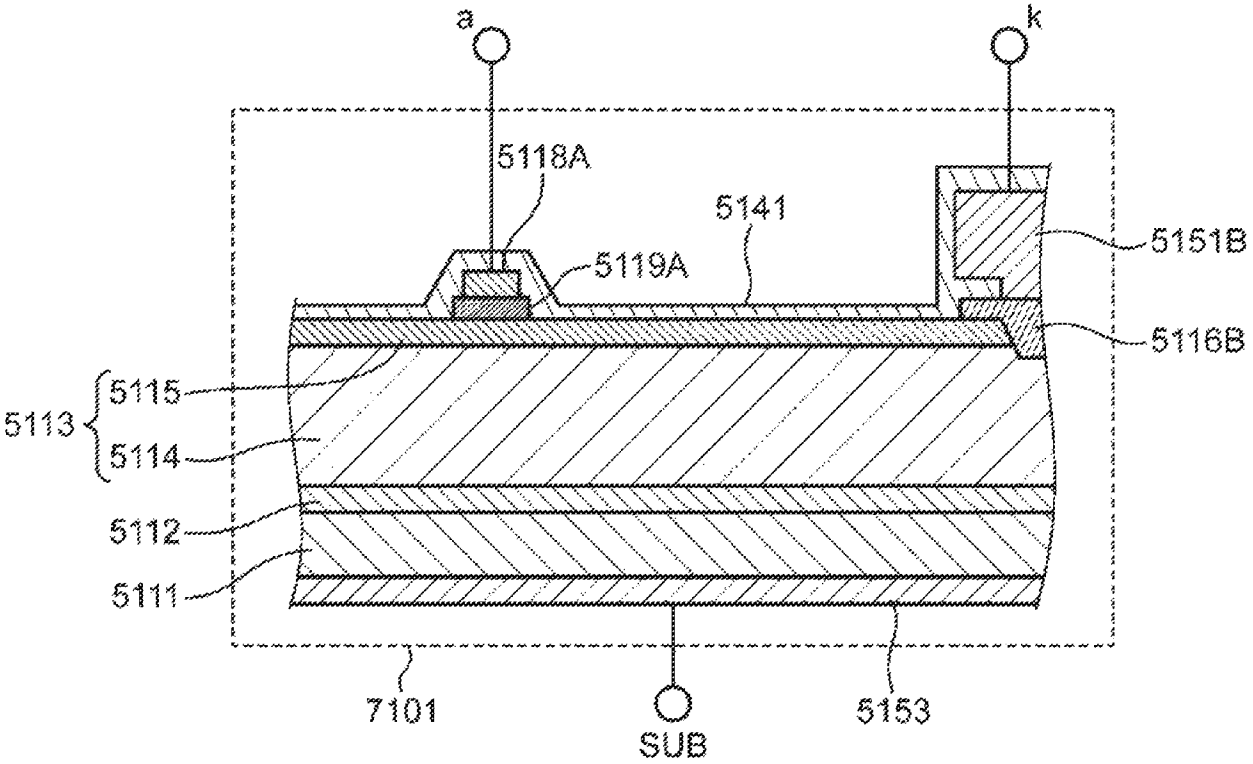
FIG. 9 is a diagram illustrating a cross-sectional structure of a GaN diode.

A method for forming the diodes 414 and 424 illustrated in FIG. 4 by using GaN, which is a semiconductor material, will be described next. FIG. 9 is a diagram illustrating a cross-sectional structure of a GaN diode 7101. The GaN diode 7101 is formed to have a structure obtained by removing the S1 electrode interconnect 5151A and the first ohmic electrode 5116A from the structure of the GaN switching device 6101 illustrated in FIG. 8. Accordingly, the GaN diode 7101 can be formed by using the same semiconductor process as that used for the GaN bidirectional switching device 5101. In addition, the gate terminal G and the drain terminal D of the GaN switching device 6101 respectively serve as an anode terminal a and a cathode terminal k of the GaN diode 7101.

The GaN diode 7101 is formed by using a p-n junction formed by the first p-type semiconductor layer 5119A and the second semiconductor layer 5115. When voltage Vak at the anode terminal a relative to voltage at the cathode terminal k is higher than threshold voltage Vf of the GaN diode 7101, the GaN diode 7101 is in the ON state and conducts current. In addition, when the voltage Vak is lower than the threshold voltage Vf, the GaN diode 7101 is in the OFF state and does not conduct current.

The resistors 313 and 323 illustrated in FIG. 4 can be formed by using the same material and layer as the first p-type semiconductor layer 5119A illustrated in FIG. 7. The resistors 313 and 323 can each have a desired resistance by adjusting the width and length of the layout of the first p-type semiconductor layer 5119A. Accordingly, the resistors 313 and 323 can be formed by using the same semiconductor process as that used for the GaN bidirectional switching device 5101.

The resistors 313 and 323 may each be formed by using a material, such as tungsten silicon nitride (WSiN).

The Zener diodes 415 and 425 illustrated in FIG. 4 are elements for protecting the gate terminal G from overvoltage. The GaN switching device 6101 includes a p-n junction diode between the gate terminal G and the source terminal S. Accordingly, this included diode functions to protect the gate terminal G from overvoltage and has the role of the Zener diodes 415 and 425. In this case, the Zener diodes 415 and 425 need not be formed as external electrical components.

The capacitors 416 and 426 illustrated in FIG. 4 will be described. If a capacitor having a large capacitance is formed using a semiconductor process, the chip area increases, which is not preferable. The substrate voltage control circuit 400 illustrated in FIG. 4 is capable of operating without the capacitors 416 and 426 as described above. It is desirable that the capacitors 416 and 426 be connected to the substrate voltage control circuit 400 as external electrical components instead of being integrated on the semiconductor chip when they are necessary.

Integration achieved by forming the GaN switching device 6101, the GaN diode 7101, and the resistors, which are components of the substrate voltage control circuit 400 illustrated in FIG. 4, on the surface of a single semiconductor chip has been described above. These components need to be electrically separated. Element separation can be implemented by using, for example, the trench structure.

A method for connecting the substrate voltage control terminal 101 of the integrated substrate voltage control circuit 400 to the back-surface electrode 5153 of the GaN bidirectional switching device 5101 will be described next.

The back-surface electrode 5153 is disposed on a lead frame when packaged. At that time, the back-surface electrode 5153 and the lead frame are electrically connected to each other. A pad for wire bonding may be provided at the substrate voltage control terminal 101, and this pad and the lead frame connected to the back-surface electrode 5153 may be connected by wire bonding.

In addition, a hole serving as a trench structure may be formed from the surface of the chip to the Si substrate 5111. An interconnect that connects an electrical node of the substrate voltage control terminal 101 that is formed on the surface of the chip with the Si substrate 5111 may be disposed in this hole.

Third Embodiment

Figure 10:
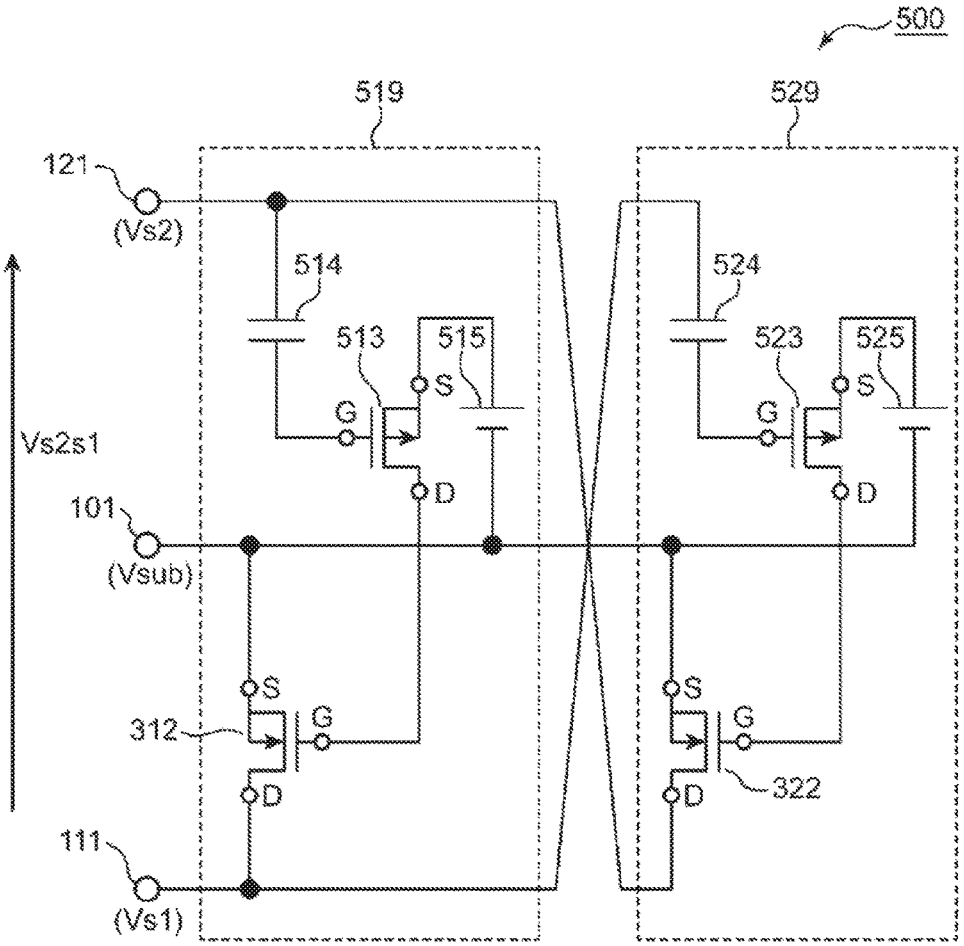
FIG. 10 is a diagram illustrating an example of a substrate voltage control circuit according to a third embodiment of the present disclosure.

FIG. 10 is a diagram illustrating an example of a substrate voltage control circuit 500 according to a third embodiment of the present disclosure. The substrate voltage control circuit 500 has a feature in which N-ch MOSFETs 312 and 322 are used respectively as the switches 112 and 122 illustrated in FIG. 1 and gate terminals G of the N-ch MOSFETs 312 and 322 are respectively driven by P-ch MOSFETs 513 and 523.

The source terminal S1 of the bidirectional switching device 900 is connected to the first source connection terminal 111. The source terminal S2 of the bidirectional switching device 900 is connected to the second source connection terminal 121. The substrate terminal SUB of the bidirectional switching device 900 is connected to the substrate voltage control terminal 101.

The substrate voltage control circuit 500 includes a low-side circuit 519 and a high-side circuit 529. The low-side circuit 519 includes the N-ch MOSFET (an example of a low-side first switch), the P-ch MOSFET 513 (an example of a low-side second switch), a capacitor 514 (an example of a low-side capacitor), and a power supply 515 (an example of a low-side power supply).

The high-side circuit 529 includes the N-ch MOSFET 322 (an example of a high-side first switch), the P-ch MOSFET 523 (an example of a high-side second switch), a capacitor 524 (an example of a high-side capacitor), and a power supply 525 (an example of a high-side power supply).

The low-side circuit 519 is a circuit for applying voltage Vs1 at the first source connection terminal 111 to the substrate voltage control terminal 101. The high-side circuit 529 is a circuit for applying voltage Vs2 at the second source connection terminal 121 to the substrate voltage control terminal 101.

The low-side circuit 519 will be described first. A source terminal S of the N-ch MOSFET 312 is connected to the substrate voltage control terminal 101, a drain terminal D of the N-ch MOSFET 312 is connected to the first source connection terminal 111, and a gate terminal G of the N-ch MOSFET 312 connected to a drain terminal D of the P-ch MOSFET 513. A source terminal of the P-ch MOSFET 513 is connected to a positive terminal of the power supply 515. The capacitor 514 is connected between a gate terminal G of the P-ch MOSFET 513 and the second source connection terminal 121. A negative terminal of the power supply 515 is connected to the substrate voltage control terminal 101.

Now, let voltage Vs2*s*1 denote voltage at the second source connection terminal 121 relative to voltage at the first source connection terminal 111. When the voltage Vs2*s*1 decreases in a positive voltage range, voltage at the gate terminal G of the P-ch MOSFET 513 decreases due to coupling caused by the capacitor 514. Gate voltage Vgs of the P-ch MOSFET 513 is voltage at the gate terminal G of the P-ch MOSFET 513 relative to voltage at the positive terminal of the power supply 515. The P-ch MOSFET 513 is in the ON state when the gate voltage Vgs is lower than threshold voltage of the P-ch MOSFET 513 and is in the OFF state when the gate voltage Vgs is higher than the threshold voltage.

When the P-ch MOSFET 513 is in the ON state, the positive voltage of the power supply 515 is applied to the gate terminal G of the N-ch MOSFET 312. The N-ch MOSFET 312 is in the ON state when gate voltage Vgs of the N-ch MOSFET 312 is higher than threshold voltage of the N-ch MOSFET 312 and is in the OFF state when the gate voltage Vgs is lower than the threshold voltage. That is, when the voltage Vs2*s*1 decreases in the positive voltage range, the P-ch MOSFET 513 is set to the ON state and then the N-ch MOSFET 312 is set to the ON state. As a result, the voltage Vs1 at the first source connection terminal 111 is applied to the substrate voltage control terminal 101.

Accordingly, the substrate voltage control circuit 500 successfully sets the voltage Vsub at the substrate voltage control terminal 101 to the voltage Vs1 at the first source connection terminal 111 when the voltage Vs2*s*1 changes and successfully prevents the floating state of the voltage Vsub at the substrate voltage control terminal 101. As a result, the substrate voltage control circuit 500 successfully controls the bidirectional switching device 900 to operate with stable switching characteristics and with a reduced switching-characteristics variance between two current-flow directions.

The gate voltage Vgs of the N-h MOSFET 312 is voltage at the gate terminal G of the N-ch MOSFET 312 relative to the lower one of the voltages at the source terminal S and the drain terminal D of the N-ch MOSFET 312.

Accordingly, in the case where the voltage Vsub at the substrate voltage control terminal 101 is lower than the voltage Vs1 at the first source connection terminal 111, if the gate voltage Vgs relative to the voltage at the source terminal S becomes higher than the threshold voltage, the N-ch MOSFET 312 is set to the ON state and short-circuits the source terminal S and the drain terminal D. With this configuration, the N-ch MOSFET 312 successfully sets the voltage Vsub at the substrate voltage control terminal 101 to the voltage Vs1 at the first source connection terminal 111 even if the voltage Vsub at the substrate voltage control terminal 101 is lower than the voltage Vs1 at the first source connection terminal 111.

The low-side circuit 519 and the high-side circuit 529 have substantially the same circuit configuration except that connections to the first source connection terminal 111 and the second source connection terminal 121 are opposite and operate in substantially the same manner.

The high-side circuit 529 will be described briefly next. When the voltage Vs2*s*1 increases in a negative voltage range and gate voltage Vgs of the P-ch MOSFET 523 decreases due to coupling caused by the capacitor 524, the P-ch MOSFET 523 is set to the ON state and then the N-ch MOSFET 322 is set to the ON state. As a result, voltage Vs2 at the second source connection terminal 121 is applied to the substrate voltage control terminal 101. Accordingly, the high-side circuit 529 successfully prevents the floating state of the voltage Vsub at the substrate voltage control terminal 101 when the voltage Vs2s1 changes just like the low-side circuit 519.

Each of the N-ch MOSFET 312 and the N-ch MOSFET 322 desirably include a body diode. The reason thereof will be described below. As described before in relation to the operation, a period in which the N-ch MOSFET 312 is in the ON state is a period in which the voltage Vs2s1 decreases, and the N-ch MOSFET 312 is kept in the OFF state in a period of a steady state in which the voltage Vs2s1 is constant. Accordingly, if the voltage Vs2 at the second source connection terminal 121 is higher than the voltage Vs1 at the first source connection terminal 111, the voltage Vsub at the substrate voltage control terminal 101 may be positive in some case because the voltage Vsub is electrically in the floating state.

As described in FIG. 2, an ideal waveform of voltage Vsub at the substrate voltage control terminal 101 is that the voltage Vsub at the substrate voltage control terminal 101 always matches the lower one of the voltage Vs1 at the first source connection terminal 111 and the voltage Vs2 at the second source connection terminal 121. Accordingly, when the voltage Vsub at the substrate voltage control terminal 101 becomes positive, the waveform of the voltage Vsub at the substrate voltage control terminal 101 is no longer ideal.

If the N-ch MOSFET 312 includes a body diode, the voltage Vsub at the substrate voltage control terminal 101 is set approximately to a voltage that is higher than the voltage Vs1 at the first source connection terminal 111 by threshold voltage Vf of the body diode when the voltage Vs2s1 is positive. As a result, the N-ch MOSFET 312 including a body diode successfully makes the waveform of the voltage Vsub at the substrate voltage control terminal 101 closer to the ideal voltage waveform. The same similarly applies to the N-ch MOSFET 322.

In the case where the N-ch MOSFET 312 and the N-ch MOSFET 322 are formed as devices not including a body diode, an external diode may be connected to each of the N-ch MOSFET 312 and the N-ch MOSFET 322. In this case, for the N-ch MOSFET 312, an anode terminal of the external diode may be connected to the substrate voltage control terminal 101, and a cathode terminal of the external diode may be connected to the first source connection terminal 111. In addition, for the N-ch MOSFET 322, an anode terminal of the external diode may be connected to the substrate voltage control terminal 101, and a cathode terminal of the external diode may be connected to the second source connection terminal 121.

In addition, the switches 112 and 122 are not limited to N-ch MOSFETs, and the N-ch MOSFETs 312 and 322 may be replaced with other switching devices, such as N-type FETs, IGBTs, JFETs, or BJTs. In this case, external diodes may be connected as in the case of the N-ch MOSFETs when switching devices not including a body diode are used.

As described above, in accordance with the third embodiment, since the gate terminal G of the N-ch MOSFET 312 is driven by the P-ch MOSFET 513 when the voltage Vs2s1 decreases in the positive voltage range, the drive performance of the N-ch MOSFET 312 is successfully increased. In addition, in accordance with the third embodiment, since the high-side circuit 529 operates in the same manner as the low-side circuit 519 when the voltage Vs2s1 increases in the negative voltage range, the drive performance of the N-ch MOSFET 322 is successfully increased.

Fourth Embodiment

The substrate voltage control circuit 500 illustrated in FIG. 10 is a basic circuit used to describe the principle. A substrate voltage control circuit 600 according to a fourth embodiment additionally has a protection function compared with the substrate voltage control circuit 500 according to the third embodiment and thus has a more practical circuit configuration.

Figure 11:
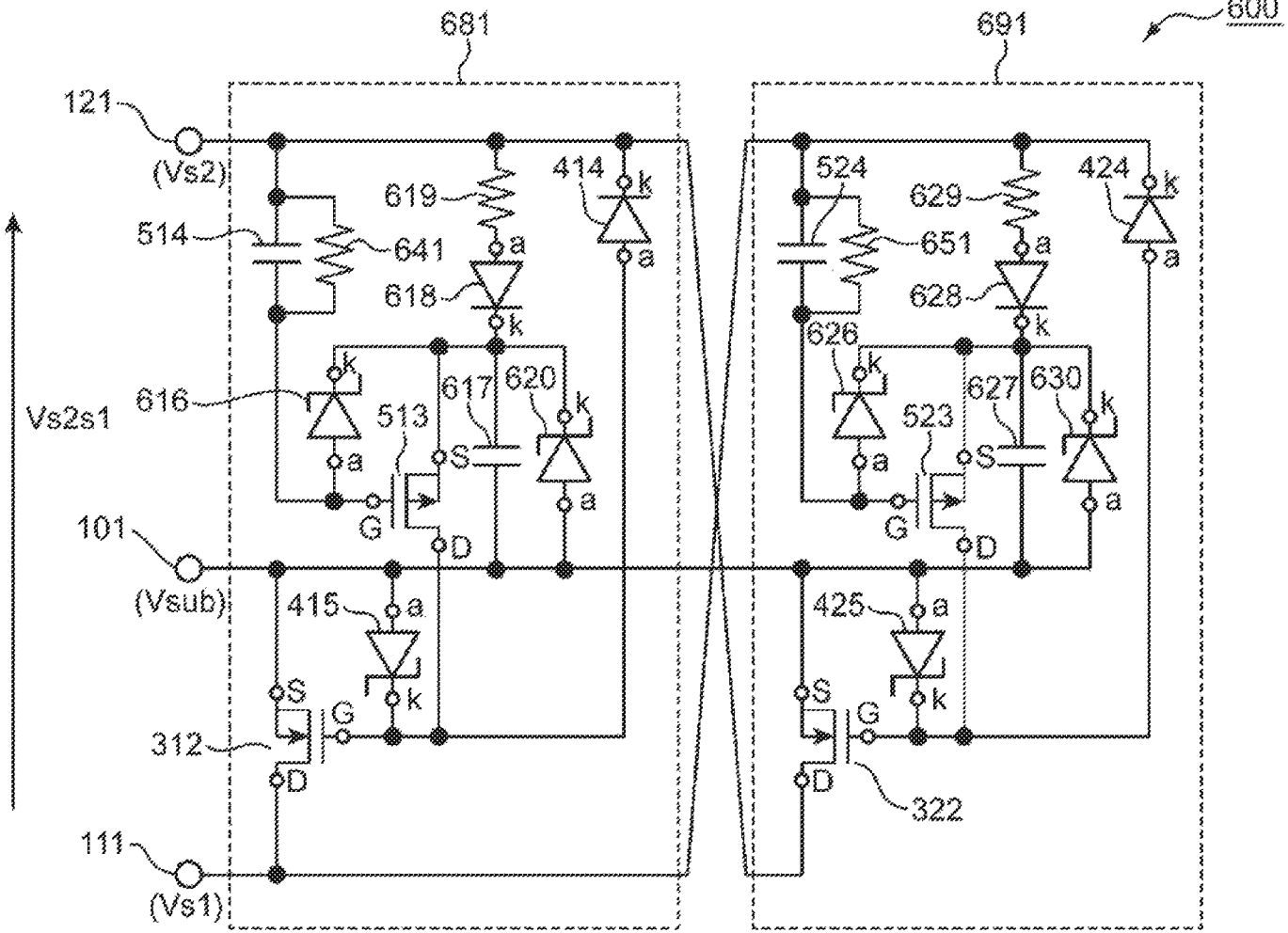
FIG. 11 is a diagram illustrating an example of a substrate voltage control circuit according to a fourth embodiment of the present disclosure.

FIG. 11 is a diagram illustrating an example of the substrate voltage control circuit 600 according to the fourth embodiment of the present disclosure. The substrate voltage control circuit 600 additionally includes Zener diodes 415, 616, 620, 425, 626, and 630, diodes 414, 618, 424, and 628, capacitors 617 and 627, and resistors 619, 641, 629, and 651 compared with the substrate voltage control circuit 500.

In the substrate voltage control circuit 600, functions of the two power supplies (i.e., the power supplies 515 and 525) of the substrate voltage control circuit 500 illustrated in FIG. 10 are implemented by circuits that utilize the capacitors 617 and 627. The substrate voltage control circuit 600 includes a low-side circuit 681 and a high-side circuit 691.

Operation and components of the low-side circuit 681 will be described below.

As in the substrate voltage control circuit 500, the N-ch MOSFET 312 is a switch for applying voltage Vs1 at the first source connection terminal 111 to the substrate voltage control terminal 101. As in the substrate voltage control circuit 500, the P-ch MOSFET 513 is a switch that turns ON when the voltage Vs2s1 decreases in a positive voltage range to drive the gate terminal G of the N-ch MOSFET 312. The capacitor 514 is a capacitor for driving the gate terminal G of the P-ch MOSFET 513 when the voltage Vs2s1 decreases in the positive voltage range.

Zener Diode 415

The Zener diode 415 (an example of a low-side switch diode) is a protection circuit for preventing the gate terminal G of the N-ch MOSFET 312 from being damaged by overvoltage. An anode terminal a of the Zener diode 415 is connected to the substrate voltage control terminal 101, and a cathode terminal k of the Zener diode 415 is connected to the gate terminal G of the N-ch MOSFET 312. The Zener diode 415 may have Zener voltage of approximately allowable voltage of the gate terminal G of the N-ch MOSFET 312. With this configuration, the Zener diode 415 successfully prevents voltage higher than the allowable voltage from being applied to the gate terminal G of the N-ch MOSFET 312 and can avoid the damage of the gate terminal G by overvoltage.

In addition, the Zener diode 415 is in the ON state when the voltage Vsub at the substrate voltage control terminal 101 is higher than the voltage Vs1 at the first source connection terminal 111 and makes the voltage Vsub at the substrate voltage control terminal 101 closer to the voltage Vs1 at the first source connection terminal 111.

The same applies to the Zener diode 425 of the high-side circuit 691.

Zener Diode 616

The Zener diode 616 is a protection circuit for preventing the gate terminal G of the P-ch MOSFET 513 from being damaged by overvoltage. An anode terminal a of the Zener diode 616 is connected to the gate terminal G of the P-ch MOSFET 513, and a cathode terminal k of the Zener diode 616 is connected to the source terminal S of the P-ch MOSFET 513. The Zener diode 616 may have Zener voltage of approximately allowable voltage of the gate terminal G of the P-ch MOSFET 513. With this configuration, the Zener diode 616 successfully prevents voltage higher than the allowable voltage from being applied to the gate terminal G of the P-ch MOSFET 513 and can avoid the damage of the gate terminal G by overvoltage.

The same applies to the Zener diode 626 of the high-side circuit 691.

Zener Diode 620

The Zener diode 620 is a voltage clamping circuit for determining the maximum voltage to be applied to the capacitor 617. An anode terminal a of the Zener diode 620 is connected to the substrate voltage control terminal 101, and a cathode terminal k of the Zener diode 620 is connected to the source terminal S of the P-ch MOSFET 513. As the Zener diode 620, a Zener diode having Zener voltage of approximately the maximum voltage for charging the capacitor 617 may be employed.

The same applies to the Zener diode 630 of the high-side circuit 691.

Diode 414

An anode terminal a of the diode 414 (an example of a low-side diode) is connected to the gate terminal G of the N-ch MOSFET 312, and a cathode terminal k of the diode 414 is connected to the second source connection terminal 121.

The diode 414 keeps the gate voltage Vgs of the N-ch MOSFET 312 to be lower than threshold voltage of the N-ch MOSFET 312 so as to keep the N-ch MOSFET 312 in the OFF state until the voltage Vs2*s*1 becomes a value close to 0 V. That is, the diode 414 turns ON when the voltage Vs2*s*1 decreases to be close to 0 V in the positive voltage range and removes electric charge from parasitic capacitance that is present at the gate terminal G of the N-ch MOSFET 312 so as to set the N-ch MOSFET 312 in the OFF state immediately.

In this way, the diode 414 successfully prevents the N-ch MOSFET 312 from being kept in the ON state when the voltage Vs2*s*1 is a negative voltage. As a result, the diode 414 can increase the response of the voltage Vsub at the substrate voltage control terminal 101 to the lower one of the voltages Vs1 and Vs2.

The same applies to the diode 424 of the high-side circuit 691.

Capacitor 617

The capacitor 617 is a power supply for the P-ch MOSFET 513 and is charged while the voltage Vs2*s*1 is positive. The capacitor 617 is connected between the anode terminal a and a the cathode terminal k of the Zener diode 620. A sufficiently large capacitance may be set for the capacitor 617 such that the capacitor 617 can supply electric charge necessary to drive the gate terminal G of the N-ch MOSFET 312 so as to set the N-ch MOSFET 312 to the ON state and to keep the N-ch MOSFET 312 in the ON state for an ON period. However, it is necessary to avoid making capacitance of the capacitor 617 too large because energy for charging/discharging the capacitor 617 becomes the loss.

The same applies to the capacitor 627 of the high-side circuit 691.

Diode 618

The diode 618 is a diode for preventing electric charge accumulated in the capacitor 617 from being discharged when the voltage Vs2*s*1 is negative. An anode terminal a of the diode 618 is connected to the resistor 619, and a cathode terminal k of the diode 618 is connected to the capacitor 617. The same applies to the diode 628 of the high-side circuit 691.

Resistor 619

The resistor 619 is a resistor for suppressing charging current when the capacitor 617 is charged. The resistor 619 is connected between the anode terminal a of the diode 618 and the second source connection terminal 121.

Resistance may be set for the resistor 619 such that a time constant is obtained with which the capacitor 617 is sufficiently charged in a steady period of the bidirectional switching device 900. In the case where charging voltage of the capacitor 617 is equal to the Zener voltage of the Zener diode 620, charging current of the capacitor 617 flows through the Zener diode 620 and entirely becomes the loss. Accordingly, the loss increases if the resistance of the resistor 619 is too small. Accordingly, it is necessary to avoid making the resistance of the resistor 619 too small.

The same applies to the resistor 629 of the high-side circuit 691.

Resistor 641

The resistor 641 sets the gate voltage Vgs of the P-ch MOSFET 513 to a value close to the voltage at the source terminal S in the steady state in which the voltage Vs2*s*1 is constant so as to set the P-ch MOSFET 513 in the OFF state for sure. The resistor 641 is connected in parallel with the capacitor 514.

A terminal of the resistor 641 that is connected to the second source connection terminal 121 may be connected to the source terminal S of the P-ch MOSFET 513 or to the anode terminal a of the diode 618.

The resistor 641 has a role of discharging electric charge accumulated in the capacitor 514 when the voltage Vs2*s*1 changes. The time constant at the time of discharging is equal to a product of the resistance of the resistor 641 and the capacitance of the capacitor 514. The resistance of the resistor 641 may be set to a value for which this time constant is sufficiently longer than a period for which the voltage Vs2*s*1 changes. The capacitance of the capacitor 514 may be set such that a sufficiently long period in which the P-ch MOSFET 513 is kept in the ON state is ensured during the period in which the voltage Vs2*s*1 decreases.

The same applies to the resistor 651 of the high-side circuit 691.

The above description is regarding the operation and components of the low-side circuit 681. Since the high-side circuit 691 has substantially the same circuit configuration as the low-side circuit 681 except that connections to the first source connection terminal 111 and the second source connection terminal 121 are opposite and operates in substantially the same manner, a description thereof is omitted.

Practical Circuit Constants

The capacitors 514 and 524 may each have a capacitance that is greater than or equal to 100 pF and less than or equal to 10 nF, for example. The capacitors 617 and 627 may each have a capacitance that is greater than or equal to 100 nF and less than or equal to 10 μF. The resistors 619 and 629 may each have a resistance that is greater than or equal to 100Ω and less than or equal to 100 kΩ. The resistors 641 and 651 may each have a resistance that is greater than or equal to 10 kΩ and less than or equal to 1 MΩ.

Comparison of Substrate Voltage Control Circuits 500 and 600 with Substrate Voltage Control Circuit 300

In the substrate voltage control circuit 300 illustrated in FIG. 3, the gate terminals G of the N-ch MOSFETs 312 and 322 are driven via the resistors 313 and 323, respectively. The drive performance is successfully increased if small resistances are set for the resistors 313 and 323. However, when small resistances are set for the resistors 313 and 323, the loss increases in the substrate voltage control circuit 300. Accordingly, it is necessary to set large resistances for the resistors 313 and 323 in order to suppress the loss, and it is difficult to increase the drive performance.

In contrast, in the substrate voltage control circuits 500 and 600 respectively illustrated in FIGS. 10 and 11, the gate terminals G of the N-ch MOSFETs 312 and 322 are driven by the P-ch MOSFET 513 and 523, respectively. Accordingly, it is relatively easy to increase the drive performance in the substrate voltage control circuits 500 and 600. Thus, the substrate voltage control circuits 500 and 600 are capable of making the waveform of voltage Vsub at the substrate voltage control terminal 101 closer to the ideal waveform than the substrate voltage control circuit 300.

Circuit Simulation

Figure 12A:
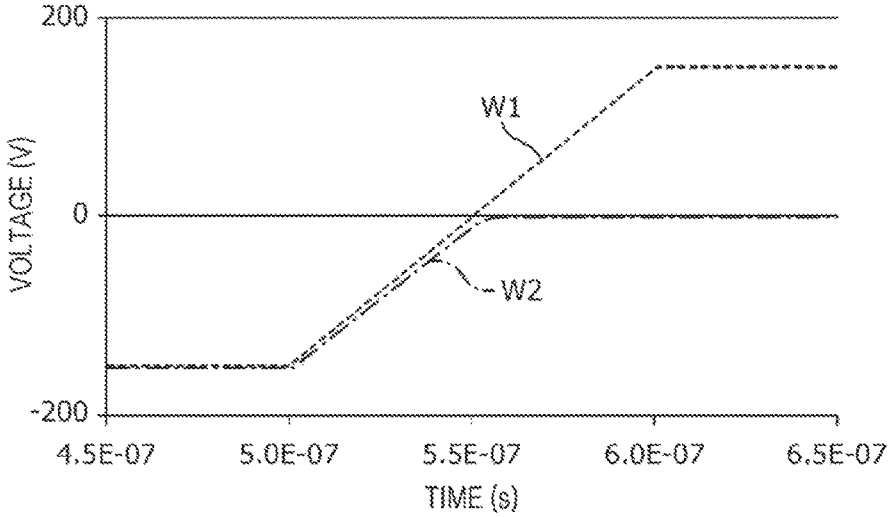
FIG. 12A is a waveform diagram illustrating a result of a circuit simulation in which the substrate voltage control circuit illustrated in FIG. 11 is used.
Figure 12B:
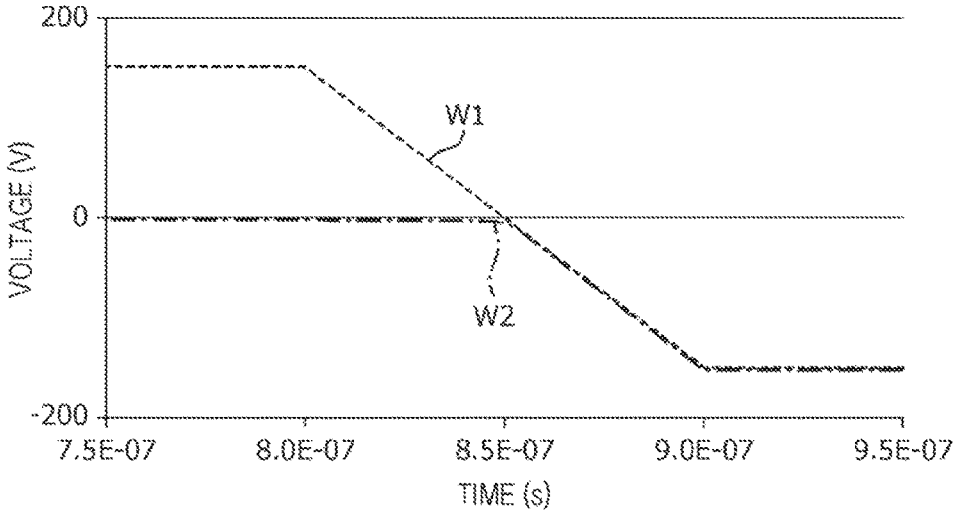
FIG. 12B is a waveform diagram illustrating the result of the circuit simulation in which the substrate voltage control circuit illustrated in FIG. 11 is used.

FIGS. 12A and 12B are waveform diagrams each illustrating a result of a circuit simulation performed by using the substrate voltage control circuit 600 illustrated in FIG. 11.

In this circuit simulation, the waveform of the voltage Vsub at the substrate voltage control terminal 101 is observed when voltage Vs2 at the second source connection terminal 121 is changed from −150 V to +150 V and is changed from +150 V to −150 V with voltage Vs1 at the first source connection terminal 111 being fixed at 0 V.

FIG. 12A illustrates a waveform of the voltage Vsub when the voltage Vs2 at the second source connection terminal 121 is changed from −150 V to +150 V, whereas FIG. 12B illustrates a waveform of the voltage Vsub when the voltage Vs2 at the second source connection terminal 121 is changed from +150 V to −150 V.

FIGS. 12A and 12B show two voltage waveforms W1 and W2. The voltage waveform W1 represents the waveform of the voltage Vs2*s*1, and the voltage waveform W2 represents the waveform of the voltage Vsub at the substrate voltage control terminal 101. In FIGS. 12A and 12B, a period for which the voltage waveform W1 is changed is 100 ns.

FIG. 12A indicates that the voltage waveform W2 immediately shows 0 V upon the voltage waveform W1 exceeding 0 V and successfully follows the voltage Vs1, which is the lower one of the voltages Vs1 and Vs2. In addition, FIG. 12B indicates that the voltage waveform W2 decreases in accordance with the voltage waveform W1 upon the voltage waveform W1 becoming lower than 0 V and successfully follows the voltage Vs2, which is the lower one of the voltages Vs1 and Vs2. As described above, the response achieved by the substrate voltage control circuit 600 shows a result closer to the voltage waveform illustrated in FIG. 2, compared with the comparative example.

Fifth Embodiment

Figure 13:
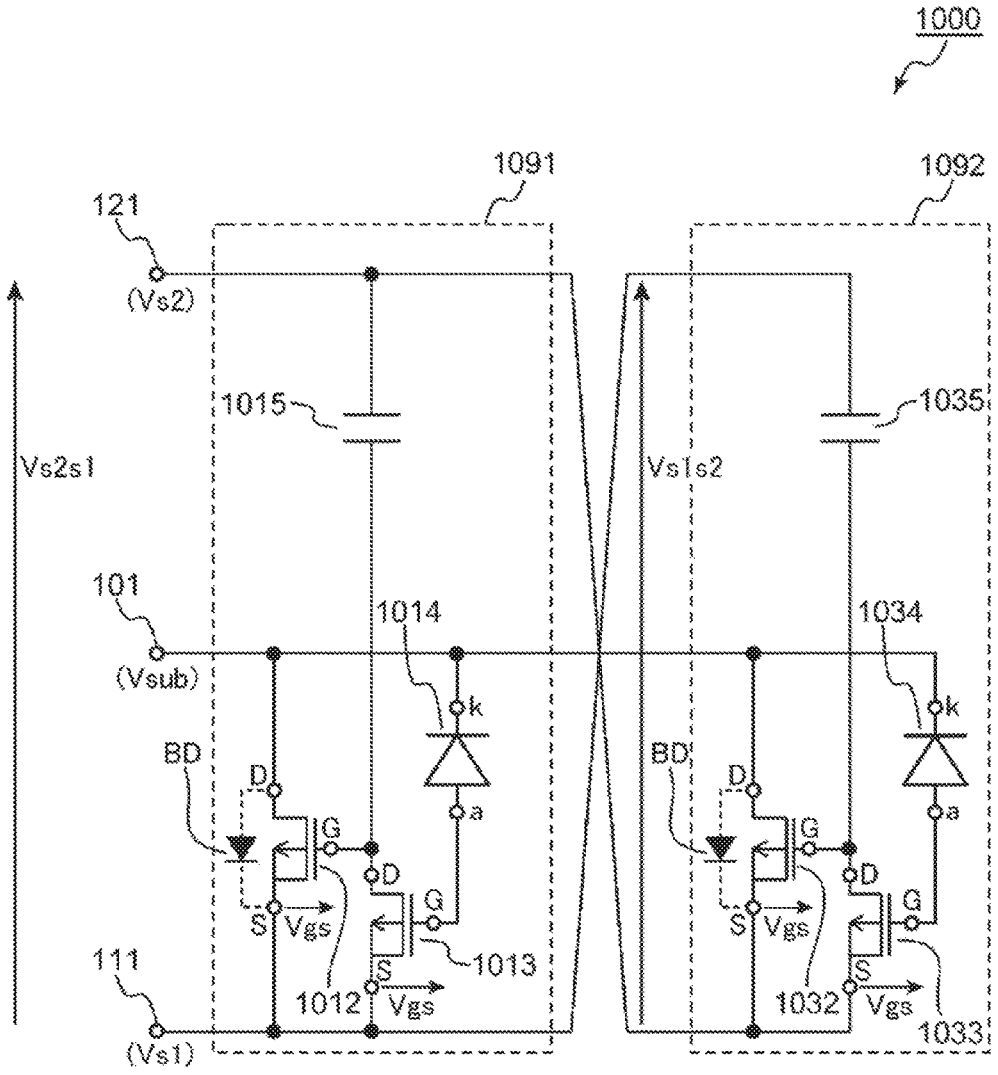
FIG. 13 is a diagram illustrating an example of a substrate voltage control circuit according to a fifth embodiment of the present disclosure.

FIG. 13 is a diagram illustrating an example of a substrate voltage control circuit 1000 according to a fifth embodiment of the present disclosure. The substrate voltage control circuit 1000 includes a first source connection terminal 111, a second source connection terminal 121, a substrate voltage control terminal 101, a low-side circuit 1091, and a high-side circuit 1092.

The first source connection terminal 111 is connected to the source terminal S1 of the bidirectional switching device 900. The second source connection terminal 121 is connected to the source terminal S2 of the bidirectional switching device 900. The substrate voltage control terminal 101 is connected to the substrate terminal SUB of the bidirectional switching device 900.

The low-side circuit 1091 is a circuit for applying voltage at the first source connection terminal 111 to the substrate voltage control terminal 101. The high-side circuit 1092 is a circuit for applying voltage at the second source connection terminal 121 to the substrate voltage control terminal 101.

The low-side circuit 1091 includes a P-ch MOSFET 1012 (an example of a low-side first switch), a P-ch MOSFET 1013 (an example of a low-side second switch), a diode 1014 (an example of a low-side diode), and a capacitor 1015 (an example of a low-side first capacitor).

The P-ch MOSFET 1012 is a P-type MOSFET that is used as the switch 112 illustrated in FIG. 1. The P-ch MOSFET 1012 includes a source terminal S (an example of a low-side-first-switch source terminal), a drain terminal D (an example of a low-side-first-switch drain terminal), and a gate terminal G (an example of a low-side-first-switch gate terminal).

The source terminal S of the P-ch MOSFET 1012 is connected to the first source connection terminal 111. The drain terminal D of the P-ch MOSFET 1012 is connected to the substrate voltage control terminal 101. The gate terminal G of the P-ch MOSFET 1012 is connected to a drain terminal D of the P-ch MOSFET 1013 (described later).

In the case where voltage at the gate terminal G of the P-ch MOSFET 1012 relative to voltage at the source terminal S of the P-ch MOSFET 1012 is gate voltage Vgs (an example of a low-side-first-switch gate voltage), when the gate voltage Vgs is lower than threshold voltage (hereinafter, referred to as threshold voltage Vth) of the P-ch MOSFET 1012, the P-ch MOSFET 1012 is in the ON state and short-circuits the source terminal S and the drain terminal D. On the other hand, when the gate voltage Vgs is higher than the threshold voltage Vth of the P-ch MOSFET 1012, the P-ch MOSFET 1012 is in the OFF state and causes the source terminal S and the drain terminal D to be open.

In addition, the P-ch MOSFET 1012 includes a body diode BD (an example of a low-side-first-switch body diode) therein. When voltage at the source terminal S of the P-ch MOSFET 1012 is lower than voltage at the drain terminal D of the P-ch MOSFET 1012, that is, when the voltage Vs1 at the first source connection terminal 111 is lower than the voltage Vsub at the substrate voltage control terminal 101, the P-ch MOSFET 1012 conducts current from the drain terminal D to the source terminal S via the body diode BD. Instead of this configuration, the P-ch MOSFET 1012 may be a device not including the body diode BD. For example, an anode terminal of an external diode may be connected to the substrate voltage control terminal 101, and the external diode may be connected in parallel with the P-ch MOSFET 1012.

The P-ch MOSFET 1013 is a P-type MOSFET for driving the gate terminal G of the P-ch MOSFET 1012. The P-ch MOSFET 1013 includes a source terminal S (an example of a low-side-second-switch source terminal), a drain terminal D (an example of a low-side-second-switch drain terminal), and a gate terminal G (an example of a low-side-second-switch gate terminal).

The source terminal S of the P-ch MOSFET 1013 is connected to the first source connection terminal 111. The drain terminal D of the P-ch MOSFET 1013 is connected to the gate terminal G of the P-ch MOSFET 1012. The gate terminal G of the P-ch MOSFET 1013 is connected to an anode terminal a of the diode 1014.

When the gate voltage Vgs of the P-ch MOSFET 1013 is lower than threshold voltage Vth of the P-ch MOSFET 1013, the P-ch MOSFET 1013 is in the ON state and short-circuits the source terminal S and the drain terminal D, just like the P-ch MOSFET 1012. In addition, when the gate voltage Vgs is higher than the threshold voltage Vth of the P-ch MOSFET 1013, the P-ch MOSFET 1013 is in the OFF state and causes the source terminal S and the drain terminal D to be open.

The diode 1014 is a diode for driving the gate terminal G of the P-ch MOSFET 1013. The diode 1014 includes an anode terminal a (an example of a low-side anode terminal)

and a cathode terminal k (an example of a low-side cathode terminal). The anode terminal a of the diode 1014 is connected to the gate terminal G of the P-ch MOSFET 1013. The cathode terminal k of the diode 1014 is connected to the substrate voltage control terminal 101. That is, the diode 1014 is connected between the substrate voltage control terminal 101 and the gate terminal G of the P-ch MOSFET 1013.

The capacitor 1015 is a capacitor for driving the gate terminal G of the P-ch MOSFET 1012. The capacitor 1015 is connected between the second source connection terminal 121 and the drain terminal D of the P-ch MOSFET 1013.

The high-side circuit 1092 includes a P-ch MOSFET 1032 (an example of a high-side first switch), a P-ch MOSFET 1033 (an example of a high-side second switch), a diode 1034 (an example of a high-side diode), and a capacitor 1035 (an example of a high-side first capacitor).

The P-ch MOSFET 1032 is a P-type MOSFET used as the switch 122 illustrated in FIG. 1. The P-ch MOSFET 1032 includes a source terminal S (an example of a high-side-first-switch source terminal), a drain terminal D (an example of a high-side-first-switch drain terminal), and a gate terminal G (an example of a high-side-first-switch gate terminal).

The source terminal S of the P-ch MOSFET 1032 is connected to the second source connection terminal 121. The drain terminal D of the P-ch MOSFET 1032 is connected to the substrate voltage control terminal 101. The gate terminal G of the P-ch MOSFET 1032 is connected to a drain terminal D of the P-ch MOSFET 1033 (described later), Suppose that voltage at the gate terminal G relative to voltage at the source terminal S is gate voltage Vgs (an example of a high-side-first-switch gate voltage). In this case, when the gate voltage Vgs of the P-ch MOSFET 1032 is lower than threshold voltage Vth of the P-ch MOSFET 1032, the P-ch MOSFET 1032 is in the ON state and short-circuits the source terminal S and the drain terminal D. On the other hand, when the gate voltage Vgs is higher than the threshold voltage Vth of the P-ch MOSFET 1032, the P-ch MOSFET 1032 is in the OFF state and causes the source terminal S and the drain terminal D to be open.

In addition, the P-ch MOSFET 1032 includes a body diode BD (an example of a high-side-first-switch body diode) therein. When voltage at the source terminal S of the P-ch MOSFET 1032 is lower than voltage at the drain terminal D of the P-ch MOSFET 1032, that is, when the voltage Vs2 at the second source connection terminal 121 is lower than the voltage Vsub at the substrate voltage control terminal 101, the P-ch MOSFET 1032 conducts current from the drain terminal D to the source terminal S via the body diode BD. Instead of this configuration, the P-ch MOSFET 1032 may be a device not including the body diode BD. In such a case, for example, an anode terminal of an external diode may be connected to the substrate voltage control terminal 101, and the external diode may be connected in parallel with the P-ch MOSFET 1032.

The P-ch MOSFET 1033 is a P-type MOSFET for driving the gate terminal G of the P-ch MOSFET 1032. The P-ch MOSFET 1033 includes a source terminal S (an example of a high-side-second-switch source terminal), a drain terminal D (an example of a high-side-second-switch drain terminal), and a gate terminal G (an example of a high-side-second-switch gate terminal).

The source terminal S of the P-ch MOSFET 1033 is connected to the second source connection terminal 121. The drain terminal D of the P-ch MOSFET 1033 is connected to the gate terminal G of the P-ch MOSFET 1032. The gate terminal G of the P-ch MOSFET 1033 is connected to an anode terminal a of the diode 1034.

When the gate voltage Vgs of the P-ch MOSFET 1033 is lower than threshold voltage Vth of the P-ch MOSFET 1033, the P-ch MOSFET 1033 is in the ON state and short-circuits the source terminal S and the drain terminal D, just like the P-ch MOSFET 1032. In addition, when the gate voltage Vgs is higher than the threshold voltage Vth of the P-ch MOSFET 1033, the P-ch MOSFET 1033 is in the OFF state and causes the source terminal S and the drain terminal D to be open.

The diode 1034 is a diode for driving the gate terminal G of the P-ch MOSFET 1033. The diode 1034 includes the anode terminal a (an example of a high-side anode terminal) and a cathode terminal k (an example of a high-side cathode terminal). The anode terminal a of the diode 1034 is connected to the gate terminal G of the P-ch MOSFET 1033. The cathode terminal k of the diode 1034 is connected to the substrate voltage control terminal 101. That is, the diode 1034 is connected between the substrate voltage control terminal 101 and the gate terminal G of the P-ch MOSFET 1033.

The capacitor 1035 is a capacitor for driving the gate terminal G of the P-ch MOSFET 1032. The capacitor 1035 is connected between the first source connection terminal 111 and the drain terminal D of the P-ch MOSFET 1033.

Operation of Low-Side Circuit 1091

Operation of the low-side circuit 1091 will be described next. When the voltage Vs2 at the second source connection terminal 121 is higher than the voltage Vs1 at the first connection terminal 111, the voltage Vs2*s*1 at the second source connection terminal 121 relative to the voltage Vs1 at the first source connection terminal 111 is positive.

In the case where the voltage Vs2*s*1 is positive, the voltage Vsub at the substrate voltage control terminal 101 is limited by the body diode BD of the P-ch MOSFET 1012 to be lower than or equal to a voltage obtained by adding threshold voltage (hereinafter, referred to as threshold voltage Vf) of the body diode BD to the voltage Vs1 at the first source connection terminal 111 in a steady state in which the voltage Vs2*s*1 is constant.

When the voltage Vs2*s*1 decreases in a positive voltage range, the voltage at the gate terminal G of the P-ch MOSFET 1012 decreases due to coupling caused by the capacitor 1015. If the gate voltage Vgs of the P-ch MOSFET 1012 consequently becomes lower than the threshold voltage Vth of the P-ch MOSFET 1012, the P-ch MOSFET 1012 is in the ON state and short-circuits the source terminal S and the drain terminal D of the P-ch MOSFET 1012. As a result of the source terminal S and the drain terminal D of the P-ch MOSFET 1012 being short-circuited, the voltage Vs1 at the first source connection terminal 111 is applied to the substrate voltage control terminal 101 via the P-ch MOSFET 1012. In this way, the voltage Vsub at the substrate voltage control terminal 101 becomes equal to the voltage Vs1. At that time, the P-ch MOSFET 1013 is in the OFF state because the voltage at the source terminal S and the voltage at the gate terminal G are equal.

As described above, when the voltage Vs2*s*1 decreases in the positive voltage range, the substrate voltage control circuit 1000 successfully sets the voltage Vsub at the substrate voltage control terminal 101 to the voltage Vs1 at the first source connection terminal 111 and successfully prevents the floating state of the voltage Vsub at the substrate voltage control terminal 101. As a result, the substrate voltage control circuit 1000 successfully controls the bidirectional switching device 900 to operate with stable switching characteristics and with a reduced switching-characteristics variance between two current-flow directions.

Suppose that the voltage Vs2 at the second source connection terminal 121 becomes lower than the voltage Vs1 at the first source connection terminal 111 and consequently the voltage Vs2*s*1 changes from a positive voltage to a negative voltage. In this case, since the voltage Vsub at the substrate voltage control terminal 101 becomes equal to the voltage Vs1 at the first source connection terminal 11 when the voltage Vs2*s*1 is positive, the voltage Vs2 at the second source connection terminal 121 is lower than the voltage Vsub at the substrate voltage control terminal 101. Accordingly, voltage at the source terminal S of the P-ch MOSFET 1032 connected to the second source connection terminal 121 is lower than voltage at the drain terminal D of the P-ch MOSFET 1032 connected to the substrate voltage control terminal 101.

Consequently, current flows from the drain terminal D to the source terminal S of the P-ch MOSFET 1032 via the body diode BD, and the voltage Vsub at the substrate voltage control terminal 101 is limited to be lower than or equal to a voltage obtained adding the threshold voltage Vf of the body diode BD to the voltage Vs2 at the second source connection terminal 121. As a result, the voltage Vsub at the substrate voltage control terminal 101 decreases as the voltage Vs2*s*1 decreases in the negative voltage range.

As described above, when the voltage Vs2*s*1 decreases in the negative voltage range, the substrate voltage control circuit 1000 successfully decreases the voltage Vsub at the substrate voltage control terminal 101 to follow the decreasing voltage Vs2*s*1.

When the voltage Vsub decreases in response to a decrease in the voltage Vs2*s*1, the diode 1014 is set to the ON state and the voltage at the gate terminal G of the P-ch MOSFET 1013 decreases in response to the decrease in the voltage Vsub. When the gate voltage Vgs of the P-ch MOSFET 1013 consequently becomes lower than the threshold voltage Vth of the P-ch MOSFET 1013, the P-ch MOSFET 1013 is in the ON state and short-circuits the source terminal S and the drain terminal D thereof. As a result, the gate terminal G of the P-ch MOSFET 1012 and the first source connection terminal 111 have an equal potential, and the P-ch MOSFET 1012 is set to the OFF state.

If the P-ch MOSFET 1012 is not set to the OFF state at that time, the first source connection terminal 111 and the second source connection terminal 121 may be short-circuited via the body diodes BD of the P-ch MOSFETs 1012 and 1032 and large current may flow. As a result, the low-side circuit 1091 may fail to operate normally, and the low-side circuit 1091 may be damaged depending on the situation.

However, the substrate voltage control circuit 1000 successfully sets the P-ch MOSFET 1012 to the OFF state for sure when the voltage Vs2*s*1 decreases in the negative voltage range.

Note that the cathode terminal k of the diode 1014 may be connected to the second source connection terminal 121 instead of being connected to the substrate voltage control terminal 101. With this configuration, when the voltage Vs2*s*1 decreases in the negative voltage range, the diode 1014 may be set to the ON state and then the P-ch MOSFET 1013 may be set to the ON state, whereby the P-ch MOSFET 1012 may be set to the OFF state.

The high-side circuit 1092 has substantially the same circuit configuration as the low-side circuit 1091 except that connections to the first source connection terminal 111 and the second source connection terminal 121 are opposite and operates in substantially the same manner.

Operation of High-Side Circuit 1092

Operation of the high-side circuit 1092 will be described briefly below. When the voltage Vs1 at the first source connection terminal 111 is higher than the voltage Vs2 at the second source connection terminal 121, voltage (hereinafter, referred to as voltage Vs1*s*2) at the first source connection terminal 111 relative to the voltage Vs2 at the second source connection terminal 121 is positive.

In the case where the voltage Vs1*s*2 is positive, the voltage Vsub is limited by the bode diode BD of the P-ch MOSFET 1032 to be lower than or equal to a voltage obtained by adding threshold voltage Vf of the body diode BD to the voltage Vs2 in a steady state in which the voltage Vs1*s*2 is constant.

When the voltage Vs1*s*2 decreases in a positive voltage range and consequently the gate voltage Vgs of the P-ch MOSFET 1032 decreases due to coupling caused by the capacitor 1035, the P-ch MOSFET 1032 is set to the ON state and the voltage Vs2 at the second source connection terminal 121 is applied to the substrate voltage control terminal 101. In this way, the voltage Vsub at the substrate voltage control terminal 101 becomes equal to the voltage Vs2, As described above, when the voltage Vs1*s*2 decreases in the positive voltage range (when the voltage Vs2*s*1 increases in the negative voltage range), the substrate voltage control circuit 1000 successfully sets the voltage Vsub to the voltage Vs2 and successfully prevents the floating state of the voltage Vsub, When the voltage Vs1*s*2 changes from a positive voltage to a negative voltage, current flows from the drain terminal D to the source terminal S of the P-ch MOSFET 1032 via the body diode BD. Consequently, the voltage Vsub is limited to be lower than or equal to a voltage obtained by adding the threshold voltage Vf of the body diode BD to the voltage Vs2. As a result, the voltage Vsub at the substrate voltage control terminal 101 decreases to follow the voltage Vs1*s*2 decreasing in the negative voltage range.

As described above, when the voltage Vs1*s*2 decreases in the negative voltage range, the substrate voltage control circuit 1000 successfully decreases the voltage Vsub at the substrate voltage control terminal 101 to follow the decrease in the voltage Vs1*s*2.

When the voltage Vsub decreases in response to a decrease in the voltage Vs1*s*2, the diode 1034 is set to the ON state, which consequently makes the gate voltage Vgs of the P-ch MOSFET 1033 lower than the threshold voltage Vth of the P-ch MOSFET 1033. As a result, the P-ch MOSFET 1033 is set to the ON state, and the gate terminal G of the P-ch MOSFET 1032 and the second source connection terminal 121 have an equal potential, and the P-ch MOSFET 1032 is set to the OFF state.

If the P-ch MOSFET 1032 is not set to the OFF state at that time, the first source connection terminal 111 and the second source connection terminal 121 may be short-circuited via the body diodes BD of the P-ch MOSFETs 1012 and 1032 and large current may flow. As a result, the high-side circuit 1092 may fail to operate normally, and the high-side circuit 1092 may be damaged depending on the situation.

However, the substrate voltage control circuit 1000 successfully sets the P-ch MOSFET 1032 to the OFF state for sure when the voltage Vs1*s*2 decreases in the negative voltage range.

Note that the cathode terminal k of the diode 1034 may be connected to the first source connection terminal 111 instead of being connected to the substrate voltage control terminal 101. With this configuration, when the voltage Vs1s2 decreases in the negative voltage range, the diode 1034 may be set to the ON state and then the P-ch MOSFET 1033 may be set to the ON state, whereby the P-ch MOSFET 1032 may be set to the OFF state.

Note that the switches are not limited to the P-ch MOSFET 1012, 1013, 1032, and 1033, and each of the P-ch MOSFET 1012, 1013, 1032, and 1033 may be replaced with a switching device, such as a P-type FET, an IGBT, or a BJT. In such a case, when devices that replace the P-ch MOSFETs 1012 and 1032 do not include a body diode therein, an anode terminal of an external diode may be connected to the substrate voltage control terminal 101, and the external diode may be connected in parallel with the device.

Figure 14:
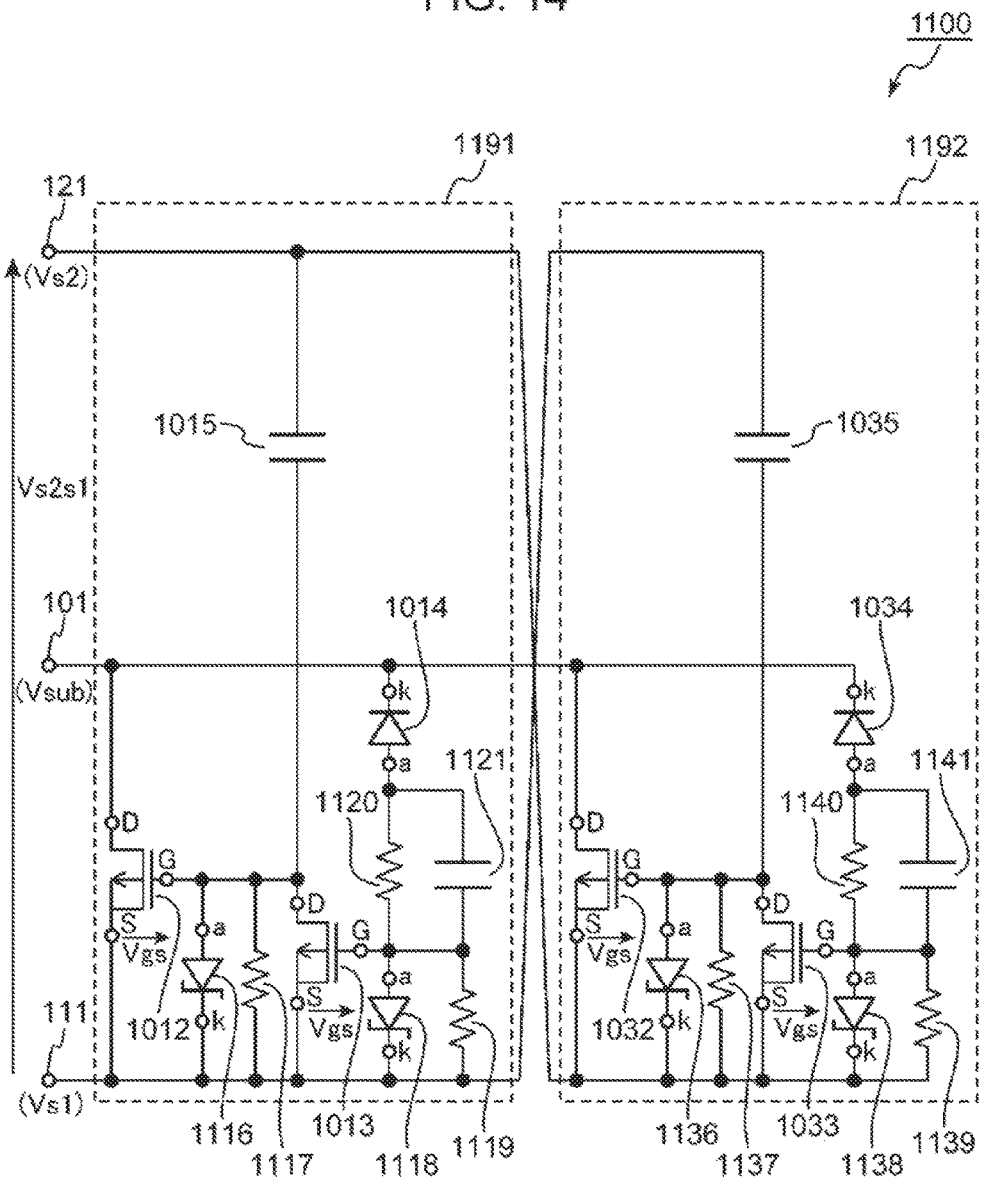
FIG. 14 is a diagram illustrating an example of a refined substrate voltage control circuit of the substrate voltage control circuit according to the fifth embodiment of the present disclosure.

The substrate voltage control circuit 1000 according to the fifth embodiment illustrated in FIG. 13 is configured by using the minimum number of components in order to describe the operation principle. Accordingly, a practical circuit needs refinements, such as protection circuits for the individual gate terminals G and a configuration for sufficiently improving the performance. A practical substrate voltage control circuit 1100 obtained by refining the substrate voltage control circuit 1000 will be described below with reference to FIG. 14 as an example. FIG. 14 is a diagram illustrating an example of the substrate voltage control circuit 1100 obtained by refining the substrate voltage control circuit 1000 according to the fifth embodiment of the present disclosure.

As illustrated in FIG. 14, the substrate voltage control circuit 1100 includes a low-side circuit 1191 and a high-side circuit 1192. The low-side circuit 1191 includes Zener diodes 1116 and 1118, resistors 1117, 1119, and 1120, and a capacitor 1121 in addition to the components of the low-side circuit 1091 illustrated in FIG. 13. The high-side circuit 1192 includes Zener diodes 1136 and 1138, resisters 1137, 1139, and 1140, and a capacitor 1141 in addition to the components of the high-side circuit 1092 illustrated in FIG. 13.

Since the basic circuit configuration and operation of the substrate voltage control circuit 1100 illustrated in FIG. 14 are substantially the same as those of the substrate voltage control circuit 1000 described above, a description thereof is omitted. Roles of components that are not included in the substrate voltage control circuit 1000 and are additionally included in the substrate voltage control circuit 1100 will be described.

Roles of components additionally included in the low-side circuit 1191 will be described below.

An anode terminal a of the Zener diode 1116 is connected to the gate terminal G of the P-ch MOSFET 1012, and a cathode terminal k of the Zener diode 1116 is connected to the first source connection terminal 111. With this configuration, the Zener diode 1116 prevents the gate terminal G of the P-ch MOSFET 1012 from being damaged by overvoltage.

An anode terminal a of the Zener diode 1118 is connected to the gate terminal G of the P-ch MOSFET 1013, and a cathode terminal k of the Zener diode 1118 is connected to the first source connection terminal 111. With this configuration, the Zener diode 1118 prevents the gate terminal G of the P-ch MOSFET 1013 from being damaged by overvoltage.

The resistor 1117 (an example of a low-side first resistor) is connected between the gate terminal G of the P-ch MOSFET 1012 and the first source connection terminal 111. With this configuration, the resistor 1117 fixes the gate voltage Vgs of the P-ch MOSFET 1012 at 0 V and keeps the P-ch MOSFET 1012 in the OFF state for sure in a period of the steady state in which the voltage Vs2s1 is constant.

The resistor 1119 (an example of a low-side second resistor) is connected between the gate terminal G of the P-ch MOSFET 1013 and the first source connection terminal 111. With this configuration, the resistor 1119 fixes the gate voltage Vgs of the P-ch MOSFET 1013 at 0 V and keeps the P-ch MOSFET 1013 in the OFF state for sure in a period of the steady state in which the voltage Vs2s1 is constant.

The resistor 1120 (an example of a low-side third resistor) is connected between the anode terminal a of the diode 1014 and the gate terminal G of the P-ch MOSFET 1013. With this configuration, the resistor 1120 limits an amount of current that flows when the diode 1014 is in the ON state.

The capacitor 1121 (an example of a low-side third capacitor) is connected between the anode terminal a of the diode 1014 and the gate terminal G of the P-ch MOSFET 1013. With this configuration, the capacitor 1121 immediately decreases the gate voltage Vgs of the P-ch MOSFET 1013 and sets the P-ch MOSFET 1013 to the ON state upon the voltage Vsub at the substrate voltage control terminal 101 starting to decrease.

Roles of components additionally included in the high-side circuit 1192 will be described next.

An anode terminal a of the Zener diode 1136 is connected to the gate terminal G of the P-ch MOSFET 1032, and a cathode terminal k of the Zener diode 1136 is connected to the second source connection terminal 121. With this configuration, the Zener diode 1136 prevents the gate terminal G of the P-ch MOSFET 1032 from being damaged by overvoltage.

An anode terminal a of the Zener diode 1138 is connected to the gate terminal G of the P-ch MOSFET 1033, and a cathode terminal k of the Zener diode 1138 is connected to the second source connection terminal 121. With this configuration, the Zener diode 1138 prevents the gate terminal G of the P-ch MOSFET 1033 from being damaged by overvoltage, The resistor 1137 (an example of a high-side first resistor) is connected between the gate terminal G of the P-ch MOSFET 1032 and the second source connection terminal 121. With this configuration, the resistor 1137 fixes the gate voltage Vgs of the P-ch MOSFET 1032 at 0 V and keeps the P-ch MOSFET 1032 in the OFF state for sure in a period of the steady state in which the voltage Vs2s1 is constant.

The resistor 1139 (an example of a high-side second resistor) is connected between the gate terminal G of the P-ch MOSFET 1033 and the second source connection terminal 121. In this way, the resistor 1139 fixes the gate voltage Vgs of the P-ch MOSFET 1033 at 0 V and keeps the P-ch MOSFET 1033 in the OFF state for sure in a period of the steady state in which the voltage Vs2s1 is constant.

The resistor 1140 (an example of a high-side third resistor) is connected between the anode terminal a of the diode 1034 and the gate terminal G of the P-ch MOSFET 1033. With this configuration, the resistor 1140 limits an amount of current that flows when the diode 1034 is in the ON state.

The capacitor 1141 (an example of a high-side third capacitor) is connected between the anode terminal a of the diode 1034 and the gate terminal G of the P-ch MOSFET 1033. With this configuration, the capacitor 1141 immediately decreases the voltage at the gate terminal G of the P-ch MOSFET 1033 and sets the P-ch MOSFET 1033 to the ON state upon the voltage Vsub at the substrate voltage control terminal 101 starting to decrease.

Note that the capacitors 1015 and 1035 may each have a capacitance in a range from 0.1 nF to 100 nF, for example. The capacitors 1121 and 1141 may each have a capacitance in a range from 0.05 nF to 50 nF, for example. The resistors 1117, 1119, 1120, 1137, 1139, and 1140 may each have a resistance in a range from 10 kΩ to 1 MΩ, for example.

Simulation

A result of a circuit simulation performed by using the substrate voltage control circuit 1100 illustrated in FIG. 14 will be described next.

In this circuit simulation, the waveform of the voltage Vsub is observed when voltage Vs2 is changed from −150 V to +150 V and is changed from +150 V to −150 V with voltage Vs1 being fixed at 0 V. In this circuit simulation, a period for which the voltage Vs2*s*1 is changed is 100 ns.

Figure 15A:
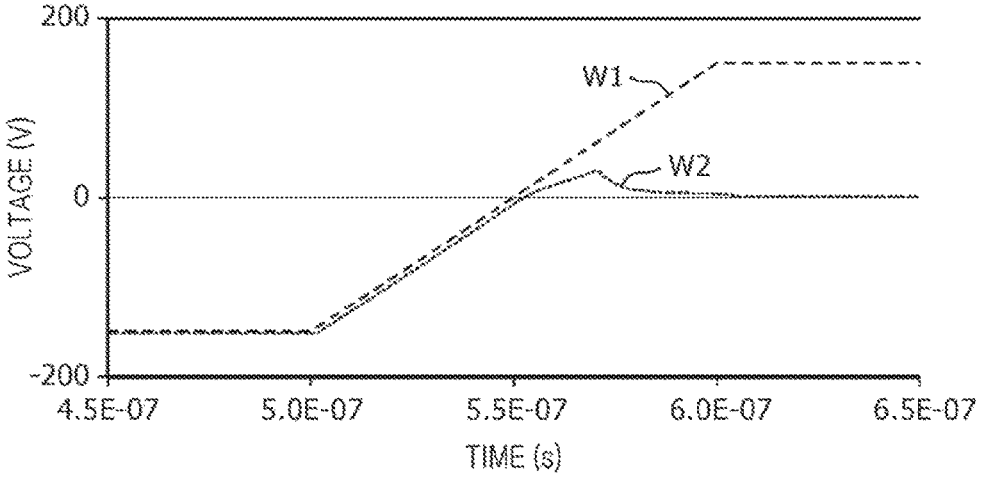
FIG. 15A is a waveform diagram illustrating a result of a circuit simulation in which the substrate voltage control circuit illustrated in FIG. 14 is used.
Figure 15B:
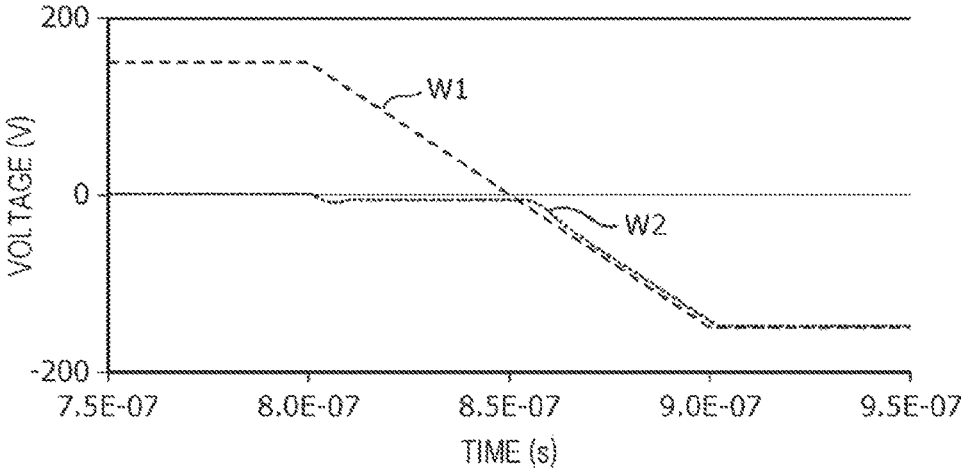
FIG. 15B is a waveform diagram illustrating the result of the circuit simulation in which the substrate voltage control circuit illustrated in FIG. 14 is used.

FIGS. 15A and 15B are waveform diagrams each illustrating the result of the circuit simulation in which the substrate voltage control circuit 1100 illustrated in FIG. 14 is used. FIG. 15A illustrates a waveform of the voltage Vsub when the voltage Vs2*s*1 is changed from a negative voltage to a positive voltage, whereas FIG. 15B illustrates a waveform of the voltage Vsub when the voltage Vs2*s*1 is changed from a positive voltage to a negative voltage. FIGS. 15A and 15B show two voltage waveforms W1 and W2. The voltage waveform W1 represents the waveform of the voltage Vs2*s*1, and the voltage waveform W2 represents the waveform of the voltage Vsub.

As illustrated in FIG. 15A, when the voltage Vs2*s*1 increases from a negative voltage to 0 V, the voltage waveform W2 increases along with the increasing voltage waveform W1. This indicates that the response of the voltage Vsub to the voltage Vs2, which is the lower one of the voltages Vs1 and Vs2, is very good. The voltage waveform W2 increases to show voltage lower than the voltage waveform W1 for some time from when the voltage Vs2*s*1 has exceeded 0 V. This indicates that the response of the voltage Vsub to the voltage Vs1 (0 V), which is the lower one of the voltages Vs1 and Vs2, is not so good. When the voltage Vs2*s*1 further increases after the some time has passed, the voltage waveform W2 shows substantially 0 V. This indicates that the response of the voltage Vsub to the voltage Vs1 (0 V), which is the lower one of the voltages Vs1 and Vs2, is very good.

On the other hand, as illustrated in FIG. 15B, when the voltage Vs2*s*1 decreases from a positive voltage to 0 V, the voltage waveform W2 shows substantially 0 V. This indicates that the response of the voltage Vsub to the voltage Vs1 (0 V), which is the lower one of the voltages Vs1 and Vs2, is very good. In addition, when the voltage Vs2*s*1 decreases from 0 V to a negative voltage, the voltage waveform W2 decreases together with the voltage waveform W1. This indicates that the response of the voltage Vsub to the voltage Vs2, which is the lower one of the voltages Vs1 and Vs2, is very good.

As described above, the circuit simulation indicates that the substrate voltage control circuit 1100 successfully makes the voltage waveform W2 of the voltage Vsub closer to the ideal substrate terminal voltage waveform 221 illustrated in FIG. 2.

Sixth Embodiment

Figure 16:
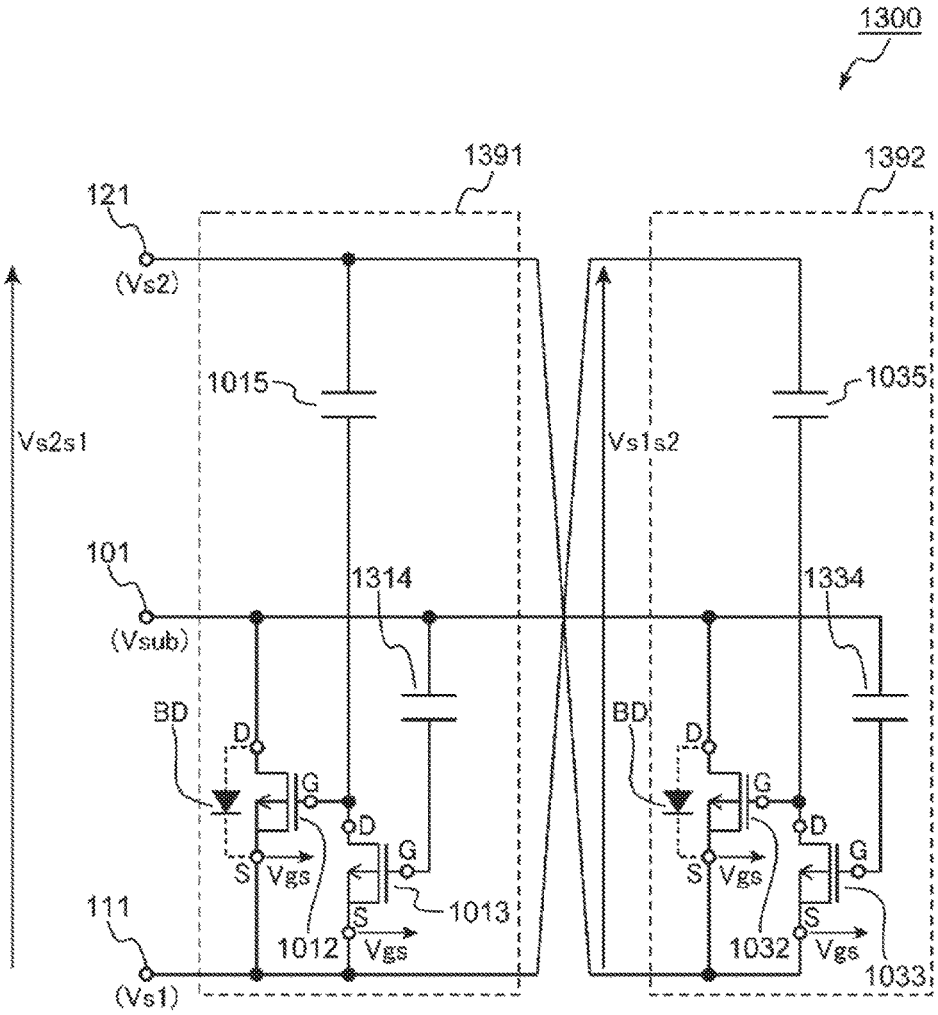
FIG. 16 is a diagram illustrating an example of a substrate voltage control circuit according to a sixth embodiment of the present disclosure.

FIG. 16 is a diagram illustrating an example of a substrate voltage control circuit 1300 according to a sixth embodiment of the present disclosure. Hereinafter, each component denoted by the same reference sign used for the component described in the fifth embodiment indicates the same component described in the fifth embodiment, and a description thereof is omitted appropriately.

The substrate voltage control circuit 1300 includes the first source connection terminal 111, the second source connection terminal 121, and the substrate voltage control terminal 101 that have been described in the fifth embodiment and a low-side circuit 1391 and a high-side circuit 1392.

The low-side circuit 1391 is a circuit for applying voltage at the first source connection terminal 111 to the substrate voltage control terminal 101. The high-side circuit 1392 is a circuit for applying voltage at the second source connection terminal 121 to the substrate voltage control terminal 101.

The low-side circuit 1391 includes the P-ch MOSFET 1012, the P-ch MOSFET 1013, and the capacitor 1015 that have been described in the fifth embodiment and a capacitor 1314 (an example of a low-side second capacitor).

The capacitor 1314 is a capacitor for driving the gate terminal G of the P-ch MOSFET 1013. The capacitor 1314 is connected between the substrate voltage control terminal 101 and the gate terminal G of the P-ch MOSFET 1013.

The high-side circuit 1392 includes the P-ch MOSFET 1032, the P-ch MOSFET 1033, and the capacitor 1035 that have been described in the fifth embodiment and a capacitor 1334 (an example of a high-side second capacitor).

The capacitor 1334 is a capacitor for driving the gate terminal G of the P-ch MOSFET 1033. The capacitor 1334 is connected between the substrate voltage control terminal 101 and the gate terminal G of the P-ch MOSFET 1033.

That is, the substrate voltage control circuit 1300 employs the capacitors 1314 and 1334 in place of the diodes 1014 and 1034 of the substrate voltage control circuit 1000 illustrated in FIG. 13, respectively.

Operation of Low-Side Circuit 1391

Operation of the low-side circuit 1391 will be described next. When the voltage Vs2*s*1 is in a steady state in which the voltage Vs2*s*1 is a positive constant voltage, the voltage Vsub at the substrate voltage control terminal 101 is limited by the body diode BD of the P-ch MOSFET 1012 to be lower than or equal to a voltage obtained by adding threshold voltage Vf of the body diode BD to the voltage Vs1 at the first source connection terminal 111.

When the voltage Vs2*s*1 decreases in a positive voltage range, the voltage at the gate terminal G of the P-ch MOSFET 1012 decreases due to coupling caused by the capacitor 1015. When the gate voltage Vgs of the P-ch MOSFET 1012 consequently becomes lower than threshold voltage Vth of the P-ch MOSFET 1012, the P-ch MOSFET 1012 is set to the ON state and short-circuits the source terminal S and the drain terminal D of the P-ch MOSFET 1012. When the source terminal S and the drain terminal D of the P-ch MOSFET 1012 are short-circuited, the voltage Vs1 at the first source connection terminal 111 is applied to the substrate voltage control terminal 101 via the P-ch MOSFET 1012. Consequently, the voltage Vsub at the substrate voltage control terminal 101 becomes equal to the voltage Vs1. At that time, the P-ch MOSFET 1013 is in the OFF state because the voltage at the source terminal S and the voltage at the gate terminal G are equal.

As described above, when the voltage Vs2*s*1 decreases in the positive voltage range, the substrate voltage control circuit 1300 sets the voltage Vsub at the substrate voltage control terminal 101 to the voltage Vs1 at the first source connection terminal 111 and successfully prevents the floating state of the voltage Vsub at the substrate voltage control terminal 101. As a result, the substrate voltage control circuit 1300 successfully controls the bidirectional switching device 900 to operate with stable switching characteristics and with a reduced switching-characteristics variance between two current-flow directions.

Suppose that the voltage Vs2 at the second source connection terminal 121 becomes lower than the voltage Vs1 at the first source connection terminal 111 and consequently the voltage Vs2*s*1 changes from a positive voltage to a negative voltage. In this case, since the voltage Vsub at the substrate voltage control terminal 101 becomes equal to the voltage Vs1 at the first source connection terminal 111 when the voltage Vs2*s*1 is positive, the voltage Vs2 at the second source connection terminal 121 is lower than the voltage Vsub at the substrate voltage control terminal 101. Accordingly, the voltage at the source terminal S of the P-ch MOSFET 1032 connected to the second source connection terminal 121 is lower than the voltage at the drain terminal D of the P-ch MOSFET 1032 connected to the substrate voltage control terminal 101.

Consequently, current flows from the drain terminal D to the source terminal S of the P-ch MOSFET 1032 via the body diode BD and the voltage Vsub at the substrate voltage control terminal 101 is limited to be lower than or equal to a voltage obtained by adding the threshold voltage Vf of the body diode BD to the voltage Vs2 at the second source connection terminal 121. As a result, the voltage Vsub at the substrate voltage control terminal 101 decreases to follow the voltage Vs2*s*1 decreasing in the negative voltage range.

As described above, when the voltage Vs2*s*1 decreases in a negative voltage range, the substrate voltage control circuit 1300 successfully decreases the voltage Vsub at the substrate voltage control terminal 101 to follow a decrease in the voltage Vs2*s*1.

As a result of the voltage Vsub decreasing to follow the decrease in the voltage Vs2*s*1, the voltage at the gate terminal G of the P-ch MOSFET 1013 decreases to follow the decrease in the voltage Vsub due to coupling caused by the capacitor 1314. When the gate voltage Vgs of the P-ch MOSFET 1013 consequently becomes lower than threshold voltage Vth of the P-ch MOSFET 1013, the P-ch MOSFET 1013 is in the ON state and short-circuits the source terminal S and the drain terminal D of the P-ch MOSFET 1013. As a result, the gate terminal G of the P-ch MOSFET 1012 and the first source connection terminal 111 have an equal potential, and the P-ch MOSFET 1012 is set to the OFF state.

If the P-ch MOSFET 1012 is not set to the OFF state at this time, the first source connection terminal 111 and the second source connection terminal 121 are short-circuited via the body diodes BD of the P-ch MOSFET 1012 and the P-ch MOSFET 1032 and large current may flow. As a result, the low-side circuit 1391 may fail to operate normally, and the low-side circuit 1391 may be damaged depending on the situation.

However, the substrate voltage control circuit 1300 successfully sets the P-ch MOSFET 1012 to the OFF state for sure when the voltage Vs2*s*1 decreases in the negative voltage range.

Note that the capacitor 1314 may be connected between the second source connection terminal 121 and the gate terminal G of the P-ch MOSFET 1013 instead of being connected to the substrate voltage control terminal 101. With this configuration, when the voltage Vs2*s*1 decreases in the negative voltage range, the P-ch MOSFET 1013 may be set to the ON state by coupling caused by the capacitor 1314, whereby the P-ch MOSFET 1012 may be set to the OFF state.

The high-side circuit 1392 has substantially the same circuit configuration as the low-side circuit 1391 except that connections to the first source connection terminal 111 and the second source connection terminal 121 are opposite and operates in substantially the same manner, Operation of High-Side Circuit 1392

Operation of the high-side circuit 1392 will be described briefly below When the voltage Vs1*s*2 is in a steady state in which the voltage Vs1*s*2 is a positive constant voltage, the voltage Vsub is limited by the body diode BD of the P-ch MOSFET 1032 to be lower than or equal to a voltage obtained by adding threshold voltage Vf of the body diode BD to the voltage Vs2.

When the voltage Vs1*s*2 decreases in a positive voltage range and the gate voltage Vgs of the P-ch MOSFET 1032 decreases due to coupling caused by the capacitor 1035, the P-ch MOSFET 1032 is set to the ON state and the voltage Vs2 at the second source connection terminal 121 is applied to the substrate voltage control terminal 101. Consequently, the voltage Vsub at the substrate voltage control terminal 101 becomes equal to the voltage Vs2.

As described above, when the voltage Vs1*s*2 decreases in the positive voltage range (when the voltage Vs2*s*1 increases in the negative voltage range), the substrate voltage control circuit 1300 successfully sets the voltage Vsub to the voltage Vs2 and prevents the flowing state of the substrate Vsub.

When the voltage Vs1*s*2 changes from a positive voltage to a negative voltage, current flows from the drain terminal D to the source terminal S of the P-ch MOSFET 1032 via the body diode BD. Accordingly, the voltage Vsub is limited to be lower than or equal to a voltage obtained by adding threshold voltage Vf of the body diode BD to the voltage Vs2. As a result, the voltage Vsub at the substrate voltage control terminal 101 decreases to follow the voltage Vs1*s*2 decreasing in the negative voltage range.

As described above, when the voltage Vs1*s*2 decreases in the negative voltage range, the substrate voltage control circuit 1300 successfully decreases the voltage Vsub at the substrate voltage control terminal 101 to follow a decrease in the voltage Vs1*s*2.

As a result of the voltage Vsub decreasing to follow the decrease in the voltage Vs1*s*2, the gate voltage Vgs of the P-ch MOSFET 1033 becomes lower than the threshold voltage Vth due to coupling caused by the capacitor 1334 and the P-ch MOSFET 1033 is set to the ON state. As a result, the gate terminal G of the P-ch MOSFET 1032 and the second source connection terminal 121 have an equal potential, and the P-ch MOSFET 1032 is set to the OFF state.

If the P-ch MOSFET 1032 is not set to the OFF state at this time, the first source connection terminal 111 and the second source connection terminal 121 may be short-circuited via the body diodes BD of the P-ch MOSFET 1012 and the P-ch MOSFET 1032 and large current may flow. As a result, the high-side circuit 1392 may fail to operate normally, and the high-side circuit 1392 may be damaged depending on the situation.

However, the substrate voltage control circuit 1300 successfully sets the P-ch MOSFET 1032 to the OFF state for sure when the voltage Vs1*s*2 decreases in the negative voltage range.

Note that the capacitor 1334 may be connected between the second source connection terminal 121 and the gate terminal G of the P-ch MOSFET 1033 instead of being connected to the substrate voltage control terminal 101. With this configuration, when the voltage Vs1*s*2 decreases in the negative voltage range, the P-ch MOSFET 1033 may be set to the ON state by coupling caused by the capacitor 1334, whereby P-ch MOSFET 1032 may be set to the OFF state.

Figure 17:
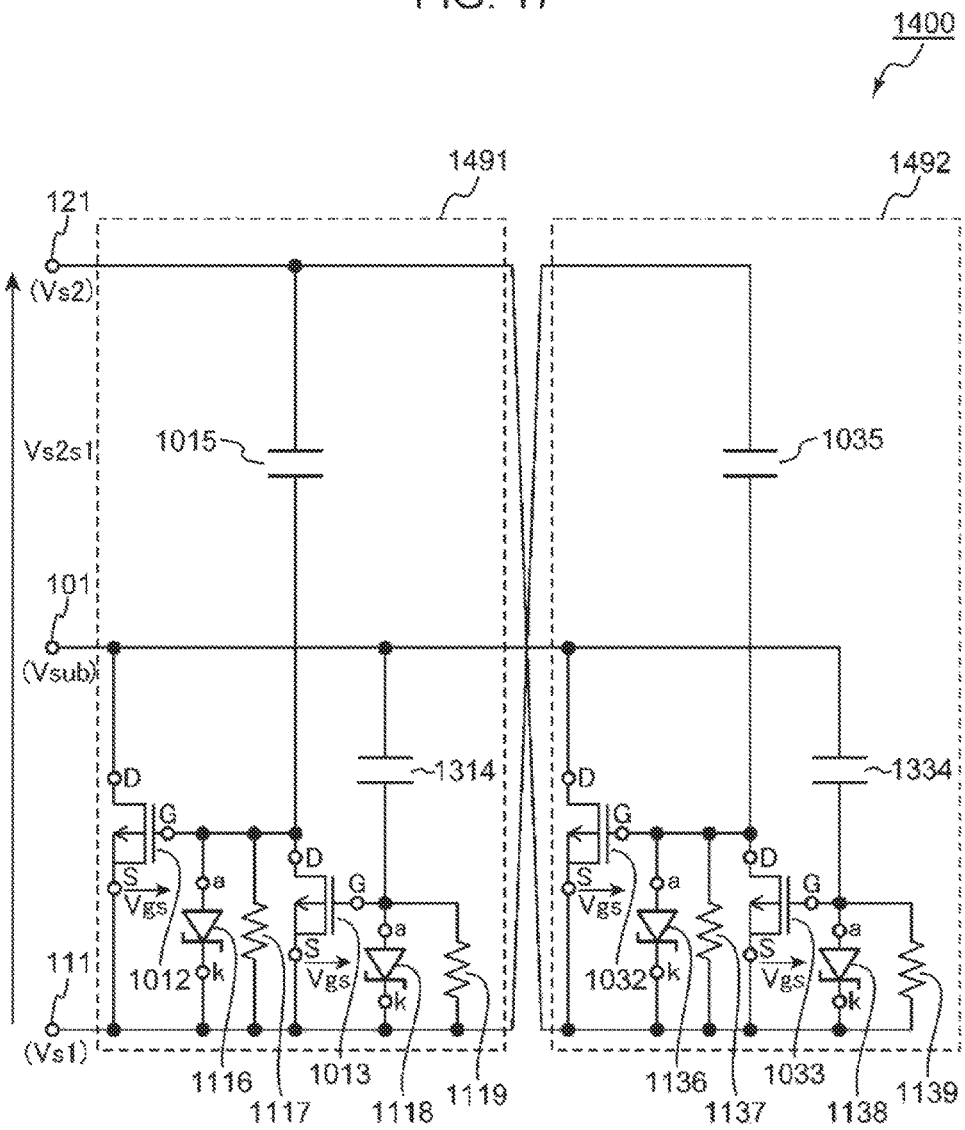
FIG. 17 is a diagram illustrating an example of a refined substrate voltage control circuit of the substrate voltage control circuit according to the sixth embodiment of the present disclosure.

The substrate voltage control circuit 1300 according to the sixth embodiment illustrated in FIG. 16 is configured by using the minimum number of components in order to describe the operation principle. Accordingly, a practical circuit needs refinements, such as protection circuits for the individual gate terminals G and a configuration for sufficiently improving the performance. A practical substrate voltage control circuit 1400 obtained by refining the substrate voltage control circuit 1300 will be described below with reference to FIG. 17 as an example. FIG. 17 is a diagram illustrating an example of the substrate voltage control circuit 1400 obtained by refining the substrate voltage control circuit 1300 according to the sixth embodiment of the present disclosure.

As illustrated in FIG. 17, the substrate voltage control circuit 1400 includes a low-side circuit 1491 and a high-side circuit 1492. The low-side circuit 1491 includes Zener diodes 1116 and 1118 and resistors 1117 and 1119 in addition to the components of the low-side circuit 1391 illustrated in FIG. 16. The high-side circuit 1392 includes Zener diodes 1136 and 1138 and resisters 1137 and 1139 in addition to the components of the high-side circuit 1392 illustrated in FIG. 16.

Since the basic circuit configuration and operation of the substrate voltage control circuit 1400 illustrated in FIG. 17 are substantially the same as those of the substrate voltage control circuit 1300 described above, a description thereof is omitted. In addition, since the components 1116 to 1119 and 1136 to 1139 that are not included in the substrate voltage control circuit 1300 and are additionally included in the substrate voltage control circuit 1400 are the same as the components 1116 to 1119 and 1136 to 1139 that are not included in the substrate voltage control circuit 1000 and are additionally included in the substrate voltage control circuit 1100, a description thereof is omitted.

Note that the capacitors 1015 and 1035 may each have a capacitance in a range from 0.1 nF to 10 nF, for example. The capacitors 1314 and 1334 may each have a capacitance in a range from 0.05 nF to 5 nF, for example. The resistors 1117, 1119, 1137 and 1139 may each have a resistance in a range from 100 kΩ to 1 MΩ, for example.

Simulation

A result of a circuit simulation performed by using the substrate voltage control circuit 1400 illustrated in FIG. 17 will be described next.

In this circuit simulation, the waveform of the voltage Vsub is observed when voltage Vs2 is changed from −150 V to +150 V and is changed from +150 V to −150 V with voltage Vs1 being fixed at 0 V. In this circuit simulation, a period for which the voltage Vs2*s*1 is changed is 100 ns.

Figure 18A:
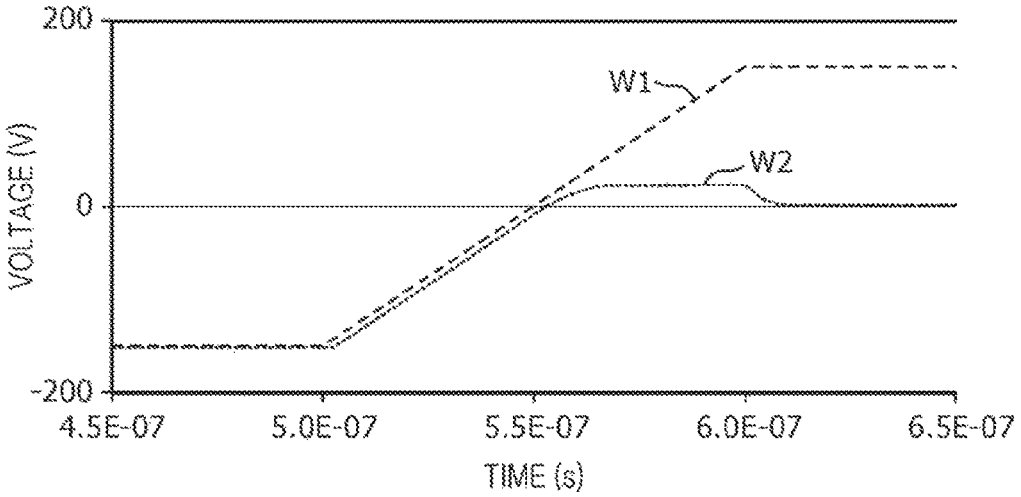
FIG. 18A is a waveform diagram illustrating a result of a circuit simulation in which the substrate voltage control circuit illustrated in FIG. 17 is used.
Figure 18B:
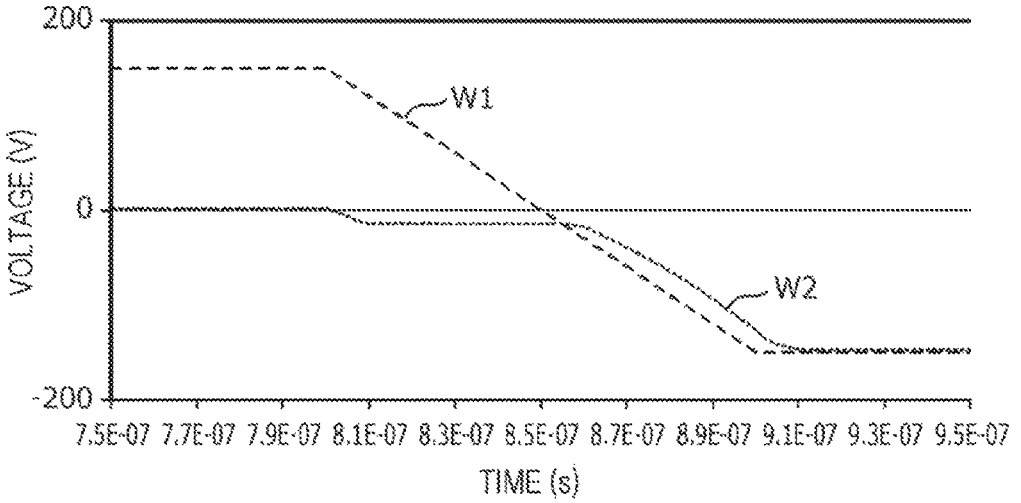
FIG. 18B is a waveform diagram illustrating the result of the circuit simulation in which the substrate voltage control circuit illustrated in FIG. 17 is used.

FIGS. 18A and 18B are waveform diagrams each illustrating the result of the circuit simulation in which the substrate voltage control circuit 1400 illustrated in FIG. 17 is used. FIG. 18A illustrates a waveform of the voltage Vsub when the voltage Vs2*s*1 is changed from a negative voltage to a positive voltage, whereas FIG. 18B illustrates a waveform of the voltage Vsub when the voltage Vs2*s*1 is changed from a positive voltage to a negative voltage. FIGS. 18A and 18B show two voltage waveforms W1 and W2. The voltage waveform W1 represents the waveform of the voltage Vs2*s*1, and the voltage waveform W2 represents the waveform of the voltage Vsub.

As illustrated in FIG. 18A, when the voltage Vs2*s*1 increases from a negative voltage to 0 V, the voltage waveform W2 increases along with the increasing voltage waveform W1. This indicates that the response of the voltage Vsub to the voltage Vs2, which is the lower one of the voltages Vs1 and Vs2, is very good. The voltage waveform W2 shows a substantially constant voltage that is lower than the voltage waveform W1 for some time from when the voltage Vs2*s*1 has exceeded 0 V. This indicates that the response of the voltage Vsub to the voltage Vs1 (0 V), which is the lower one of the voltages Vs1 and Vs2, is not so good. When the voltage Vs2*s*1 becomes constant after the some time has passed, the voltage waveform W2 shows substantially 0 V. This indicates that the response of the voltage Vsub to the voltage Vs1 (0 V), which is the lower one of the voltages Vs1 and Vs2, is very good.

On the other hand, as illustrated in FIG. 18B, when the voltage Vs2*s*1 decreases from a positive voltage to 0 V, the voltage waveform W2 shows a constant voltage that is slightly lower than 0 V. This indicates that the response of the voltage Vsub to the voltage Vs1 (0 V), which is the lower one of the voltages Vs1 and Vs2, is good. In addition, when the voltage Vs2*s*1 decreases from 0 V to a negative voltage, the voltage waveform W2 decreases together with the voltage waveform W1 while having a slightly higher voltage than the voltage waveform W1. This indicates that the response of the voltage Vsub to the voltage Vs2, which is the lower one of the voltages Vs1 and Vs2, is good.

As described above, the circuit simulation indicates that the substrate voltage control circuit 1400 successfully makes the voltage waveform W2 of the voltage Vsub closer to the ideal substrate terminal voltage waveform 221 illustrated in FIG. 2.

Seventh Embodiment

Figure 19:
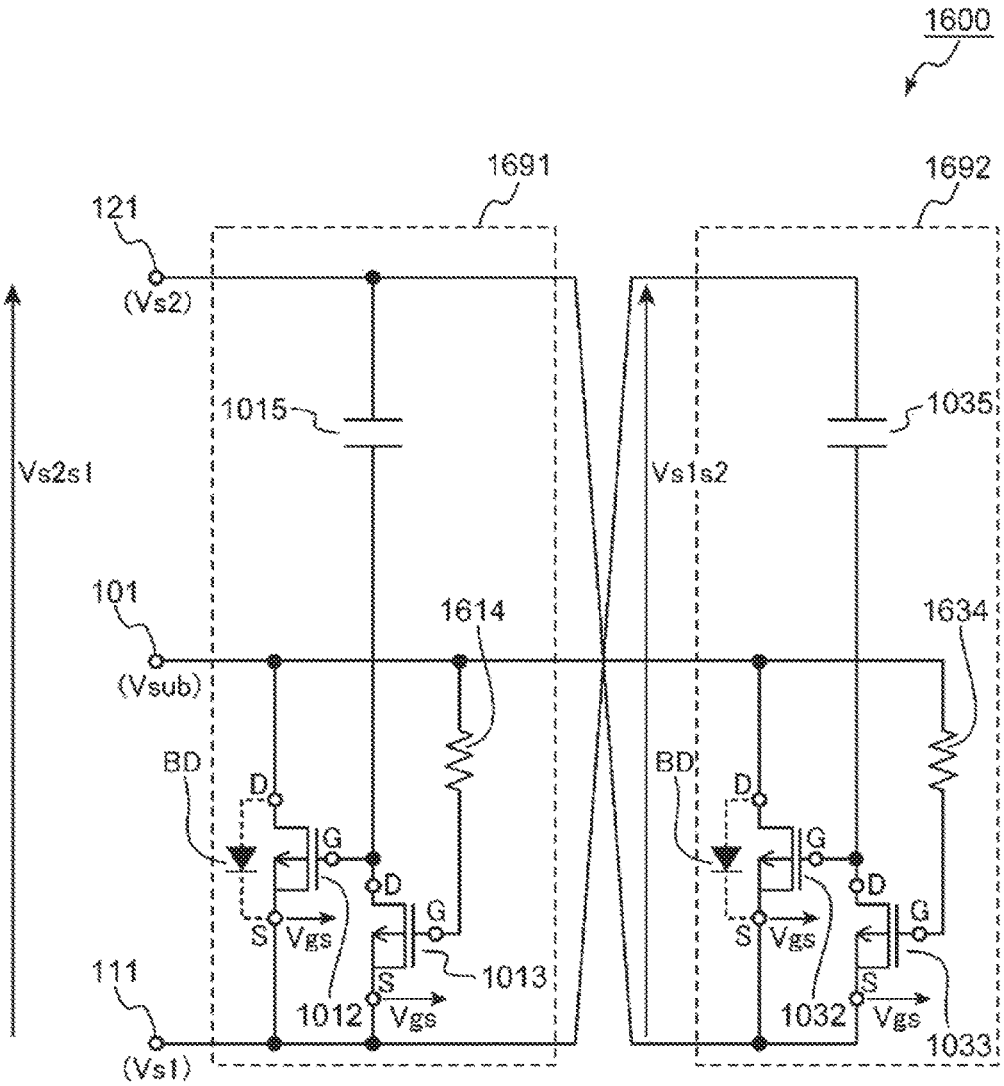
FIG. 19 is a diagram illustrating an example of a substrate voltage control circuit according to a seventh embodiment of the present disclosure.

FIG. 19 is a diagram illustrating an example of a substrate voltage control circuit 1600 according to a seventh embodiment of the present disclosure. Hereinafter, each component denoted by the same reference sign used for the component described in the fifth embodiment indicates the same component described in the fifth embodiment, and a description thereof is omitted appropriately.

The substrate voltage control circuit 1600 includes the first source connection terminal 111, the second source connection terminal 121, and the substrate voltage control terminal 101 that have been described in the fifth embodiment and a low-side circuit 1691 and a high-side circuit 1692.

The low-side circuit 1691 is a circuit for applying voltage at the first source connection terminal 111 to the substrate voltage control terminal 101. The high-side circuit 1692 is a circuit for applying voltage at the second source connection terminal 121 to the substrate voltage control terminal 101.

The low-side circuit 1691 includes the P-ch MOSFET 1012, the P-ch MOSFET 1013, and the capacitor 1015 that have been described in the fifth embodiment and a resistor 1614 (an example of a low-side resistor).

The resistor 1614 is a resistor for driving the gate terminal G of the P-ch MOSFET 1013. The resistor 1614 is connected between the substrate voltage control terminal 101 and the gate terminal G of the P-ch MOSFET 1013.

The high-side circuit 1692 includes the P-ch MOSFET 1032, the P-ch MOSFET 1033, and the capacitor 1035 that have been described in the fifth embodiment and a resistor 1634 (an example of a high-side resistor).

The resistor 1634 is a resistor for driving the gate terminal G of the P-ch MOSFET 1033. The resistor 1634 is connected between the substrate voltage control terminal 101 and the gate terminal G of the P-ch MOSFET 1033.

That is, the substrate voltage control circuit 1600 employs the resistors 1614 and 1634 in place of the diodes 1014 and 1034 of the substrate voltage control circuit 1000 illustrated in FIG. 13, respectively.

Operation of Low-Side Circuit 1691

Operation of the low-side circuit 1691 will be described next. When the voltage Vs2*s*1 is in a steady state in which the voltage Vs2*s*1 is a positive constant voltage, the voltage Vsub at the substrate voltage control terminal 101 is limited by the body diode BD of the P-ch MOSFET 1012 to be lower than or equal to a voltage obtained by adding threshold voltage Vf of the body diode BD to the voltage Vs1 at the first source connection terminal 111.

When the voltage Vs2*s*1 decreases in a positive voltage range, the voltage at the gate terminal G of the P-ch MOSFET 1012 decreases due to coupling caused by the capacitor 1015. When the gate voltage Vgs of the P-ch MOSFET 1012 consequently becomes lower than threshold voltage Vth of the P-ch MOSFET 1012, the P-ch MOSFET 1012 is set to the ON state and short-circuits the source terminal S and the drain terminal D of the P-ch MOSFET 1012. When the source terminal S and the drain terminal D of the P-ch MOSFET 1012 are short-circuited, the voltage Vs1 at the first source connection terminal 111 is applied to the substrate voltage control terminal 101 via the P-ch MOSFET 1012. Consequently, the voltage Vsub at the substrate voltage control terminal 101 becomes equal to the voltage Vs1. At that time, the P-ch MOSFET 1013 is in the OFF state because the voltage at the source terminal S and the voltage at the gate terminal G are equal.

As described above, when the voltage Vs2*s*1 decreases in the positive voltage range, the substrate voltage control circuit 1600 sets the voltage Vsub at the substrate voltage control terminal 101 to the voltage Vs1 at the first source connection terminal 111 and successfully prevents the floating state of the voltage Vsub at the substrate voltage control terminal 101. As a result, the substrate voltage control circuit 1600 successfully controls the bidirectional switching device 900 to operate with stable switching characteristics and with a reduced switching-characteristics variance between two current-flow directions.

Suppose that the voltage Vs2 at the second source connection terminal 121 becomes lower than the voltage Vs1 at the first source connection terminal 111 and consequently the voltage Vs2*s*1 changes from a positive voltage to a negative voltage. In this case, since the voltage Vsub at the substrate voltage control terminal 101 becomes equal to the voltage Vs1 at the first source connection terminal 111 when the voltage Vs2*s*1 is positive, the voltage Vs2 at the second source connection terminal 121 is lower than the voltage Vsub at the substrate voltage control terminal 101. Accordingly, the voltage at the source terminal S of the P-ch MOSFET 1032 connected to the second source connection terminal 121 is lower than the voltage at the drain terminal D of the P-ch MOSFET 1032 connected to the substrate voltage control terminal 101.

Consequently, current flows from the drain terminal D to the source terminal S of the P-ch MOSFET 1032 via the body diode BD and the voltage Vsub at the substrate voltage control terminal 101 is limited to be lower than or equal to a voltage obtained by adding the threshold voltage Vf of the body diode BD to the voltage Vs2 at the second source connection terminal 121. As a result, the voltage Vsub at the substrate voltage control terminal 101 decreases to follow the voltage Vs2*s*1 decreasing in the negative voltage range.

As described above, when the voltage Vs2*s*1 decreases in a negative voltage range, the substrate voltage control circuit 1600 successfully decreases the voltage Vsub at the substrate voltage control terminal 101 to follow a decrease in the voltage Vs2*s*1.

When the voltage Vsub decreases to follow the decrease in the voltage Vs2*s*1, current flows from the gate terminal G of the P-ch MOSFET 1013 to the substrate voltage control terminal 101 via the resistor 1614, and consequently the voltage at the gate terminal G of the P-ch MOSFET 1013 decreases to follow the decrease in the voltage Vsub. When the gate voltage Vgs of the P-ch MOSFET 1013 consequently becomes lower than threshold voltage Vth of the P-ch MOSFET 1013, the P-ch MOSFET 1013 is set to the ON state and short-circuits the source terminal S and the drain terminal D of the P-ch MOSFET 1013. As a result, the gate terminal G of the P-ch MOSFET 1012 and the first source connection terminal 111 have an equal potential, and the P-ch MOSFET 1012 is set to the OFF state.

If the P-ch MOSFET 1012 is not set to the OFF state at this time, the first source connection terminal 111 and the second source connection terminal 121 are short-circuited via the body diodes BD of the P-ch MOSFET 1012 and the P-ch MOSFET 1032 and large current may flow. As a result, the low-side circuit 1691 may fail to operate normally, and the low-side circuit 1691 may be damaged depending on the situation.

However, the substrate voltage control circuit 1600 successfully sets the P-ch MOSFET 1012 to the OFF state for sure when the voltage Vs2*s*1 decreases in the negative voltage range.

Note that the resistor 1614 may be connected between the second source connection terminal 121 and the gate terminal G of the P-ch MOSFET 1013 instead of being connected to the substrate voltage control terminal 101. With this configuration, when the voltage Vs2*s*1 decreases in the negative voltage range, current may be caused to flow from the gate terminal G of the P-ch MOSFET 1013 to the second source connection terminal 121 via the resistor 1614. In this way, the P-ch MOSFET 1013 may be set to the ON state, whereby the P-ch MOSFET 1012 may be set to the OFF state.

The high-side circuit 1692 has substantially the same circuit configuration as the low-side circuit 1691 except that connections to the first source connection terminal 111 and the second source connection terminal 121 are opposite and operates in substantially the same manner.

Operation of High-Side Circuit 1692

Operation of the high-side circuit 1692 will be described briefly below. When the voltage Vs1*s*2 is in a steady state in which the voltage Vs1*s*2 is a positive constant voltage, the voltage Vsub is limited by the body diode BD of the P-ch MOSFET 1032 to be lower than or equal to a voltage obtained by adding threshold voltage Vth of the P-ch MOSFET 1032 to the voltage Vs1.

When the voltage Vs1*s*2 decreases in a positive voltage range and the gate voltage Vgs of the P-ch MOSFET 1032 decreases due to coupling caused by the capacitor 1035, the P-ch MOSFET 1032 is set to the ON state and the voltage Vs2 at the second source connection terminal 121 is applied to the substrate voltage control terminal 101. Consequently, the voltage Vsub at the substrate voltage control terminal 101 becomes equal to the voltage Vs2.

As described above, when the voltage Vs1*s*2 decreases in the positive voltage range (when the voltage Vs2*s*1 increases in the negative voltage range), the substrate voltage control circuit 1600 successfully sets the voltage Vsub to the voltage Vs2 and prevents the flowing state of the substrate Vsub, When the voltage Vs1*s*2 changes from a positive voltage to a negative voltage, current flows from the drain terminal D to the source terminal S of the P-ch MOSFET 1032 via the body diode BD. Accordingly, the voltage Vsub is limited to be lower than or equal to a voltage obtained by adding threshold voltage Vf of the body diode BD to the voltage Vs2. As a result, the voltage Vsub at the substrate voltage control terminal 101 decreases to follow the voltage Vs1*s*2 decreasing in the negative voltage range.

As described above, when the voltage Vs1*s*2 decreases in the negative voltage range, the substrate voltage control circuit 1600 successfully decreases the voltage Vsub at the substrate voltage control terminal 101 to follow a decrease in the voltage Vs1*s*2.

When the voltage Vsub decreases to follow the decrease in the voltage Vs1*s*2, current flows from the gate terminal G of the P-ch MOSFET 1033 to the substrate voltage control terminal 101 via the resistor 1634. Consequently, the gate voltage Vgs of the P-ch MOSFET 1033 becomes lower than the threshold voltage Vth, and the P-ch MOSFET 1033 is set to the ON state. As a result, the gate terminal G of the P-ch MOSFET 1032 and the second source connection terminal 121 have an equal potential, and the P-ch MOSFET 1032 is set to the OFF state.

If the P-ch MOSFET 1032 is not set to the OFF state at this time, the first source connection terminal 111 and the second source connection terminal 121 are short-circuited via the body diodes BD of the P-ch MOSFET 1012 and the P-ch MOSFET 1032 and large current may flow. As a result, the high-side circuit 1692 may fail to operate normally, and the high-side circuit 1692 may be damaged depending on the situation.

However, the substrate voltage control circuit 1600 successfully sets the P-ch MOSFET 1032 to the OFF state for sure when the voltage Vs1*s*2 decreases in the negative voltage range.

Note that the resistor 1634 may be connected between the second source connection terminal 121 and the gate terminal G of the P-ch MOSFET 1033 instead of being connected to the substrate voltage control terminal 101. With this configuration, when the voltage Vs1*s*2 decreases in the negative voltage range, current may be caused to flow from the gate terminal G of the P-ch MOSFET 1033 to the second source connection terminal 121 via the resistor 1634. In this way, the P-ch MOSFET 1033 may be set to the ON state, whereby the P-ch MOSFET 1032 may be set to the OFF state.

Figure 20:
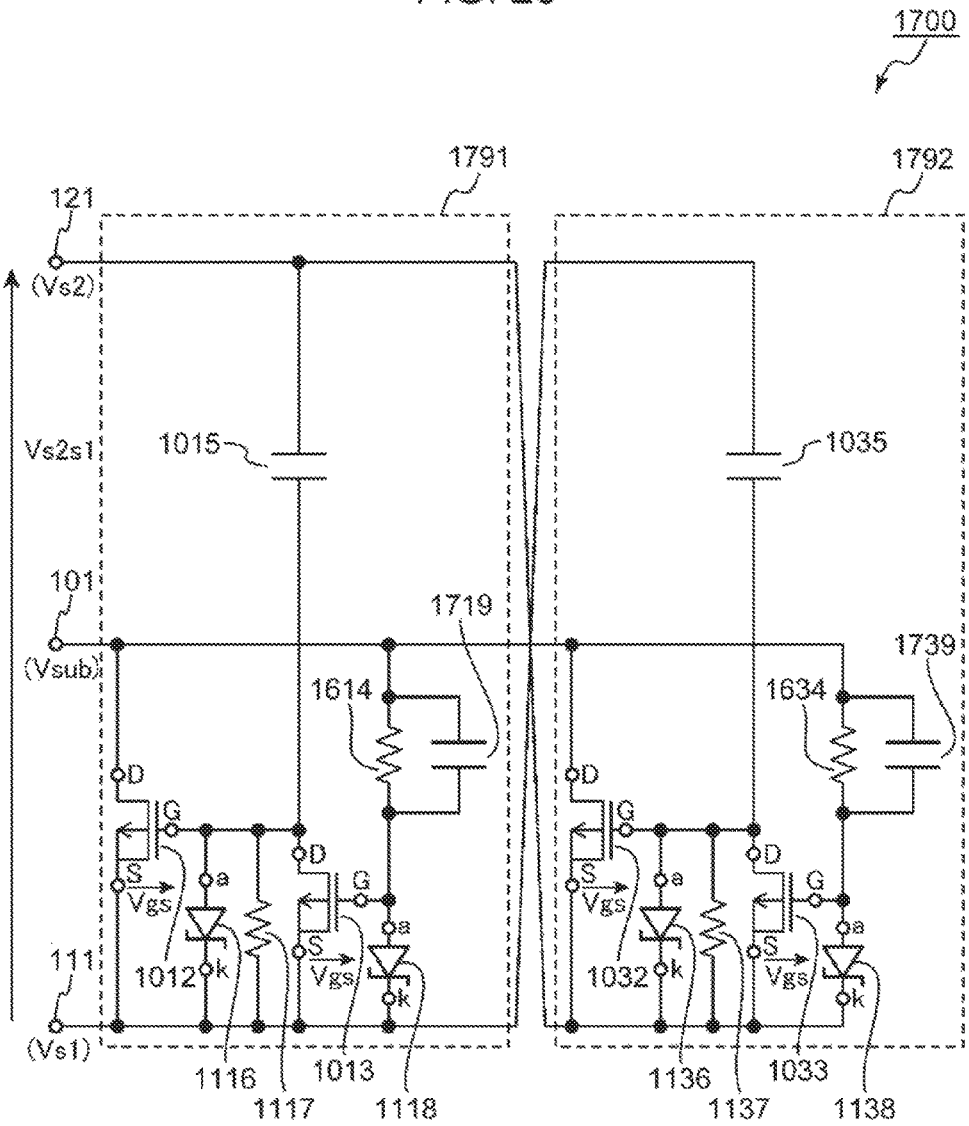
FIG. 20 is a diagram illustrating an example of a refined substrate voltage control circuit of the substrate voltage control circuit according to the seventh embodiment of the present disclosure.

The substrate voltage control circuit 1600 according to the seventh embodiment illustrated in FIG. 19 is configured by using the minimum number of components in order to describe the operation principle. Accordingly, a practical circuit needs refinements, such as protection circuits for the individual gate terminals G and a configuration for sufficiently improving the performance. A practical substrate voltage control circuit 1700 obtained by refining the substrate voltage control circuit 1600 will be described below with reference to FIG. 20 as an example. FIG. 20 is a diagram illustrating an example of the substrate voltage control circuit 1700 obtained by refining the substrate voltage control circuit 1600 according to the seventh embodiment of the present disclosure.

As illustrated in FIG. 20, the substrate voltage control circuit 1700 includes a low-side circuit 1791 and a high-side circuit 1792. The low-side circuit 1791 includes Zener diodes 1116 and 1118, a resistor 1117, and a capacitor 1719 in addition to the components of the low-side circuit 1691 illustrated in FIG. 19. The high-side circuit 1792 includes Zener diodes 1136 and 1138, a resister 1137, and a capacitor 1739 in addition to the components of the high-side circuit 1692 illustrated in FIG. 19.

Since the basic circuit configuration and operation of the substrate voltage control circuit 1700 illustrated in FIG. 20 are substantially the same as those of the substrate voltage control circuit 1600 described above, a description thereof is omitted. In addition, since the components 1116 to 1118 and 1136 to 1138 that are not included in the substrate voltage control circuit 1600 and are additionally included in the substrate voltage control circuit 1700 are the same as the components 1116 to 1118 and 1136 to 1138 that are not included in the substrate voltage control circuit 1000 and are additionally included in the substrate voltage control circuit 1100, a description thereof is omitted. Roles of the capacitors 1719 and 1739 that are not included in the substrate voltage control circuit 1600 illustrated in FIG. 19 and are additionally included in the substrate voltage control circuit 1700 illustrated in FIG. 20 will be described below.

The capacitor 1719 is connected between the substrate voltage control terminal 101 and the gate terminal G of the P-ch MOSFET 1013. With this configuration, the capacitor 1719 immediately decreases voltage at the gate terminal G of the P-ch MOSFET 1013 and sets the P-ch MOSFET 1013 to the ON state upon the voltage Vsub at the substrate voltage control terminal 101 starting to decrease.

The capacitor 1739 is connected between the substrate voltage control terminal 101 and the gate terminal G of the P-ch MOSFET 1033. With this configuration, the capacitor 1739 immediately decreases voltage at the gate terminal G of the P-ch MOSFET 1033 and sets the P-ch MOSFET 1033 to the ON state upon the voltage Vsub at the substrate voltage control terminal 101 starting to decrease.

Note that the capacitors 1015 and 1035 may each have a capacitance in a range from 0.1 nF to 10 nF, for example. The capacitors 1719 and 1739 may each have a capacitance in a range from 0.05 nF to 5 nF, for example. The resistors 1117, 1137, 1614 and 1634 may each have a resistance in a range from 100 kΩ to 1 MΩ, for example.

Simulation

A result of a circuit simulation performed by using the substrate voltage control circuit 1700 illustrated in FIG. 20 will be described next.

In this circuit simulation, the waveform of the voltage Vsub is observed when voltage Vs2 is changed from −150 V to +150 V and is changed from +150 V to −150 V with voltage Vs1 being fixed at 0 V. In this circuit simulation, a period for which the voltage Vs2*s*1 is changed is 100 ns.

Figure 21A:
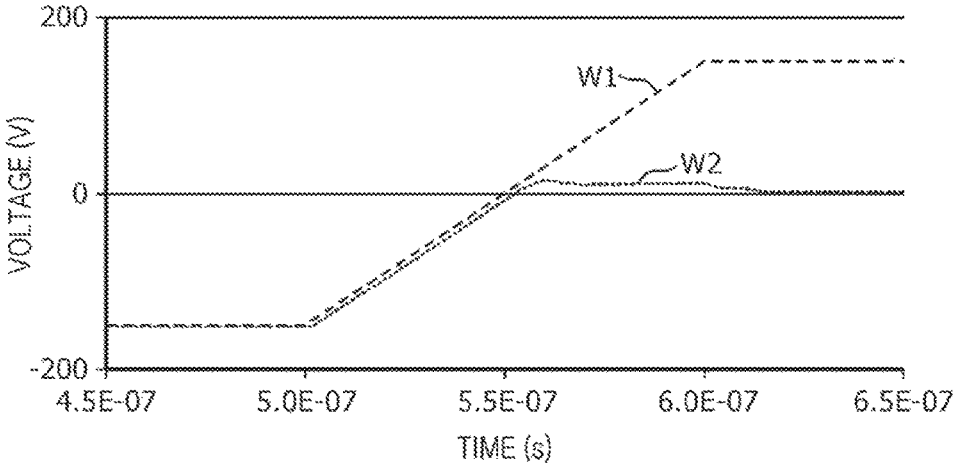
FIG. 21A is a waveform diagram illustrating a result of a circuit simulation in which the substrate voltage control circuit illustrated in FIG. 20 is used.
Figure 21B:
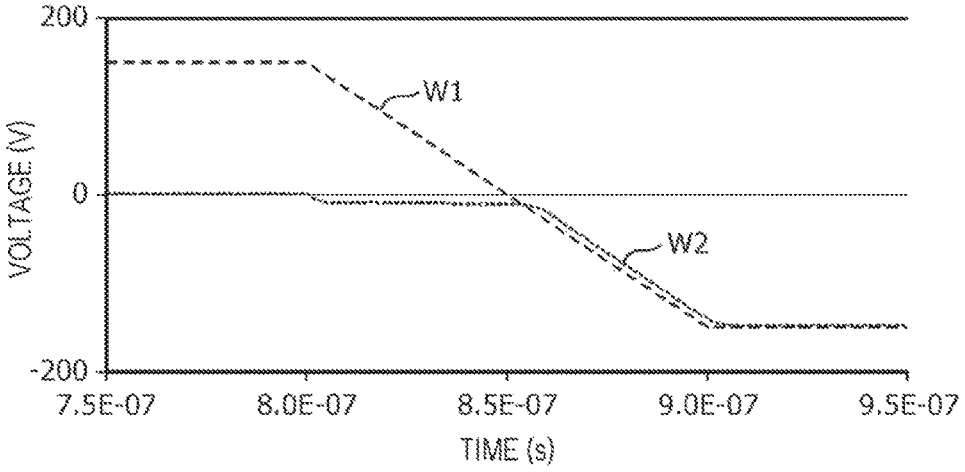
FIG. 21B is a waveform diagram illustrating a result of a circuit simulation in which the substrate voltage control circuit illustrated in FIG. 20 is used.

FIGS. 21A and 21B are waveform diagrams each illustrating the result of the circuit simulation in which the substrate voltage control circuit 1700 illustrated in FIG. 20 is used. FIG. 21A illustrates a waveform of the voltage Vsub when the voltage Vs2*s*1 is changed from a negative voltage to a positive voltage, whereas FIG. 21B illustrates a waveform of the voltage Vsub when the voltage Vs2*s*1 is changed from a positive voltage to a negative voltage. FIGS. 21A and 21B show two voltage waveforms W1 and W2. The voltage waveform W1 represents the waveform of the voltage Vs2*s*1, and the voltage waveform W2 represents the waveform of the voltage Vsub.

As illustrated in FIG. 21A, when the voltage Vs2*s*1 increases from a negative voltage to 0 V, the voltage waveform W2 increases along with the increasing voltage waveform W1. This indicates that the response of the voltage Vsub to the voltage Vs2, which is the lower one of the voltages Vs1 and Vs2, is very good. In addition, when the voltage Vs2*s*1 increases from 0 V, the voltage waveform W2 shows substantially 0 V. This indicates that the response of the voltage Vsub to the voltage Vs1 (0 V), which is the lower one of the voltages Vs1 and Vs2, is very good.

On the other hand, as illustrated in FIG. 21B, when the voltage Vs2s1 decreases from a positive voltage to 0 V, the voltage waveform W2 shows substantially 0 V. This indicates that the response of the voltage Vsub to the voltage Vs1 (0 V), which is the lower one of the voltages Vs1 and Vs2, is very good. In addition, when the voltage Vs2s1 decreases from 0 V to a negative voltage, the voltage waveform W2 decreases together with the decreasing voltage waveform W1. This indicates that the response of the voltage Vsub to the voltage Vs2, which is the lower one of the voltages Vs1 and Vs2, is very good.

As described above, the circuit simulation indicates that the substrate voltage control circuit 1700 successfully makes the voltage waveform W2 of the voltage Vsub be the closest to the ideal substrate terminal waveform 221 illustrated in FIG. 2.

Since the substrate voltage control circuits according to the embodiments of the present disclosure are usable for bidirectional switching devices and thus are useful in the technical field relating to matrix converters and the like.

The present disclosure also include aspects described below.

[Item 1] A substrate voltage control circuit comprising:

a first connection terminal;

a second connection terminal;

a substrate voltage control terminal;

a first switch having a first source, a first drain, and a first gate, the first source being connected to the substrate voltage control terminal, the first drain being connected to the first connection terminal;

a second switch having a second source, a second drain, and a second gate, the second drain being connected to the first gate;

a first capacitor connected between the second connection terminal and the second gate;

a first power supply connected between the substrate voltage control terminal and the second source;

a third switch having a third source, a third drain, and a third gate, the third source being connected to the substrate voltage control terminal, the third drain being connected to the second connection terminal;

a fourth switch having a fourth source, a fourth drain, and a fourth gate, the fourth drain being connected to the third gate;

a second capacitor connected between the first connection terminal and the fourth gate; and a second power supply connected between the substrate voltage control terminal and the fourth source.

[Item 2] The substrate voltage control circuit according to [Item 1], further comprising:

a first diode having a first anode and a first cathode, the first anode being connected to the substrate voltage control terminal, the first cathode being connected to the first gate; and a second diode having a second anode and a second cathode, the second anode being connected to the substrate voltage control terminal, the second cathode being connected to the third gate.

[Item 3] The substrate voltage control circuit according to [Item 2], wherein the first diode conducts current from the first anode to the first cathode when voltage at the substrate voltage control terminal is higher than voltage at the first connection terminal so as to make the voltage at the substrate voltage control terminal closer to the voltage at the first connection terminal, and the second diode conducts current from the second anode to the second cathode when the voltage at the substrate voltage control terminal is higher than voltage at the second connection terminal so as to make the voltage at the substrate voltage control terminal closer to the voltage at the second connection terminal.

[Item 4] The substrate voltage control circuit according to [Item 1], further comprising:

a third diode having a third anode and a third cathode, the third anode being connected to the first gate, the third cathode being connected to the second connection terminal; and a fourth diode having a fourth anode and a fourth cathode, the fourth anode being connected to the third gate, the fourth cathode being connected to the first connection terminal.

[Item 5] The substrate voltage control circuit according to [Item 4], wherein the third diode causes voltage at the first gate to be lower than threshold voltage of the first switch so as to set the first switch to an OFF state, by the time that voltage at the second connection terminal becomes equal to voltage at the first connection terminal, and the fourth diode causes voltage at the third gate to be lower than threshold voltage of the third switch so as to set the third switch to the OFF state, by the time that the voltage at the first connection terminal becomes equal to the voltage at the second connection terminal.

[Item 6] The substrate voltage control circuit according to [Item 1], wherein the first switch becomes in an ON state and causes the first source and the first drain to be short-circuited to each other when voltage at the first gate relative to voltage at the first source is higher than threshold voltage of the first switch, the first switch becomes in an OFF state and causes the first source and the first drain to be open-circuited to each other when the voltage at the first gate relative to the voltage at the first source is lower than the threshold voltage of the first switch, the third switch becomes in the ON state and causes the third source and the third drain to be short-circuited to each other when voltage at the third gate relative to voltage at the third source is higher than threshold voltage of the third switch, and the third switch becomes in the OFF state and causes the third source and the third drain to be open-circuited to each other when the voltage at the third gate relative to the voltage at the third source is lower than the threshold voltage of the third switch.

[Item 7] The substrate voltage control circuit according to [Item 1], wherein each of the first switch and the third switch is one of a metal oxide semiconductor field effect transistor (MOSFET), an insulated gate bipolar transistor (IGBT), a junction field effect transistor (JFET), a static induced transistor (SIT), and a high electron mobility transistor (HEMT).

[Item 8] The substrate voltage control circuit according to [Item 1], wherein the first switch includes a first body diode configured such that current flows from the first source to the first drain via the first body diode when voltage at the first source is higher than voltage at the first drain, and the third switch includes a third body diode configured such that current flows from the third source to the third drain via the third body diode when voltage at the third source is higher than voltage at the third drain.

[Item 9] A substrate voltage control circuit comprising:

a first connection terminal;

a second connection terminal;

a substrate voltage control terminal;

a first switch having a first source, a first drain, and a first gate, the first source being connected to the first connection terminal, the first drain being connected to the substrate voltage control terminal;

a second switch having a second source, a second drain, and a second gate, the second source being connected to the first connection terminal, the second drain being connected to the first gate;

a first capacitor connected between the second connection terminal and the second drain;

a third switch including a third source, a third drain, and a third gate, the third source being connected to the second connection terminal and the third drain being connected to the substrate voltage control terminal;

a fourth switch including a fourth source, a fourth drain, and a fourth gate, the fourth source being connected to the second connection terminal and the fourth drain being connected to the third gate; and a second capacitor connected between the first connection terminal and the fourth drain.

[Item 10] The substrate voltage control circuit according to [Item 9], further comprising:

a first diode having a first anode and a first cathode, the first anode being connected to the second gate, the first cathode being connected to the substrate voltage control terminal; and a second diode having a second anode and a second cathode, the second anode being connected to the fourth gate, the second cathode being connected to the substrate voltage control terminal.

[Item 11] The substrate voltage control circuit according to [Item 9], further comprising:

a third capacitor connected between the substrate voltage control terminal and the second gate; and a fourth capacitor connected between the substrate voltage control terminal and the fourth gate.

[Item 12] The substrate voltage control circuit according to [Item 9], further comprising:

a first resistor connected between the substrate voltage control terminal and the second gate; and a second resistor connected between the substrate voltage control terminal and the fourth gate.

[Item 13] The substrate voltage control circuit according to [Item 9], wherein the first switch becomes in an ON state and causes the first source and the first drain to be short-circuited to each other when voltage at the first gate relative to voltage at the first source is lower than threshold voltage of the first switch, the first switch becomes in an OFF state and causes the first source and the first drain to be open-circuited to each other when the voltage at the first gate relative to the voltage at the first source is higher than the threshold voltage of the first switch, the third switch becomes in the ON state and causes the third source and the third drain to be short-circuited to each other when voltage at the third gate relative to voltage at the third source is lower than threshold voltage of the third switch, and the third switch becomes in the OFF state and causes the third source and the third drain to be open-circuited to each other when the voltage at the third gate relative to the voltage at the third source is higher than the threshold voltage of the third switch.

[Item 14] The substrate voltage control circuit according to [Item 9], wherein each of the first switch and the third switch is one of a metal oxide semiconductor field effect transistor (MOSFET), an insulated gate bipolar transistor (IGBT), a junction field effect transistor (JFET), a static induced transistor (SIT), and a high electron mobility transistor (HEMT).

[Item 15] The substrate voltage control circuit according to [Item 9], wherein the first switch includes a first body diode configured such that current flows from the first drain to the first source via the first body diode when voltage at the first source is lower than voltage at the first drain, and the third switch includes a second body diode configured such that current flows from the third drain to the third source via the second body diode when voltage at the third source is lower than voltage at the third drain.

[Item 16] The substrate voltage control circuit according to [Item 10], further comprising:

a third capacitor connected between the first anode and the second gate; and a fourth capacitor connected between the second anode and the fourth gate, wherein the first capacitor and the second capacitor each have a capacitance value that is greater than or equal to 0.1 nF and less than or equal to 100 nF, and the third capacitor and the fourth capacitor each have a capacitance value that is greater than or equal to 0.05 nF and less than or equal to 50 nF.

[Item 17] The substrate voltage control circuit according to [Item 10], further comprising:

a first resistor connected between the first gate and the first connection terminal;

a second resistor connected between the second gate and the first connection terminal;

a third resistor connected between the first anode and the second gate;

a fourth resistor connected between the third gate and the second connection terminal;

a fifth resistor connected between the fourth gate and the second connection terminal; and a sixth resistor connected between the second anode and the fourth gate, wherein the first resistor, the second resistor, the third resistor, the fourth resistor, the fifth resistor, and the sixth resistor each have a resistance value that is greater than or equal to 10 kΩ and less than or equal to 1 MΩ.

What is claimed is:

1. A substrate voltage control circuit comprising:

a first connection terminal;

a second connection terminal;

a substrate voltage control terminal;

a first switch having a first source, a first drain, and a first gate, the first source being connected to the substrate voltage control terminal, the first drain being connected to the first connection terminal;

a first resistor connected between the first gate and the second connection terminal;

a second switch having a second source, a second drain, and a second gate, the second source being connected to the substrate voltage control terminal, the second drain being connected to the second connection terminal; and a second resistor connected between the second gate and the first connection terminal, wherein the first switch becomes in an ON state and causes the first source and the first drain to be short-circuited to each other when voltage at the first gate relative to voltage at the first source is higher than threshold voltage of the first switch, the first switch becomes in an OFF state and causes the first source and the first drain to be open-circuited to each other when the voltage at the first gate relative to the voltage at the first source is lower than the threshold voltage of the first switch, the second switch becomes in an ON state and causes the second source and the second drain to be short-circuited to each other when voltage at the second gate relative to voltage at the second source is higher than threshold voltage of the second switch, and the second switch becomes in an OFF state and causes the second source and the second drain to be open-circuited to each other when the voltage at the second gate relative to the voltage at the second source is lower than the threshold voltage of the second switch.

2. The substrate voltage control circuit according to claim 1, wherein the first resistor and the second resistor each have a resistance value that is greater than or equal to 500Ω and less than or equal to 500 kΩ.

3. The substrate voltage control circuit according to claim 1, wherein each of the first switch and the second switch is one of a metal oxide semiconductor field effect transistor, an insulated gate bipolar transistor, a junction field effect transistor, a static induced transistor, and a high electron mobility transistor.

4. The substrate voltage control circuit according to claim 1, wherein the first switch includes a first body diode configured such that current flows from the first source to the first drain via the first body diode when voltage at the first source is higher than voltage at the first drain, and the second switch includes a second body diode configured such that current flows from the second source to the second drain via the second body diode when voltage at the second source is higher than voltage at the second drain.

5. A module comprising:

a bidirectional switch including a first terminal, a second terminal, and a substrate terminal; and the substrate voltage control circuit according to claim 1, wherein the first connection terminal, the second connection terminal, and the substrate voltage control terminal of the substrate voltage control circuit are connected with the first terminal, the second terminal, and the substrate terminal of the bidirectional switch, respectively.

6. The module according to claim 5, wherein the substrate voltage control circuit causes voltage at the substrate terminal to be equal to the lower one of voltage at the first terminal and voltage at the second terminal.

7. A substrate voltage control circuit comprising:

a first connection terminal;

a second connection terminal;

a substrate voltage control terminal;

a first switch having a first source, a first drain, and a first gate, the first source being connected to the substrate voltage control terminal, the first drain being connected to the first connection terminal;

a first resistor connected between the first gate and the second connection terminal;

a second switch having a second source, a second drain, and a second gate, the second source being connected to the substrate voltage control terminal, the second drain being connected to the second connection terminal;

a second resistor connected between the second gate and the first connection terminal;

a first diode having a first anode and a first cathode, the first anode being connected to the first gate, the first cathode being connected to the second connection terminal; and a second diode having a second anode and a second cathode, the second anode being connected to the second gate, the second cathode being connected to the first connection terminal, wherein the first diode causes voltage at the first gate to be lower than threshold voltage of the first switch so as to set the first switch to an OFF state, by the time that voltage at the second connection terminal becomes equal to voltage at the first connection terminal, and the second diode causes voltage at the second gate to be lower than threshold voltage of the second switch so as to set the second switch to an OFF state, by the time that the voltage at the first connection terminal becomes equal to the voltage at the second connection terminal.

8. A substrate voltage control circuit comprising:

a first connection terminal;

a second connection terminal;

a substrate voltage control terminal;

a first switch having a first source, a first drain, and a first gate, the first source being connected to the substrate voltage control terminal, the first drain being connected to the first connection terminal;

a first resistor connected between the first gate and the second connection terminal;

a second switch having a second source, a second drain, and a second gate, the second source being connected to the substrate voltage control terminal, the second drain being connected to the second connection terminal;

a second resistor connected between the second gate and the first connection terminal;

a first capacitor connected between the first connection terminal and the first gate; and a second capacitor connected between the second connection terminal and the second gate.

9. The substrate voltage control circuit according to claim 8, wherein the first capacitor suppresses drop of voltage at the first gate such that the first switch keeps in an ON state, until voltage at the second connection terminal relative to voltage at the first connection terminal decreases to be close to 0 V in a positive voltage range, and the second capacitor suppresses drop of voltage at the second gate such that the second switch keeps in an ON state, until the voltage at the second connection terminal relative to the voltage at the first connection terminal increases to be close to 0 V in a negative voltage range.

10. The substrate voltage control circuit according to claim 8, wherein the first capacitor and the second capacitor each have a capacitance value that is greater than or equal to 100 pF and less than or equal to 10 nF.

* * * * *